US007881630B2

(12) United States Patent
Mitsuoka et al.

(10) Patent No.: US 7,881,630 B2
(45) Date of Patent: Feb. 1, 2011

(54) TEMPERATURE CONTROL DEVICE, TEMPERATURE CONTROL METHOD, FIXING DEVICE, IMAGE FORMING APPARATUS, TEMPERATURE CONTROL PROGRAM, COMPUTER-READABLE RECORDING MEDIUM, AND COMPUTER DATA SIGNAL

(75) Inventors: Tetsunori Mitsuoka, Tondabayashi (JP); Atsushi Ide, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 1047 days.

(21) Appl. No.: 11/603,250

(22) Filed: Nov. 22, 2006

(65) Prior Publication Data

US 2007/0122173 A1 May 31, 2007

(30) Foreign Application Priority Data

Nov. 25, 2005 (JP) ..... 2005-341144
Nov. 2, 2006 (JP) ..... 2006-299511

(51) Int. Cl.
*G03G 15/20* (2006.01)

(52) U.S. Cl. ..... 399/69

(58) Field of Classification Search ..... 399/69
See application file for complete search history.

(56) References Cited

U.S. PATENT DOCUMENTS 6,367,972 B1 4/2002 Kamiyama
6,654,571 B2 * 11/2003 Kume et al. ..... 399/69
7,062,187 B2 * 6/2006 Peng et al. ..... 399/69
2002/0094212 A1 * 7/2002 Suzumi ..... 399/69
2004/0028420 A1 * 2/2004 Aslam et al. ..... 399/45
2005/0013622 A1 * 1/2005 Omoto et al. ..... 399/69
2005/0061792 A1 * 3/2005 Kagawa et al. ..... 219/216
2005/0207774 A1 * 9/2005 Sone et al. ..... 399/69
2006/0245779 A1 11/2006 Sone et al.

FOREIGN PATENT DOCUMENTS

JP 11-133796 5/1999
JP 11-223555 8/1999
JP 2002-156284 5/2002
JP 2003-149981 5/2003
JP 2003-149981 A 5/2003
JP 2003-302288 10/2003
JP 2005-275408 A 10/2005
JP 2005-315990 A 11/2005

* cited by examiner

*Primary Examiner*—David M Gray
*Assistant Examiner*—Andrew V Do
(74) *Attorney, Agent, or Firm*—Nixon & Vanderhye, PC

(57) ABSTRACT

The present invention carries out temperature detection and temperature control accurately in a temperature control device using a noncontact-type temperature detecting section. The temperature control device obtains the surface temperature of a fixing roller by using a temperature correspondence table in which correspondences between output voltage values of a main NTC thermistor which detects heat generated by infrared radiation from the fixing roller and the surface temperatures of the fixing roller are shown for respective output voltage values of a compensation NTC thermistor. Here, the output voltage values of the main NTC thermistor and the output voltage values of the compensation NTC thermistor are set in the temperature correspondence table so that an interval between adjacent values of the compensation temperatures corresponding to the output voltage values of the compensation NTC thermistor is smaller than an interval between adjacent values of the surface temperatures of the fixing roller which temperatures correspond to the output values of the main NTC thermistor.

30 Claims, 41 Drawing Sheets

FIG. 1

| | SURFACE TEMPERATURE (°C) | 0 | ··· | 168 | 169 | 170 | 171 | 172 | ··· | 250 |
|---|---|---|---|---|---|---|---|---|---|---|
| COMPENSATION TEMPERATURE (°C) | COMPENSATION OUTPUT (V2) | DETECTION OUTPUT (V1) | | | | | | | | |
| 0 | 3.1931 | 3.1891 | ··· | 3.1280 | 3.1273 | 3.1265 | 3.1258 | 3.1250 | ··· | 3.0334 |
| ⋮ | ⋮ | | | ⋮ | ⋮ | ⋮ | ⋮ | ⋮ | | ⋮ |
| 99.0 | 1.7682 | | ··· | 1.6443 | 1.6425 | 1.6408 | 1.6390 | 1.6372 | ··· | 1.4626 |
| 99.2 | 1.7641 | | ··· | 1.6406 | 1.6388 | 1.6370 | 1.6353 | 1.6335 | ··· | 1.4591 |
| 99.4 | 1.7600 | | ··· | 1.6368 | 1.6351 | 1.6333 | 1.6315 | 1.6297 | ··· | 1.4556 |
| 99.6 | 1.7559 | | ··· | 1.6331 | 1.6313 | 1.6296 | 1.6278 | 1.6260 | ··· | 1.4499 |
| 99.8 | 1.7518 | | ··· | 1.6294 | 1.6276 | 1.6259 | 1.6241 | 1.6223 | ··· | 1.4485 |
| 100.0 | 1.7477 | | ··· | 1.6256 | 1.6239 | 1.6221 | 1.6204 | 1.6186 | ··· | 1.4450 |
| 100.2 | 1.7436 | | ··· | 1.6219 | 1.6202 | 1.6184 | 1.6167 | 1.6149 | ··· | 1.4415 |
| 100.4 | 1.7395 | | ··· | 1.6182 | 1.6165 | 1.6147 | 1.6129 | 1.6112 | ··· | 1.4380 |
| 100.6 | 1.7354 | | ··· | 1.6145 | 1.6128 | 1.6110 | 1.6092 | 1.6075 | ··· | 1.4367 |
| 100.8 | 1.7313 | | ··· | 1.6108 | 1.6091 | 1.6073 | 1.6055 | 1.6038 | ··· | 1.4311 |
| 101.0 | 1.7272 | | ··· | 1.6071 | 1.6054 | 1.6036 | 1.6019 | 1.6001 | ··· | 1.4276 |
| ⋮ | ⋮ | | | ⋮ | ⋮ | ⋮ | ⋮ | ⋮ | | ⋮ |
| 150.0 | 0.8920 | | ··· | 0.8613 | 0.8603 | 0.8593 | 0.8583 | 0.8573 | ··· | 0.7665 |

FIG. 8

| | SURFACE TEMPERATURE (°C) | 0 | ··· | 168 | 169 | 170 (N) | 171 | 172 | ··· | 250 |
|---|---|---|---|---|---|---|---|---|---|---|
| COMPENSATION TEMPERATURE (°C) | COMPENSATION OUTPUT (V2) | DETECTION OUTPUT (V1) | | | | | | | | |
| 0 | 3.1931 | 3.1891 | ··· | 3.1280 | 3.1273 | 3.1265 | 3.1258 | 3.1250 | ··· | 3.0334 |
| ⋮ | ⋮ | | | ⋮ | ⋮ | ⋮ | ⋮ | ⋮ | | ⋮ |
| 99.0 | 1.7682 | | ··· | 1.6443 | 1.6425 | 1.6408 | 1.6390 | 1.6372 | ··· | 1.4626 |
| 99.2 | 1.7641 | | ··· | 1.6406 | 1.6388 | 1.6370 | 1.6353 | 1.6335 | ··· | 1.4591 |
| 99.4 | 1.7600 | | ··· | 1.6368 | 1.6351 | 1.6333 | 1.6315 | 1.6297 | ··· | 1.4556 |
| 99.6 | 1.7559 | | ··· | 1.6331 | 1.6313 | 1.6296 | 1.6278 | 1.6260 | ··· | 1.4499 |
| 99.8 | 1.7518 | | ··· | 1.6294 | 1.6276 | 1.6259 | 1.6241 | 1.6223 | ··· | 1.4485 |
| 100.0 (L) | 1.7477 | | | 1.6256 | 1.6239 | 1.6221 (M) | 1.6204 | 1.6186 | ··· | 1.4450 |
| 100.2 | 1.7436 | | ··· | 1.6219 | 1.6202 | 1.6184 | 1.6167 | 1.6149 | ··· | 1.4415 |
| 100.4 | 1.7395 | | ··· | 1.6182 | 1.6165 | 1.6147 | 1.6129 | 1.6112 | ··· | 1.4380 |
| 100.6 | 1.7354 | | ··· | 1.6145 | 1.6128 | 1.6110 | 1.6092 | 1.6075 | ··· | 1.4367 |
| 100.8 | 1.7313 | | ··· | 1.6108 | 1.6091 | 1.6073 | 1.6055 | 1.6038 | ··· | 1.4311 |
| 101.0 | 1.7272 | | ··· | 1.6071 | 1.6054 | 1.6036 | 1.6019 | 1.6001 | ··· | 1.4276 |
| ⋮ | ⋮ | | | ⋮ | ⋮ | ⋮ | ⋮ | ⋮ | | ⋮ |
| 150.0 | 0.8920 | | ··· | 0.8613 | 0.8603 | 0.8593 | 0.8583 | 0.8573 | ··· | 0.7665 |

TABLE USED AT LOW TEMPERATURE AND LOW HUMIDITY

TABLE USED AT HIGH TEMPERATURE AND HIGH HUMIDITY

FIG. 17

| REFERENCE VOLTAGE | VOLTAGE TOLERANCE | | | | | | |
|---|---|---|---|---|---|---|---|
| | −5% | −2% | −1% | 0% | +1% | +2% | +5% |
| 5. 0V | 4. 75V | 4. 9V | 4. 95V | 5. 0V | 5. 05V | 5. 1V | 5. 25V |
| | △ | ○ | ○ | ○ | △ | × | × |
| 3. 3V | 3. 135V | 3. 234V | 3. 267V | 3. 3V | 3. 333V | 3. 366V | 3. 465V |
| | △ | ○ | ○ | ○ | ○ | △ | × |

FIG. 18

| TOLERANCE OF RESISTANCE VALUE OF PULL-UP RESISTOR | | | | |
|---|---|---|---|---|
| −2% | −1% | 0% | +1% | +2% |
| 32. 34kΩ | 32. 67kΩ | 33kΩ | 33. 33kΩ | 33. 66kΩ |
| × | ○ | ○ | ○ | × |

FIG. 19

| CONDITIONS OF A/D CONVERSION AT THE TIME OF SIGNAL READING | | QUANTIZATION RESOLUTION | 8bit | 10bit | 12bit | 14bit | 16bit |
|---|---|---|---|---|---|---|---|
| | | QUANTIZATION LEVEL | 256 | 1024 | 4096 | 16384 | 65536 |
| REFERENCE VOLTAGE | 3.3 V | | × | ○ | ○ | ○ | ○ |
| | 5.0 V | | × | △ | ○ | ○ | ○ |

FIG. 20

| INPUT-OFFSET VOLTAGE OF SIGNAL PROCESSING AMPLIFIER | | | | |
|---|---|---|---|---|
| 0. 1mV | 0. 5mV | 1mV | 2mV | 5mV |
| ○ | ○ | ○ | △ | × |

FIG. 23 (a)

CORRECTION VALUES CORRESPONDING TO THE NUMBERS OF SHEETS (POSTCARD, AT NORMAL TEMPERATURE AND NORMAL HUMIDITY)

| THE NUMBER OF PRINTED SHEETS (OR SURFACES) | UP TO 10 | UP TO 20 | UP TO 50 | UP TO 100 | UP TO 150 | 151 OR MORE |
|---|---|---|---|---|---|---|
| CORRECTION VALUE (°C) | −5 | −8 | −10 | −10 | −10 | −10 |

FIG. 23 (b)

CORRECTION VALUES CORRESPONDING TO THE NUMBERS OF SHEETS (POSTCARD, AT LOW TEMPERATURE AND LOW HUMIDITY)

| THE NUMBER OF PRINTED SHEETS (OR SURFACES) | UP TO 10 | UP TO 20 | UP TO 50 | UP TO 100 | UP TO 150 | 151 OR MORE |
|---|---|---|---|---|---|---|
| CORRECTION VALUE (°C) | −3 | −6 | −8 | −9 | −9 | −10 |

FIG. 23 (c)

CORRECTION VALUES CORRESPONDING TO THE NUMBERS OF SHEETS (POSTCARD, AT HIGH TEMPERATURE AND HIGH HUMIDITY)

| THE NUMBER OF PRINTED SHEETS (OR SURFACES) | UP TO 10 | UP TO 20 | UP TO 50 | UP TO 100 | UP TO 150 | 151 OR MORE |
|---|---|---|---|---|---|---|
| CORRECTION VALUE (°C) | −6 | −9 | −10 | −10 | −11 | −12 |

FIG. 24

| COMPENSATION TEMPERATURE (°C) | 90°C<Tc | 90≦Tc<95°C | 95≦Tc<100°C | 100≦Tc<105°C | 105≦Tc<110°C |
|---|---|---|---|---|---|
| CORRECTION VALUE (°C) | 0 | 0 | 0 | 0 | 0 |
| COMPENSATION TEMPERATURE (°C) | 110≦Tc<115°C | 115≦Tc<120°C | 120≦Tc<125°C | 125≦Tc<130°C | Tc≧130°C |
| CORRECTION VALUE (°C) | 0 | 0 | 0 | −1 | −1 |

FIG. 26 (a)

CORRECTION VALUES CORRESPONDING TO THE NUMBERS OF SHEETS (INVOICE R)

| THE NUMBER OF PRINTED SHEETS (OR SURFACES) | UP TO 10 | UP TO 20 | UP TO 50 | UP TO 100 | UP TO 150 | 151 OR MORE |
|---|---|---|---|---|---|---|
| CORRECTION VALUE (°C) | 0 | −1 | −3 | −4 | −4 | −4 |

FIG. 26 (b)

CORRECTION VALUES WITH RESPECT TO TEMPERATURES OF CASE OF TEMPERATURE DETECTING SECTION (INVOICE R)

| COMPENSATION TEMPERATURE (°C) | 90°C<Tc | 90≦Tc<95°C | 95≦Tc<100°C | 100≦Tc<105°C | 105≦Tc<110°C |
|---|---|---|---|---|---|
| CORRECTION VALUE (°C) | 0 | −1 | −2 | −5 | −5 |
| COMPENSATION TEMPERATURE (°C) | 110≦Tc<115°C | 115≦Tc<120°C | 120≦Tc<125°C | 125≦Tc<130°C | Tc≧130°C |
| CORRECTION VALUE (°C) | −5 | −5 | −5 | −5 | −6 |

FIG. 27 (a) CORRECTION VALUES OF TARGET TEMPERATURE TS1 CORRESPONDING TO THE NUMBERS OF PRINTED SHEETS (A4, FINAL TARGET TEMPERATURE: 170°C)

| THE NUMBER OF PRINTED SHEETS (OR SURFACES) | UP TO 10 | UP TO 20 | UP TO 50 | UP TO 100 | UP TO 150 | 151 OR MORE |
|---|---|---|---|---|---|---|
| CORRECTION VALUE (°C) | −10 | −5 | 0 | 0 | 0 | +5 |

FIG. 27 (b) CHANGES IN TARGET TEMPERATURE TS1 (A4, FINAL TARGET TEMPERATURE: 170°C)

| THE NUMBER OF PRINTED SHEETS (OR SURFACES) | UP TO 10 | UP TO 20 | UP TO 50 | UP TO 100 | UP TO 150 | 151 OR MORE |
|---|---|---|---|---|---|---|
| TARGET TEMPERATURE (°C) | 160 | 165 | 170 | 170 | 170 | 175 |

FIG. 27 (c) CORRECTION VALUES CORRESPONDING TO CHANGES IN TARGET TEMPERATURE TS1 (A4)

| TARGET TEMPERATURE TS1 (°C) | CORRECTION AMOUNT (°C) |
|---|---|
| LOWER THAN 140°C | +3 |
| 140°C～149°C | +2 |
| 150°C～159°C | +1 |
| 160°C～172°C | 0 |
| 173°C～174°C | −1 |
| 175°C～184°C | −2 |
| 185°C～194°C | −3 |
| 195°C～204°C | −4 |
| 205°C OR HIGHER | −5 |

FIG. 28 (a) CORRECTION VALUES OF TARGET TEMPERATURE TS3 (B4, FINAL TARGET TEMPERATURE: 180°C)

| THE NUMBER OF PRINTED SHEETS (OR SURFACES) | UP TO 10 | UP TO 20 | UP TO 50 | UP TO 100 | UP TO 150 | 151 OR MORE |
|---|---|---|---|---|---|---|
| CORRECTION VALUE (°C) | −10 | 0 | +5 | +10 | +10 | +10 |

FIG. 28 (b) CHANGES IN TARGET TEMPERATURE TS3 (B4, FINAL TARGET TEMPERATURE: 180°C)

| THE NUMBER OF PRINTED SHEETS (OR SURFACES) | UP TO 10 | UP TO 20 | UP TO 50 | UP TO 100 | UP TO 150 | 151 OR MORE |
|---|---|---|---|---|---|---|
| TARGET TEMPERATURE (°C) | 170 | 180 | 185 | 190 | 190 | 190 |

FIG. 28 (c) CORRECTION VALUES CORRESPONDING TO CHANGES IN TARGET TEMPERATURE TS3 (B4)

| TARGET TEMPERATURE TS3 (°C) | CORRECTION AMOUNT (°C) |
|---|---|
| LOWER THAN 140°C | +4 |
| 140°C～154°C | +3 |
| 155°C～160°C | +2 |
| 161°C～164°C | +1 |
| 165°C～172°C | 0 |
| 173°C～174°C | −1 |
| 175°C～184°C | −2 |
| 185°C～194°C | −3 |
| 195°C～204°C | −4 |
| 205°C OR HIGHER | −5 |

FIG. 30 (a) CORRECTION VALUES CORRESPONDING TO THE NUMBERS OF PRINTED SHEETS (A5R)

| THE NUMBER OF PRINTED SHEETS (OR SURFACES) | UP TO 10 | UP TO 20 | UP TO 50 | UP TO 100 | UP TO 150 | 151 OR MORE |
|---|---|---|---|---|---|---|
| CORRECTION VALUE (°C) | −2 | −2 | −3 | −4 | −4 | −4 |

FIG. 30 (b) CHANGES IN SET TEMPERATURE OF TARGET TEMPERATURE TS1 (A5R)

| THE NUMBER OF PRINTED SHEETS (OR SURFACES) | UP TO 10 | UP TO 20 | UP TO 50 | UP TO 100 | UP TO 150 | 151 OR MORE |
|---|---|---|---|---|---|---|
| TARGET TEMPERATURE (°C) | 163 | 170 | 170 | 170 | 170 | 170 |

FIG. 30 (c) CHANGES IN SET TEMPERATURE OF TARGET TEMPERATURE TS3 (A5R)

| THE NUMBER OF PRINTED SHEETS (OR SURFACES) | UP TO 10 | UP TO 20 | UP TO 50 | UP TO 100 | UP TO 150 | 151 OR MORE |
|---|---|---|---|---|---|---|
| TARGET TEMPERATURE (°C) | 160 | 160 | 165 | 165 | 165 | 165 |

FIG. 30 (d) CHANGES IN SET TEMPERATURE OF TARGET TEMPERATURE TS2 (A5R)

| THE NUMBER OF PRINTED SHEETS (OR SURFACES) | UP TO 10 | UP TO 20 | UP TO 50 | UP TO 100 | UP TO 150 | 151 OR MORE |
|---|---|---|---|---|---|---|
| TARGET TEMPERATURE (°C) | 120 | 140 | 150 | 160 | 160 | 160 |

FIG. 30 (e) CORRECTION VALUES CORRESPONDING TO CHANGES IN TARGET TEMPERATURE TS1 (A5R)

| TARGET TEMPERATURE TS1 (°C) | CORRECTION AMOUNT (°C) |
|---|---|
| LOWER THAN 140°C | +4 |
| 140°C～154°C | +3 |
| 155°C～160°C | +2 |
| 161°C～164°C | +1 |
| 165°C～172°C | 0 |
| 173°C～174°C | −1 |
| 175°C～184°C | −2 |
| 185°C～194°C | −3 |
| 195°C～204°C | −4 |
| 205°C OR HIGHER | −5 |

FIG. 30 (f) CORRECTION VALUES CORRESPONDING TO CHANGES IN TARGET TEMPERATURE TS3 (A5R)

| TARGET TEMPERATURE TS3 (°C) | CORRECTION AMOUNT (°C) |
|---|---|
| LOWER THAN 135°C | +2 |
| 135°C～154°C | +1 |
| 155°C～166°C | 0 |
| 167°C～169°C | −1 |
| 170°C～174°C | −2 |
| 175°C～185°C | −3 |
| 186°C～200°C | −4 |
| 201°C OR HIGHER | −5 |

FIG. 30 (g) CORRECTION VALUES CORRESPONDING TO CHANGES IN TARGET TEMPERATURE TS2 (A5R)

| TARGET TEMPERATURE TS2 (°C) | CORRECTION AMOUNT (°C) |
|---|---|
| LOWER THAN 70°C | +1 |
| 70°C～89°C | +1 |
| 90°C～109°C | 0 |
| 110°C～150°C | 0 |
| 151°C～174°C | −1 |
| 175°C～195°C | −2 |
| 196°C～205°C | −3 |
| 206°C OR HIGHER | −4 |

FIG. 31

| COMPENSATION TEMPERATURE (°C) | 90°C<Tc | 90≦Tc<95°C | 95≦Tc<100°C | 100≦Tc<105°C | 105≦Tc<110°C |
|---|---|---|---|---|---|
| CORRECTION VALUE (°C) | 0 | 0 | 0 | 0 | 0 |
| COMPENSATION TEMPERATURE (°C) | 110≦Tc<115°C | 115≦Tc<120°C | 120≦Tc<125°C | 125≦Tc<130°C | Tc≧130°C |
| CORRECTION VALUE (°C) | 0 | 0 | −1 | −1 | −1 |

FIG. 32

CORRECTION VALUES CORRESPONDING TO THE NUMBERS OF PRINTED SHEETS AND CHANGES IN TARGET TEMPERATURES TS1, TS2 AND TS3 (A5R)

| THE NUMBER OF PRINTED SHEETS (OR SURFACES) | UP TO 10 | UP TO 20 | UP TO 50 | UP TO 100 | UP TO 150 | 151 OR MORE |
|---|---|---|---|---|---|---|
| CORRECTION VALUE CORRESPONDING TO THE NUMBER OF PRINTED SHEETS (°C) | −2 | −2 | −3 | −4 | −4 | −4 |
| CORRECTION VALUE CORRESPONDING TO TARGET TEMPERATURE TS1 (°C) | +1 | 0 | 0 | 0 | 0 | 0 |
| CORRECTION VALUE CORRESPONDING TO TARGET TEMPERATURE TS3 (°C) | 0 | 0 | 0 | 0 | 0 | 0 |
| CORRECTION VALUE CORRESPONDING TO TARGET TEMPERATURE TS2 (°C) | 0 | 0 | 0 | −1 | −1 | −1 |
| CORRECTION VALUE CORRESPONDING TO ROTATION (°C) | +2 | +2 | +2 | +2 | +2 | +2 |
| TOTAL CORRECTION VALUE (°C) | +1 | 0 | −1 | −3 | −3 | −3 |

FIG. 33 (a) CHANGES IN TARGET TEMPERATURE TS1 (A4, TWO-SIDE PRINTING)

| THE NUMBER OF PRINTED SURFACES | UP TO 20 | UP TO 40 | UP TO 50 | UP TO 100 | UP TO 150 | 151 OR MORE |
|---|---|---|---|---|---|---|
| TARGET TEMPERATURE (°C) | 170 | 170 | 170 | 170 | 170 | 170 |

FIG. 33 (b) CHANGES IN TARGET TEMPERATURE TS3 (A4, TWO-SIDE PRINTING)

| THE NUMBER OF PRINTED SURFACES | UP TO 20 | UP TO 40 | UP TO 50 | UP TO 100 | UP TO 150 | 151 OR MORE |
|---|---|---|---|---|---|---|
| TARGET TEMPERATURE (°C) | 160 | 165 | 165 | 165 | 165 | 165 |

FIG. 33 (c) CHANGES IN TARGET TEMPERATURE TS2 (A4, TWO-SIDE PRINTING)

| THE NUMBER OF PRINTED SURFACES | UP TO 20 | UP TO 40 | UP TO 50 | UP TO 100 | UP TO 150 | 151 OR MORE |
|---|---|---|---|---|---|---|
| TARGET TEMPERATURE (°C) | 90 | 100 | 105 | 115 | 115 | 115 |

FIG. 33 (d) CORRECTION VALUES CORRESPONDING TO CHANGES IN TARGET TEMPERATURE TS1 (A4, TWO-SIDE PRINTING)

| TARGET TEMPERATURE TS1 (°C) | CORRECTION AMOUNT (°C) |
|---|---|
| LOWER THAN 140°C | +4 |
| 140°C～154°C | +3 |
| 155°C～160°C | +2 |
| 161°C～164°C | +1 |
| 165°C～172°C | 0 |
| 173°C～174°C | −1 |
| 175°C～184°C | −2 |
| 185°C～194°C | −3 |
| 195°C～204°C | −4 |
| 205°C OR HIGHER | −5 |

FIG. 33 (e) CORRECTION VALUES CORRESPONDING TO CHANGES IN TARGET TEMPERATURE TS3 (A4, TWO-SIDE PRINTING)

| TARGET TEMPERATURE TS3 (°C) | CORRECTION AMOUNT (°C) |
|---|---|
| LOWER THAN 140°C | +2 |
| 140°C～146°C | +2 |
| 147°C～152°C | +1 |
| 153°C～154°C | +1 |
| 155°C～157°C | 0 |
| 158°C～163°C | 0 |
| 164°C～167°C | −1 |
| 168°C～173°C | −2 |
| 174°C～180°C | −3 |
| 181°C～189°C | −4 |
| 198°C OR HIGHER | −4 |

FIG. 33 (f) CORRECTION VALUES CORRESPONDING TO CHANGES IN TARGET TEMPERATURE TS2 (A4, TWO-SIDE PRINTING)

| TARGET TEMPERATURE TS2 (°C) | CORRECTION AMOUNT (°C) |
|---|---|
| LOWER THAN 70°C | 0 |
| 70°C～89°C | 0 |
| 90°C～109°C | 0 |
| 110°C～150°C | 0 |
| 151°C～164°C | 0 |
| 165°C～174°C | 0 |
| 175°C～184°C | −1 |
| 185°C～194°C | −1 |
| 195°C OR HIGHER | −1 |

FIG. 34

CORRECTION VALUES CORRESPONDING TO THE NUMBERS OF PRINTED SHEETS AND CHANGES IN TARGET TEMPERATURES TS1, TS2 AND TS3 (A4, TWO-SIDE PRINTING)

| THE NUMBER OF PRINTED SURFACES | UP TO 20 | UP TO 40 | UP TO 50 | UP TO 100 | UP TO 150 | 151 OR MORE |
|---|---|---|---|---|---|---|
| CORRECTION VALUE CORRESPONDING TO THE NUMBER OF PRINTED SURFACES (°C) | 0 | 0 | 0 | 0 | 0 | 0 |
| CORRECTION VALUE CORRESPONDING TO TARGET TEMPERATURE TS1 (°C) | 0 | 0 | 0 | 0 | 0 | 0 |
| CORRECTION VALUE CORRESPONDING TO TARGET TEMPERATURE TS3 (°C) | 0 | −1 | −1 | −1 | −1 | −1 |
| CORRECTION VALUE CORRESPONDING TO TARGET TEMPERATURE TS2 (°C) | 0 | 0 | 0 | 0 | 0 | 0 |
| CORRECTION VALUE CORRESPONDING TO ROTATION (°C) | +2 | +2 | +2 | +2 | +2 | +2 |
| TOTAL CORRECTION VALUE (°C) | +2 | +1 | +1 | +1 | +1 | +1 |

FIG. 35 (a) CORRECTION VALUES CORRESPONDING TO THE NUMBERS OF PRINTED SHEETS (A5R, TWO-SIDE PRINTING)

| THE NUMBER OF PRINTED SURFACES | UP TO 10 | UP TO 20 | UP TO 50 | UP TO 100 | UP TO 150 | 151 OR MORE |
|---|---|---|---|---|---|---|
| CORRECTION VALUE (°C) | -2 | -2 | -3 | -4 | -4 | -4 |

FIG. 35 (b) CHANGES IN SET TEMPERATURE OF TARGET TEMPERATURE TS1 (A5R, TWO-SIDE PRINTING)

| THE NUMBER OF PRINTED SURFACES | UP TO 10 | UP TO 20 | UP TO 50 | UP TO 100 | UP TO 150 | 151 OR MORE |
|---|---|---|---|---|---|---|
| TARGET TEMPERATURE (°C) | 163 | 170 | 170 | 170 | 170 | 170 |

FIG. 35 (c) CHANGES IN SET TEMPERATURE OF TARGET TEMPERATURE TS3 (A5R, TWO-SIDE PRINTING)

| THE NUMBER OF PRINTED SURFACES | UP TO 10 | UP TO 20 | UP TO 50 | UP TO 100 | UP TO 150 | 151 OR MORE |
|---|---|---|---|---|---|---|
| TARGET TEMPERATURE (°C) | 160 | 160 | 160 | 160 | 160 | 160 |

FIG. 35 (d) CHANGES IN SET TEMPERATURE OF TARGET TEMPERATURE TS2 (A5R, TWO-SIDE PRINTING)

| THE NUMBER OF PRINTED SURFACES | UP TO 10 | UP TO 20 | UP TO 50 | UP TO 100 | UP TO 150 | 151 OR MORE |
|---|---|---|---|---|---|---|
| TARGET TEMPERATURE (°C) | 90 | 110 | 120 | 130 | 130 | 130 |

FIG. 35 (e) CORRECTION VALUES CORRESPONDING TO CHANGES IN TARGET TEMPERATURE TS1 (A5R, TWO-SIDE PRINTING)

| TARGET TEMPERATURE TS1 (°C) | CORRECTION AMOUNT (°C) |
|---|---|
| LOWER THAN 140°C | +4 |
| 140°C～154°C | +3 |
| 155°C～160°C | +2 |
| 161°C～164°C | +1 |
| 165°C～172°C | 0 |
| 173°C～174°C | -1 |
| 175°C～184°C | -2 |
| 185°C～194°C | -3 |
| 195°C～204°C | -4 |
| 205°C OR HIGHER | -5 |

FIG. 35 (f) CORRECTION VALUES CORRESPONDING TO CHANGES IN TARGET TEMPERATURE TS3 (A5R, TWO-SIDE PRINTING)

| TARGET TEMPERATURE TS3 (°C) | CORRECTION AMOUNT (°C) |
|---|---|
| LOWER THAN 140°C | +4 |
| 140°C～145°C | +3 |
| 146°C～147°C | +2 |
| 148°C～149°C | +1 |
| 150°C～151°C | +1 |
| 152°C～153°C | 0 |
| 154°C～158°C | 0 |
| 159°C～163°C | +1 |
| 164°C～170°C | +2 |
| 171°C～180°C | +3 |
| 181°C～200°C | +3 |
| 201°C OR HIGHER | +4 |

FIG. 35 (g) CORRECTION VALUES CORRESPONDING TO CHANGES IN TARGET TEMPERATURE TS2 (A5R, TWO-SIDE PRINTING)

| TARGET TEMPERATURE TS2 (°C) | CORRECTION AMOUNT (°C) |
|---|---|
| LOWER THAN 70°C | +1 |
| 70°C～89°C | 0 |
| 90°C～109°C | 0 |
| 110°C～150°C | 0 |
| 151°C～164°C | 0 |
| 165°C～174°C | 0 |
| 175°C～184°C | -1 |
| 185°C～194°C | -1 |
| 195°C OR HIGHER | -2 |

FIG. 36

CORRECTION VALUES CORRESPONDING TO THE NUMBERS OF PRINTED SHEETS AND CHANGES IN TARGET TEMPERATURES TS1, TS2 AND TS3 (A5R, TWO-SIDE PRINTING)

| THE NUMBER OF PRINTED SURFACES | UP TO 10 | UP TO 40 | UP TO 50 | UP TO 100 | UP TO 150 | 151 OR MORE |
|---|---|---|---|---|---|---|
| CORRECTION VALUE CORRESPONDING TO THE NUMBER OF PRINTED SURFACES (°C) | −2 | −2 | −3 | −4 | −4 | −4 |
| CORRECTION VALUE CORRESPONDING TO TARGET TEMPERATURE TS1 (°C) | +1 | 0 | 0 | 0 | 0 | 0 |
| CORRECTION VALUE CORRESPONDING TO TARGET TEMPERATURE TS3 (°C) | +1 | +1 | +1 | +1 | +1 | +1 |
| CORRECTION VALUE CORRESPONDING TO TARGET TEMPERATURE TS2 (°C) | 0 | 0 | 0 | 0 | 0 | 0 |
| CORRECTION VALUE CORRESPONDING TO ROTATION (°C) | +2 | +2 | +2 | +2 | +2 | +2 |
| TOTAL CORRECTION VALUE (°C) | +2 | +1 | 0 | −1 | −1 | −1 |

TEMPERATURE CONTROL DEVICE, TEMPERATURE CONTROL METHOD, FIXING DEVICE, IMAGE FORMING APPARATUS, TEMPERATURE CONTROL PROGRAM, COMPUTER-READABLE RECORDING MEDIUM, AND COMPUTER DATA SIGNAL

This Nonprovisional application claims priority under 35 U.S.C. §119(a) on Patent Application Nos. 341144/2005 and 299511/2006 filed in Japan respectively on Nov. 25, 2005, and Nov. 2, 2006, the entire contents of which are hereby incorporated by reference.

FIELD OF THE TECHNOLOGY

The present technology relates to a temperature control device and more particularly to (i) the temperature control device used in, for example, a hot plate, a microwave oven, a wet electrophotographic device, an inkjet printer and a dry electrophotographic device, and (ii) a temperature control method used by the temperature control device. Moreover, the present technology relates to a fixing device including the temperature control device and an image forming apparatus including the temperature control device. Further, the technology relates to a temperature control program and a computer-readable recording medium.

BACKGROUND OF THE TECHNOLOGY

An image forming apparatus (such as a copier) which forms an image on a print medium (such as a sheet) includes a fixing device which fixes toner, transferred to the print medium, by thermocompression bonding. The fixing device includes a fixing roller and a pressure roller which are opposed to each other, and the fixing roller incorporates one heater or a plurality of heaters.

The surface of the fixing roller is heated by the heater to a predetermined target temperature, and the heated fixing roller and the pressure roller sandwich and press the print medium. Thus, the toner is fixed on the print medium. Here, the fixing roller contacts a surface on which the toner is transferred, and the pressure roller contacts another surface where the toner is not transferred.

The temperature of the fixing roller is an important factor for determining whether or not the toner is fixed on the print medium finely. The heater for heating the fixing roller is usually a heater which converts electric energy to heat energy. Therefore, the temperature control of the fixing roller is carried out by controlling electric power supplied to the heater. Feed back control is usually used to control the temperature of the fixing roller. The feed back control is to detect the temperature of the fixing roller, compare the detected temperature with the target temperature and increase or decrease the electric power supplied to the heater.

There are various methods for detecting the surface temperature of the fixing roller. A conventionally used method is to cause a temperature detecting element (such as a thermistor) to contact a region of the fixing roller which region contacts the print medium. According to this method, a resistance value of the temperature detecting element which value corresponds to the temperature is detected by a voltage, and the surface temperature of the fixing roller is obtained from the detected voltage.

In recent years, the image forming apparatus has been realizing high speed and colorization, and the rotation speed of the fixing roller has been increasing. As a result, the conventional method for causing the temperature detecting element to contact the fixing roller causes scratches or damages on the surface of the fixing roller even if its contact pressure is reduced. This poses problems where the toner is not fixed uniformly and the quality of an image formed on the print medium deteriorates.

Here, Tokukaihei 11-133796 (Japanese Unexamined Patent Publication 11-133796 (published on May 21, 1999)) discloses a method for providing the temperature detecting element (such as the thermistor and a thermocouple) in a noncontact manner with respect to a portion of the fixing roller which portion contacts a recording sheet. According to this method, it is possible to detect the changes in the temperature of the fixing roller quickly, and also possible to prevent scratches and damages caused by the contacting of the temperature detecting element. However, in order to directly detect the temperature of the fixing roller, the temperature detecting element needs to be placed near the fixing roller. This poses a problem of the heat resistance of the temperature detecting element.

Moreover, widely used as a noncontact-type temperature detecting element is a thermopile element. The changes in an output signal of the thermopile element are small as compared with the changes in the temperature detected. Therefore, if the compensation is not carried out with respect to the reference temperature near the thermopile element and the amplification is not carried out, the thermopile element generates the output signal containing a large amount of noise. Therefore, it is impossible to detect the temperature accurately. On this account, it is necessary to provide the thermopile element and an amplifier near the fixing roller that is a heat source. However, these members are weak against heat. This especially poses a problem of the heat resistance.

Here, Tokukaihei 11-223555 (Japanese Unexamined Patent Publication 11-223555 (published on Aug. 17, 1999) discloses a noncontact-type temperature sensor which detects the temperature of the fixing roller by detecting the infrared radiation, emitted from the fixing roller, by a thermistor element. In this sensor, the thermistor element is provided on a film which absorbs the infrared radiation, the infrared radiation film absorbs the infrared radiation emitted from the fixing roller, and the heat generated by the absorption is detected by the thermistor element. Thus, by using the thermistor element as the temperature detecting element, it is possible to alleviate the problem of the heat resistance. As a result, the conventional use condition of up to 100° C. is improved to 150° C., and it becomes possible to provide the noncontact-type temperature detecting element in the fixing device.

Note that in this method, the temperature detecting element can detect not the temperature of the surface of the fixing roller itself but a relative temperature difference between the temperature detecting element and the fixing roller. Here, generally, a compensation temperature detecting element which detects a temperature around the temperature detecting element is further provided at the periphery of the temperature detecting element which detects the infrared radiation, and an output value of the temperature detecting element which detects the infrared radiation is compensated by an output value of the compensation temperature detecting element.

Moreover, Tokukai 2003-302288 (Japanese Unexamined Patent Publication 2003-302288 (published on Oct. 24, 2003)) also discloses a temperature detecting means (i) which includes a temperature detecting element for detecting the infrared radiation and a compensation temperature detecting element and (ii) which is configured so that the difference between the output voltage of the temperature detecting element and the output voltage of the compensation temperature detecting element becomes constant when the temperature of the fixing roller is in a desired temperature range. With this, it is possible to detect excessive temperature rising of the fixing roller.

However, the conventional noncontact-type temperature detecting means disclosed in Tokukaihei 11-223555 (Japanese Unexamined Patent Publication 11-223555 (published on Aug. 17, 1999) and Tokukai 2003-302288 (Japanese Unexamined Patent Publication 2003-302288 (published on Oct. 24, 2003)) cannot carry out the temperature control of the fixing roller accurately. According to the techniques in Tokukaihei 11-223555 (Japanese Unexamined Patent Publication 11-223555 (published on Aug. 17, 1999) and Tokukai 2003-302288 (Japanese Unexamined Patent Publication 2003-302288 (published on Oct. 24, 2003)), the output value of the noncontact-type temperature detecting means is analogically compensated by the output value of the compensation temperature detecting means, and the temperature of the fixing roller is detected. However, when various disturbances occur, the detected temperature of the fixing roller may become inaccurate. For example, in the case of the temperature detecting means disclosed in Tokukai 2003-302288 (Japanese Unexamined Patent Publication 2003-302288 (published on Oct. 24, 2003)) discloses that the error of about 17° C. occurs depending on the ambient temperature detected by a compensation thermistor. Thus, according to the conventional techniques, if the environmental conditions at the periphery of the noncontact-type temperature detecting section change, there are problems in that the error of the detected temperature becomes large and this affects the temperature control.

Moreover, Tokukai 2003-149981 (Japanese Unexamined Patent Publication 2003-149981 (published on May 21, 2003)) proposes that the temperature of the fixing roller is obtained by calculation using a detection value of a temperature sensor. However, as a matter of reality, it is difficult to accurately express the relation between the detected value and the temperature by a mathematical formula. Especially, in light of shortening of calculation time, an approximation formula is used in many cases. In such a case, a calculation result is often largely different from the actual temperature.

SUMMARY OF THE TECHNOLOGY

The present technology was made to solve the above problems, and an object is to realize a temperature control device which detects a temperature in a noncontact manner, can carry out a temperature detection accurately, and can also carry out temperature control accurately.

In order to solve the above problems, a temperature control device controls a temperature of a heated object heated by a heating section and includes: a main temperature detecting section which detects heat generated by infrared radiation from the heated object; a compensation temperature detecting section which detects an ambient temperature of the main temperature detecting section; a memory section which stores a temperature correspondence table in which correspondences between output values of the main temperature detecting section and the temperatures of the heated object are shown for respective output values of the compensation temperature detecting section; a temperature calculating section which refers to the temperature correspondence table so as to obtain the temperature of the heated object from the output value of the main temperature detecting section and the output value of the compensation temperature detecting section; and a heat control section which controls a heating power of the heating section on the basis of the temperature obtained by the temperature calculating section, and the output values of the compensation temperature detecting section and the output values of the main temperature detecting section in the temperature correspondence table are set so that an interval between adjacent values of the ambient temperatures corresponding to the output values of the compensation temperature detecting section is smaller than an interval between adjacent values of the temperatures of the heated object which temperatures correspond to the output values of the main temperature detecting section.

According to the above configuration, the heat generated by the infrared radiation emitted from the heated object is detected by the main temperature detecting section. Here, in addition to the heat generated by the infrared radiation from the heated object, the heat detected by the main temperature detecting section is, for example, heat from the holding body that is a peripheral member of the main temperature detecting section. Therefore, the compensation temperature detecting section detects the ambient temperature which may affect the main temperature detecting section, and the temperature detected by the main temperature detecting section is compensated by this ambient temperature. With this, it is possible to detect the temperature of the heated object precisely without contacting the heated object.

When the temperature calculating section obtains the temperature of the heated object from the output value of the main temperature detecting section and the output value of the compensation temperature detecting section, the temperature correspondence table stored in the memory section is used. This temperature correspondence table shows the correspondences between the output values of the main temperature detecting section and the temperatures of the heated object for respective output values of the compensation temperature detecting section. Therefore, by referring to a cell corresponding to the output value of the main temperature detecting section and the output value of the compensation temperature detecting section, the temperature calculating section can obtain the temperature of the heated object quickly. Moreover, by obtaining the temperatures corresponding to respective output values through experiments and creating the temperature correspondence table based on the obtained temperatures, it is possible to accurately obtain the temperature close to the actual temperature.

Further, according to the above configuration, the output values of the compensation temperature detecting section and the output values of the main temperature detecting section in the temperature correspondence table are set so that the difference (interval) between adjacent values of the compensation temperatures corresponding to the output values of the compensation temperature detecting section is smaller than the difference (interval) between adjacent values of the temperatures of the heated object which temperatures correspond to the output values of the main temperature detecting section. This setting has the following advantages.

As the temperature detected by the compensation temperature detecting section changes by 1° C. in the case of obtaining the temperature of the heated object by using the output value of the main temperature detecting section and the output value of the compensation temperature detecting section, the corresponding temperature of the heated object usually changes by a few degrees centigrade. Therefore, as is conventional, even if the main temperature detecting section detects the temperature of the heated object to an accuracy of 1° C. by using the temperature correspondence table in which the interval between adjacent values of the compensation temperatures and the interval between adjacent values of the temperatures of the heated object are the same value (for example, 1° C.), the eventually obtained temperature of the heated object contains the error that is a few times (that is, a few degrees centigrade) the accuracy of the compensation temperature detected by the compensation temperature detecting section. However, according to the above configuration, the accuracy of the compensation temperature detected by the compensation temperature detecting section becomes higher than the accuracy of the temperature of the heated object detected by the main temperature detecting section, and the errors of the temperatures detected by these temperature detecting sections are balanced. Therefore, it is possible to obtain the temperature of the heated object precisely without reducing the interval between the adjacent values of the temperatures in the temperature correspondence table.

Then, since the heat control section controls the heating power of the heating section on the basis of the accurate temperature of the heated object which temperature is obtained by the temperature calculating section, it is possible to carry out the temperature control accurately without the temperature drift or the temperature ripple.

As above, the temperature control device which detects the temperature in a noncontact manner can carry out the temperature detection and the temperature control accurately.

A fixing device includes: any of the above temperature control devices; the heating section controlled by the temperature control device; and a fixing section, as the heated object, which heats print mediums, conveyed sequentially, so as to fix a toner image transferred onto the print mediums.

According to the above configuration, since the fixing device includes the temperature control device, it is possible to carry out the temperature control of the fixing section accurately, and also possible to realize the fixing device which can fix the toner properly.

An image forming apparatus includes the above temperature control device. Therefore, it is possible to realize the image forming apparatus which can realize high print quality.

Here, the temperature calculating section of the temperature control device may be realized by a hardware or by causing a computer to execute a program. Specifically, a software program may cause a computer to function as the temperature calculating section, and a recording medium records this program.

When this program is executed by a computer, the computer functions as the temperature calculating section of the temperature control device. Therefore, as with the temperature control device, it is possible to obtain the accurate temperature of the heated object.

Moreover, another recording medium records the temperature correspondence table stored in the memory section of the temperature control device. Since a computer obtains the temperature of the heated object by using the temperature correspondence table, it is possible to obtain the temperature of the heated object accurately.

In order to solve the above problems, a temperature control device controls a temperature of a fixing section which fixes a toner image transferred onto a print medium and is heated by a heating section, and the temperature control device includes: a main thermistor which detects heat generated by infrared radiation from the fixing section; a compensation thermistor which detects an ambient temperature of the main thermistor; a memory section which stores (i) a temperature correspondence table in which correspondences between output values of the main thermistor and the temperatures of the fixing section are shown for respective output values of the compensation thermistor and (ii) data of correction values for respective types of a sheet and for respective numbers of the sheets sequentially fixed by the fixing section; a temperature calculating section which (i) refers to the temperature correspondence table so as to obtain the temperature of the fixing section from the output value of the main thermistor and the output value of the compensation thermistor and (ii) corrects the obtained temperature by using the correction value in the data of the correction values on the basis of the type of the sheet and the number of the sheets fixed sequentially; and a heat control section which controls a heating power of the heating section on the basis of the temperature of the fixing section which temperature is corrected by the temperature calculating section, and the output values of the main thermistor and the output values of the compensation thermistor in the temperature correspondence table are set so that an interval between adjacent values of compensation temperatures corresponding to the output values of the compensation thermistor is smaller than an interval between adjacent values of the temperatures of the fixing section which temperatures correspond to the output values of the main thermistor.

According to the above configuration, it is possible to detect the accurate temperature of the fixing section on the basis of the output voltage values of the main thermistor and the compensation thermistor, and also possible to carry out the temperature control accurately without the temperature drift or the temperature ripple.

In order to solve the above problems, a temperature control method controls a temperature of a heated object, heated by a heating section, by using (i) a main temperature detecting section which detects heat generated by infrared radiation from the heated object and (ii) a compensation temperature detecting section which detects an ambient temperature of the main temperature detecting section, and the temperature control method includes the steps of: obtaining the temperature of the heated object from an output value of the main temperature detecting section and an output value of the compensation temperature detecting section by referring to a temperature correspondence table, stored in a memory section, in which (i) correspondences between the output values of the main temperature detecting section and the temperatures of the heated object are shown for the respective output values of the compensation temperature detecting section and (ii) the output values of the compensation temperature detecting section and the output values of the main temperature detecting section are set so that an interval between adjacent values of the ambient temperatures corresponding to the output values of the compensation temperature detecting section is smaller than an interval between adjacent values of the temperatures of the heated object which temperatures correspond to the output values of the main temperature detecting section; and controlling a heating power of the heating section on the basis of the temperature obtained in the obtaining step.

According to the above configuration, it is possible to carry out the temperature detection accurately, and also possible to carry out the temperature control accurately without the temperature drift or the temperature ripple.

Moreover, in order to solve the above problems, another temperature control method controls a temperature of a first region of a heated object, whose first region is heated by a first heating section and whose second region is heated by a second heating section, by using (i) a main temperature detecting section which detects heat generated by infrared radiation from the first region of the heated object and (ii) a compensation temperature detecting section which detects an ambient temperature of the main temperature detecting section, and the temperature control method includes the steps of: obtaining the temperature of the first region of the heated object from the output value of the main temperature detecting section and the output value of the compensation temperature detecting section by referring to a temperature correspondence table, stored in a memory section, in which (i) correspondences between the output values of the main temperature detecting section and the temperatures of the first region of the heated object are shown for respective output values of the compensation temperature detecting section and (ii) the output values of the compensation temperature detecting section and the output values of the main temperature detecting section are set so that an interval between adjacent values of the ambient temperatures corresponding to the output values of the compensation temperature detecting section is smaller than an interval between adjacent values of the temperatures of the first region of the heated object which temperatures correspond to the output values of the main temperature detecting section; correcting the temperature, obtained in the obtaining step, by using data, stored in the memory section, of correction values for respective target temperatures of the second region of the heated object on the basis of the target temperature of the second region of the heated object; and controlling a heating power of the first heating section on the basis of the temperature corrected in the correcting step.

According to the above configuration, it is possible to carry out the temperature detection accurately, and also possible to carry out the temperature control accurately without the temperature drift or the temperature ripple.

Additional objects, features, and strengths of the present technology will be made clear by the description below. Further, the advantages of the present technology will be evident from the following explanation in reference to the drawings.

BRIEF DESCRIPTION OF THE DRAWINGS

FIG. 1 is a diagram showing a temperature correspondence table used by a temperature control device.

FIG. 8 is a diagram for explaining a method for obtaining the surface temperature of the fixing roller from output voltage values of two types of NTC thermistors by using the temperature correspondence table.

FIG. 9(*b*) is a diagram showing data of correction values corresponding to the temperatures of the case of the temperature detecting section used at low temperature and low humidity.

FIG. 9(*c*) is a diagram showing data of correction values corresponding to the temperatures of the case of the temperature detecting section used at high temperature and high humidity.

FIG. 17 is a diagram showing results of Examples 2 and 3.

FIG. 18 is a diagram showing results of Example 4.

FIG. 19 is a diagram showing results of Example 5.

FIG. 20 is a diagram showing results of Example 6.

FIG. 23(*a*) is a diagram showing data of correction values corresponding to the numbers of printed sheets used at normal temperature and normal humidity.

FIG. 23(*b*) is a diagram showing data of correction values corresponding to the numbers of printed sheets used at low temperature and low humidity.

FIG. 23(*c*) is a diagram showing data of correction values corresponding to the numbers of printed sheets used at high temperature and high humidity.

FIG. 24 is a diagram showing data of correction values corresponding to the temperatures of the temperature detecting section itself when carrying out printing onto postcards.

FIG. 26(*a*) is a diagram showing data of correction values corresponding to the numbers of printed sheets when carrying out printing onto invoice R sheets.

FIG. 26(*b*) is a diagram showing data of correction values corresponding to the temperatures of the temperature detecting section itself when carrying out printing onto the invoice R sheets.

FIG. 27(*a*) is a diagram showing data of correction values of the target temperature which values correspond to the numbers of printed sheets when carrying out printing onto A4 sheets.

FIG. 27(*b*) is a diagram showing the target temperatures corresponding to the numbers of printed sheets when carrying out printing onto the A4 sheets.

FIG. 27(*c*) is a diagram showing data of correction values corresponding to the changes in the target temperature when carrying out printing onto the A4 sheets.

FIG. 28(*a*) is a diagram showing data of correction values of the target temperature which values correspond to the numbers of printed sheets when carrying out printing onto B4 sheets.

FIG. 28(*b*) is a diagram showing the target temperatures corresponding to the numbers of printed sheets when carrying out printing onto the B4 sheets.

FIG. 28(*c*) is a diagram showing data of correction values corresponding to the numbers of printed sheets when carrying out printing onto the B4 sheets.

FIG. 30(*a*) is a diagram showing data of correction values corresponding to the numbers of printed sheets when carrying out printing onto A5R sheets.

FIG. 30(*b*) is a diagram showing the target temperatures of a center portion of the fixing roller which temperatures correspond to the numbers of printed sheets when carrying out printing onto the A5R sheets.

FIG. 30(*c*) is a diagram showing the target temperatures of the pressure roller which temperatures correspond to the numbers of printed sheets when carrying out printing onto the A5R sheets.

FIG. 30(*d*) is a diagram showing the target temperatures of an edge portion of the fixing roller which temperatures correspond to the numbers of printed sheets when carrying out printing onto the A5R sheets.

FIG. 30(*e*) is a diagram showing data of correction values corresponding to the target temperatures of the center portion of the fixing roller when carrying out printing onto the A5R sheets.

FIG. 30(*f*) is a diagram showing data of correction values corresponding to the target temperatures of the pressure roller when carrying out printing onto the A5R sheets.

FIG. 30(*g*) is a diagram showing data of correction values corresponding to the target temperatures of the edge portion of the fixing roller when carrying out printing onto the A5R sheets.

FIG. 31 is a diagram showing data of correction values corresponding to the temperatures of the temperature detecting section itself when carrying out printing onto the A5R sheets.

FIG. 32 is a diagram showing final correction values corresponding to the numbers of printed sheets when carrying out printing onto the A5R sheets.

FIG. 33(*a*) is a diagram showing the target temperatures of the center portion of the fixing roller which temperatures correspond to the numbers of printed sheets when carrying out two-side printing onto the A4 sheets.

FIG. 33(*b*) is a diagram showing the target temperatures of the pressure roller which temperatures correspond to the numbers of printed sheets when carrying out two-side printing onto the A4 sheets.

FIG. 33(*c*) is a diagram showing the target temperatures of the edge portion of the fixing roller which temperatures correspond to the numbers of printed sheets when carrying out two-side printing onto the A4 sheets.

FIG. 33(*d*) is a diagram showing data of correction values corresponding to the target temperatures of the center portion of the fixing roller when carrying out two-side printing onto the A4 sheets.

FIG. 33(*e*) is a diagram showing data of correction values corresponding to the target temperatures of the pressure roller when carrying out two-side printing onto the A4 sheets.

FIG. 33(*f*) is a diagram showing data of correction values corresponding to the target temperatures of the edge portion of the fixing roller when carrying out two-side printing onto the A4 sheets.

FIG. 34 is a diagram showing final correction values corresponding to the numbers of printed sheets when carrying out two-side printing onto the A4 sheets.

FIG. 35(*a*) is a diagram showing data of correction values corresponding to the numbers of printed sheets when carrying out two-side printing onto the A5R sheets.

FIG. 35(*b*) is a diagram showing the target temperatures of the center portion of the fixing roller which temperatures correspond to the numbers of printed sheets when carrying out two-side printing onto the A5R sheets.

FIG. 35(*c*) is a diagram showing the target temperatures of the pressure roller which temperatures correspond to the numbers of printed sheets when carrying out two-side printing onto the A5R sheets.

FIG. 35(*d*) is a diagram showing the target temperatures of the edge portion of the fixing roller which temperatures correspond to the numbers of printed sheets when carrying out two-side printing onto the A5R sheets.

FIG. 35(*e*) is a diagram showing data of correction values corresponding to the target temperatures of the center portion of the fixing roller when carrying out two-side printing onto the A5R sheets.

FIG. 35(*f*) is a diagram showing data of correction values corresponding to the target temperatures of the pressure roller when carrying out two-side printing onto the A5R sheets.

FIG. 35 (*g*) is a diagram showing data of correction values corresponding to the target temperatures of the edge portion of the fixing roller when carrying out two-side printing onto the A5R sheets.

FIG. 36 is a diagram showing final correction values corresponding to the numbers of printed sheets when carrying out two-side printing onto the A5R sheets.

DESCRIPTION OF THE EMBODIMENTS

The following will explain embodiments with reference to FIGS. 1 to 41. First, configurations common to the respective embodiments are explained. The following will explain an example in which a temperature control device is applied to a fixing device included in an image forming apparatus. However, the temperature control device is not limited to this, and can be applied to various equipments which carries out heating, such as a hot plate, a microwave oven, a wet electrophotographic device, an inkjet printer and a dry electrophotographic device.

Figure 2:
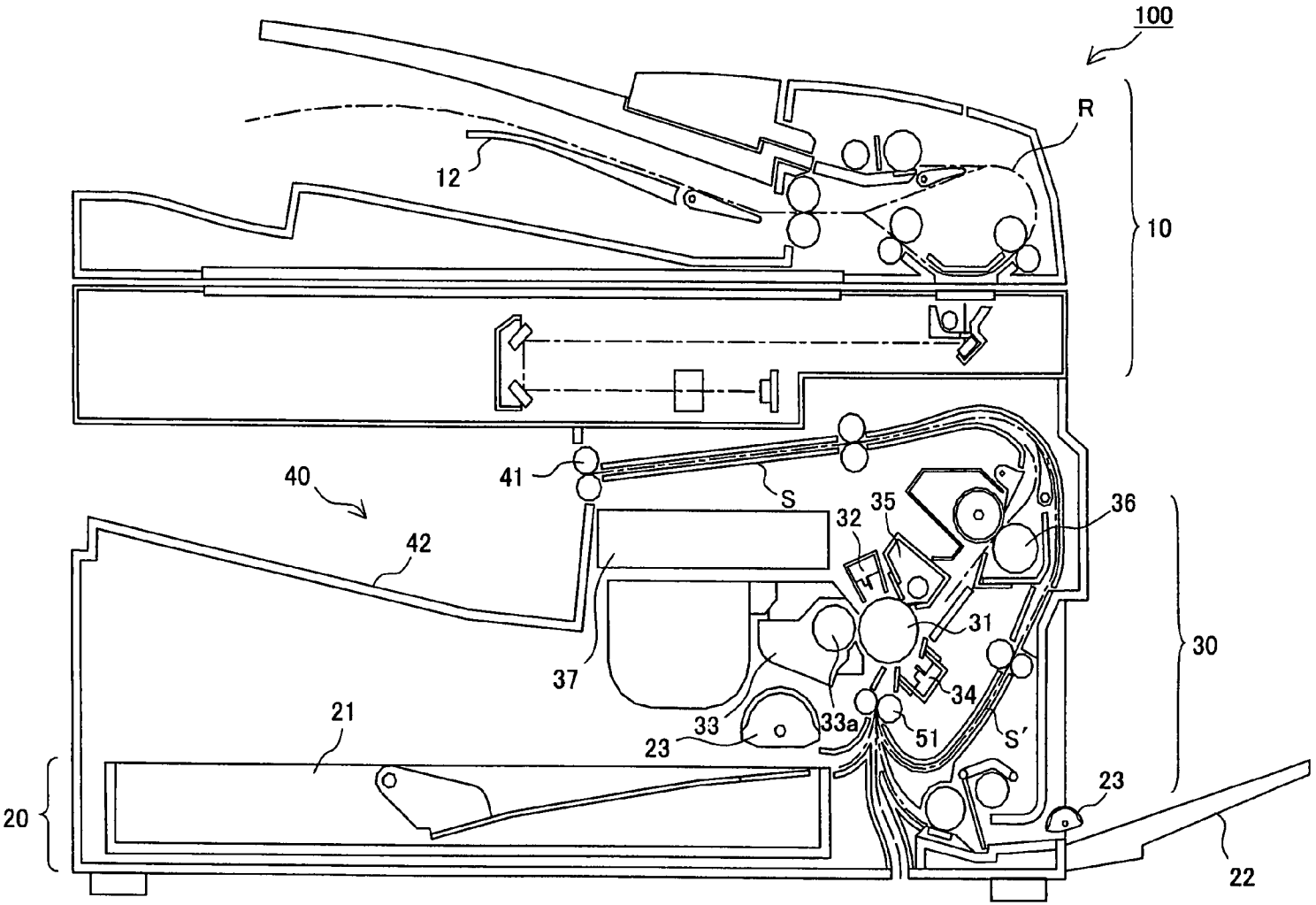
FIG. 2 is a cross-sectional view for explaining a schematic configuration of an image forming apparatus including the temperature control device.

FIG. 2 is a cross-sectional view showing a schematic configuration of the image forming apparatus to which the temperature control device of each embodiment is applied. An image forming apparatus 100 that is a main body device has a copier mode, a printer mode and a FAX mode as image forming modes for forming an image on a sheet (including a print medium, such as an OHP). The modes are selected by a user, and the image forming apparatus 100 can carry out two-side printing.

Moreover, the image forming apparatus 100 includes a document reading section 10, a paper feeding section 20, an image forming section 30, a paper output section 40, an operation panel section (not shown), a control section (not shown), etc. The document reading section 10 is placed at an upper portion of the apparatus main body, and includes a platen glass 11, a document mounting tray 12, a scanner optical system 13, etc. The scanner optical system 13 includes a light source 14, reflection mirrors 15*a* to 15*c*, an optical lens 16 and a CCD (Charge Coupled Device) 17. The light source 14 illuminates a document mounted on the platen glass 11 or a document conveyed from the document mounting tray 12 through a document conveying path R. The reflection mirrors 15*a* to 15*c* reflect light reflected from the document, and guide the light to the optical lens 16. The optical lens 16 collects the reflected light guided by the reflection mirrors 15*a* to 15*c*, and guides to the CCD 17. The CCD 17 photoelectrically converts the collected reflected light.

The paper feeding section 20 is placed at a lower portion of the apparatus main body, and includes a paper feeding tray 21, a manual tray 22, a pickup roller 23, etc. The paper feeding tray 21 and the manual tray 22 mount the sheets which are supplied to a sheet conveying path S at the time of image formation. The pickup roller 23 rotates so as to supply the sheets, mounted on the trays 21 and 22, to the sheet conveying path S.

The image forming section 30 is placed under the document reading section 10 and is placed on a side of the manual tray 22. The image forming section 30 includes a laser scanning unit (hereinafter referred to as "LSU") 37, a photosensitive drum 31 and a fixing device 36. Moreover, around the photosensitive drum 31, a charger 32, a development device 33, a transfer device 34 and a cleaner unit 35 are provided in this order along a rotation direction of the photosensitive drum 31.

The paper output section 40 is provided above the paper feeding tray 21, and includes a paper output roller 41, a paper output tray 42, etc. The paper output roller 41 outputs to the paper output tray 42 the sheet having been conveyed on the sheet conveying path S. Moreover, the paper output roller 42 rotates by a rotational force transmitted from a drive motor 70, which is a drive source, through a pinion gear 71 and a paper output roller drive gear 72. Further, the paper output roller 41 can rotate reversibly. In the case of carrying out image formation on both surfaces of the sheet, the paper output roller 41 holds the sheet (i) which has been conveyed on the sheet conveying path S and (ii) on the front surface of which an image is formed. Then, the paper output roller 41 rotates in a direction opposite a direction for outputting the sheet, so as to convey the sheet to the sheet conveying path S'. Thus, the sheet is turned over, the back surface of the sheet faces the photosensitive drum 31, and a toner image is transferred to the back surface of the sheet. The paper output tray 42 stores the sheet (i) which has been output from the paper output roller 41 and (ii) on which an image(s) is formed.

Moreover, the control section controls all the operations of the image forming apparatus 100.

When copying an image of a document to a sheet in the copier mode, (i) the document to be copied is mounted on the platen glass 11 of the document reading section 10 or on the document mounting tray 12, (ii) respective input keys on the operation panel section are pressed so that the number of printed sheets, print magnification, etc. are set, and (iii) a start key (not shown) is pressed to start a copy operation.

When the start key is pressed in the image forming apparatus 100, the pickup roller 23 rotates so as to supply the sheet to the sheet conveying path S. The supplied sheet is conveyed to a resist roller 51 provided on the sheet conveying path S.

In order to carry out a position adjustment between the sheet conveyed to the resist roller 51 and the toner image on the photosensitive drum 31 to be transferred to the sheet, the front edge portion of the sheet in the conveyance direction is held by the resist roller 51 so that the sheet is in parallel with an axial direction of the resist roller 51.

Data of the image read by the document reading section 10 is subjected to image processing under conditions input by using the input keys, etc., and this data is transmitted to the LSU 37 as print data. The LSU 37 exposes the surface of the photosensitive drum 31, which is charged by the charger 32 at a predetermined potential, to a laser beam, based on the image data, through a polygon mirror and various lens (not shown), so as to form an electrostatic latent image on this surface. Then, the toner adhered to the surface of an MG roller 33*a* provided in the development device 33 is attracted toward the surface of the photosensitive drum 31 by a potential gap on the surface of the photosensitive drum 31, adheres to the surface of the photosensitive drum 31, and visualizes the electrostatic latent image.

Then, the resist roller 51 carries out the position adjustment between the sheet held by the resist roller 51 and the toner image formed on the surface of the photosensitive drum 31, and conveys the sheet to between the photosensitive drum 31 and the transfer device 34. Next, the toner image on the surface of the photosensitive drum 31 is transferred to the sheet by using a transfer roller 34*a* provided in the transfer device 34. The sheet to which the toner image is transferred is subjected to heat and pressure by passing through the fixing device 36, and the toner image is melted and fixed. Then, the sheet is output to the paper output tray 42 by the paper output roller 41.

The toner remaining on the photosensitive drum 31 is removed by a cleaning blade of a drum unit (not shown), and collected by the cleaner unit 35.

Embodiment 1

Figure 3:
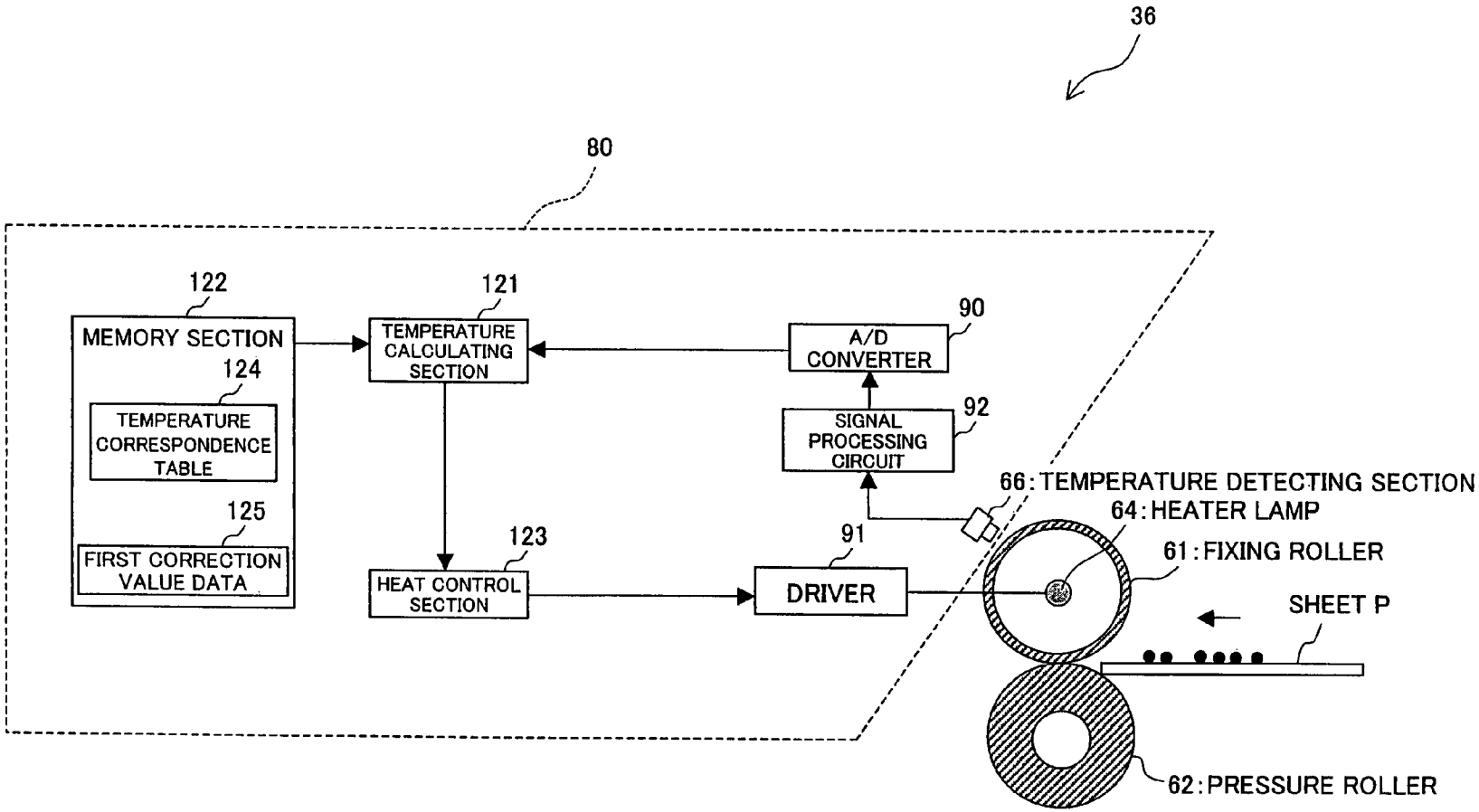
FIG. 3 is a block diagram for explaining a schematic configuration of the temperature control device.

FIG. 3 is a diagram showing a schematic configuration of the fixing device 36 including a temperature control device 80 of one embodiment. As shown in FIG. 3, the fixing device 36 includes a fixing roller 61 incorporating a heater lamp 64 (heating section), a pressure roller 62, a temperature detecting section 66, a signal processing circuit 92, an A/D converter 90, a temperature calculating section 121, a memory section 122, a heat control section 123 and a driver 91.

The fixing roller 61 and the pressure roller 62 heats and presses a sheet P to which the toner is transferred, so as to fix the toner onto the sheet P. The temperature detecting section 66 includes two thermistors (will be described later) and detects the surface temperature of the fixing roller 61 heated by the heater lamp 64.

Output voltages from two thermistors of the temperature detecting section 66 are input to the signal processing circuit 92, and the signal processing circuit 92 carries out amplification, etc. of signal voltages. The output voltages, from two thermistors, subjected to the amplification of the signal voltages are input to and digitalized by the A/D converter 90. Thus, respective output voltage values are generated. The generated output voltage values are input to the temperature calculating section 121. The temperature calculating section 121 refers to a temperature correspondence table 124 and correction value data 125 stored in the memory section 122 such as a RAM, so as to calculate the surface temperature of the fixing roller 61 on the basis of the input voltage values.

Based on the temperature calculated by the temperature calculating section 121, the heat control section 123 controls, via the driver 91, the heating power of the heater lamp 64 incorporated in the fixing roller 61. It is possible to use conventional methods as a method for controlling the heating power of the heater lamp 64. Examples of the conventional method are (1) a control for carrying out a simple ON/OFF control to control electric power supplied to the heater lamp 64, (2) a phase control for controlling, for each voltage half-cycle in sync with a power supply frequency, the amount of electric power supplied to the heater lamp 64, (3) a wave number control (cycle control) for controlling the wave number in the voltage half cycle in sync with the power supply frequency in a predetermined time interval, to control the amount of electric power supplied to the heater lamp 64, (4) a variable voltage control for varying the amplitude of a power supply voltage to control the amount of electric power supplied to the heater lamp 64, and (5) a variable frequency control for varying the frequency of the power supply voltage to control the amount of electric power supplied to the heater lamp 64. These methods may be used alone or in combination. Note that the ON/OFF control, the phase control and the wave number control can be carried out by an electronic control device such as a transistor, a thyristor or a triac, or a power relay. The following will explain configurations of respective parts in detail.

Figure 4:
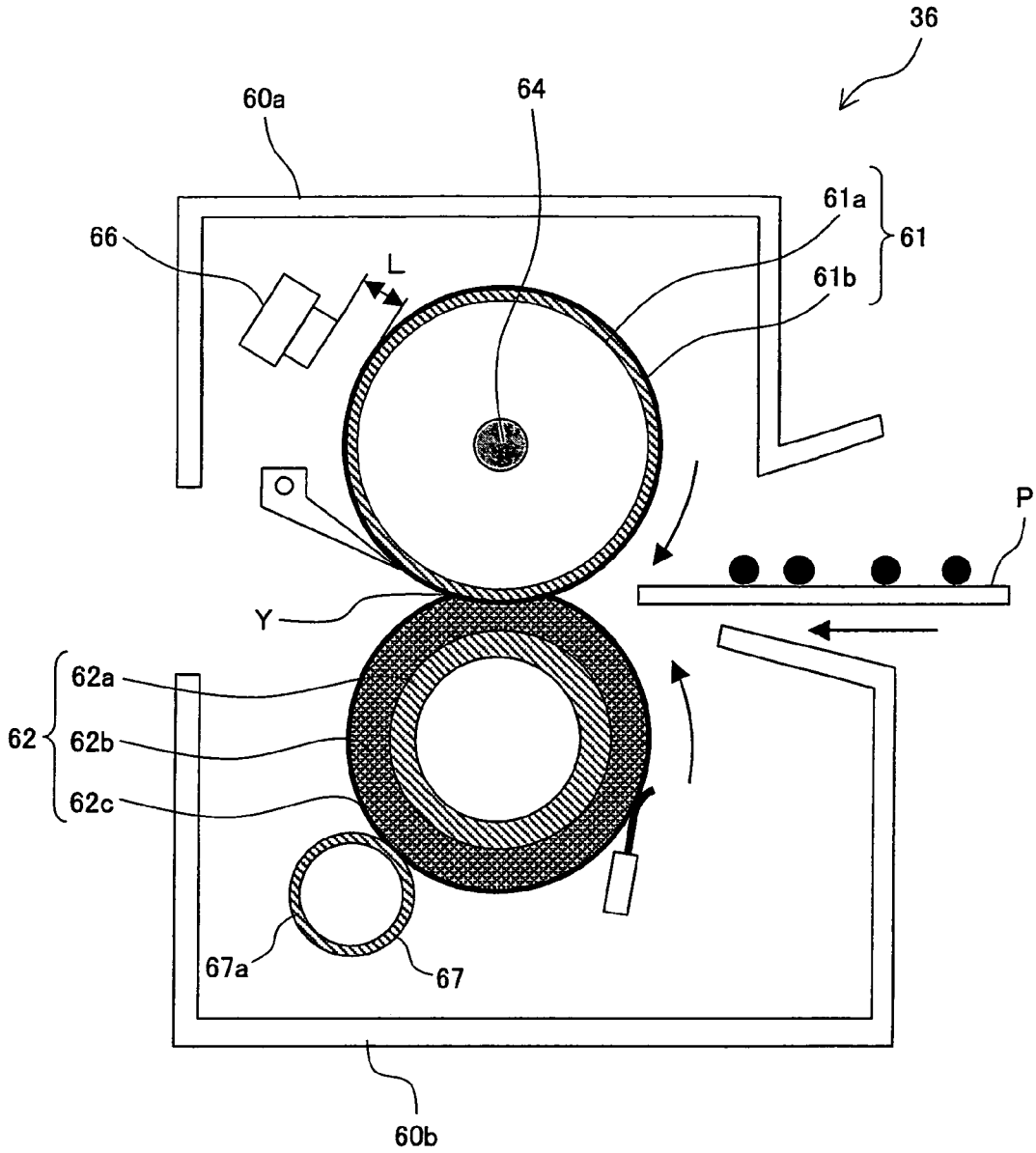
FIG. 4 is a cross-sectional view for explaining a partial configuration of a fixing device including the temperature control device.

FIG. 4 is a diagram showing a partial configuration of the fixing device including the fixing roller 61 and the pressure roller 62. As shown in FIG. 4, the fixing device 36 includes a fixation cover 60 (an upper fixation cover 60*a*, a lower fixation cover 60*b*), the fixing roller 61, the pressure roller 62, the heater lamp 64, the temperature detecting section 66, a cleaning roller 67, etc.

In the present embodiment, the heater lamp 64 is included as the heating section in the fixing roller 61. The heater lamp 64 is a halogen lamp, and is such that a glass tube is filled with halogen inactive gas and a tungsten filament (not shown) is placed. By supplying electric power to this filament, the surface of the fixing roller 61 is heated via the inner peripheral surface of the fixing roller 61. By adjusting the position of the heater lamp 64 in the fixing roller 61, the size of the filament in the glass tube of the heater lamp 64, and the position, shape and size of a coil, it is possible to carry out heat distribution such as "center high" which means that the center portion of the fixing roller 61 in the axial direction has high heat, "edge high" which means that the edge portion of the fixing roller 61 in the axial direction has high heat. Note that the rated power of the heater lamp 64 of the present embodiment is 1,000 W.

The fixing roller 61 that is a heated object in the present embodiment is rotatable in a clockwise direction, and the heater lamp 64 incorporated in the fixing roller 61 heats the fixing roller 61 so that the surface of the fixing roller 61 has a desired constant temperature (170° C. in the present embodiment). Moreover, when the sheet P that is the print medium to which an unfixed toner image is transferred passes through a fixation nip portion (will be described later), the fixing roller 61 heats a surface, to which the unfixed toner is transferred, of the sheet P. Note that the fixing roller 61 is in the shape of an inverted crown, that is, the diameter of the center of the fixing roller 61 is smaller than the diameter of each edge of the fixing roller 61, and moreover, the fixing roller 61 includes a core bar 61*a* that is a main body part and is in the shape of a hollow cylinder, a release layer 61*b* formed on an outer peripheral surface of the core bar 61*a*, etc.

As the core bar 61*a*, for example, a metal such as iron, stainless steel, aluminium or copper, or an alloy thereof is used. In the present embodiment, the core bar 61*a* is made of iron (STKM13C) having an external diameter of 40 mm and a thickness of 1.3 mm. Moreover, as the release layer 61*b*, fluorocarbon resin such as PFA (copolymer of tetrafluoroethylene and perfluoroalkyl vinyl ether) or PTFE (polytetrafluoroethylene), silicon rubber, fluorocarbon rubber, or the like is suitable. In the present embodiment, a mixture of PFA and PTFE is applied to the outer peripheral surface of the core bar 61*a* and is burned, so that a layer having a thickness of 25 μm is formed as the release layer 61*b*.

Meanwhile, the pressure roller 62 that is a pressure member is rotatable in an anticlockwise direction, and includes, for example, (i) a core bar 62*a* which is made of iron, stainless steel, aluminium, or the like and is in the shape of a hollow cylinder and (ii) a heat-resistant elastic body layer 62*b* which is formed on the outer peripheral surface of the core bar 62*a* and is made of silicon rubber or the like. Note that a release layer made of fluorocarbon resin may be formed on the outer peripheral surface of the heat-resistant elastic body layer 62*b*, as with the configuration of the fixing roller 61.

In the present embodiment, the pressure roller 62 is such that (i) the heat-resistant elastic body layer 62*b* made of silicon rubber and having a thickness of 5 mm is formed on the outer peripheral surface of the core bar 62*a* having an external diameter of 30 mm and made of stainless steel, and (ii) the outer surface of the heat-resistant elastic body layer 62*b* is coated with a nonconducting tube 62*c* made of PFA. This pressure roller 62 contacts the fixing roller 61 by a biasing member such as a spring (not shown). Thus, a fixation nip portion Y is formed. Then, when the sheet P passes through the fixation nip portion Y, the pressure roller 62 causes the sheet P to contact (or to be heated and pressed by) the fixing roller 61. Thus, the unfixed toner on the sheet P is melted and fixed.

The cleaning roller 67 removes in advance the toner, paper powder, etc. adhered to the pressure roller 62, so as to prevent the pressure roller 62 from damaging. The cleaning roller 67 is provided downstream of the fixation nip portion Y in an anticlockwise direction of the pressure roller 62, contacts the pressure roller 62 by a predetermined pressing force, and rotates by the rotation of the pressure roller 62. Note that the cleaning roller 67 can be constituted by, for example, a metal core 67*a* which is made of aluminium, an iron-based material, or the like and is in the shape of a hollow cylinder. In the present embodiment, a stainless steel-based material is used for the metal core 67*a*.

As shown in FIG. 4, the fixing device 36 of the present embodiment is configured such that the pressure roller 62 contacts the fixing roller 61, and the cleaning roller 67 contacts the pressure roller 62. However, the fixing device 36 of the present embodiment can be further configured such that (i) an external heating roller or an external heating belt contacts the fixing roller 61 or the pressure roller 62 so as to externally heat the surface of the fixing roller 61 or the pressure roller 62, (ii) a web cleaner contacts the fixing roller 61 so as to remove dirt such as the toner adhered to the surface of the fixing roller 61, or (iii) a scraper or a pad contacts the pressure roller 62 so as to remove dirt such as the toner adhered to the surface of the pressure roller 62.

Moreover, the configurations (external diameter, thickness, material, etc.) of the rollers and the configuration of the fixing device are not limited to the above. Further, the rotation speed (process speed) of the fixing roller 61 of the present embodiment is 220 mm/sec, however the present technology is not limited to this. The present technology can accommodate various process speeds by changing the configurations of the rollers, the configuration of the heater lamp, etc.

The temperature detecting section 66 detects, in a noncontact manner, the surface temperature of the fixing roller 61 that is the heated object. The temperature detecting section 66 is placed so that there is a predetermined interval L between the temperature detecting section 66 and the fixing roller 61. In the present embodiment, the predetermined interval L is 5 mm. Note that the number of the temperature detecting sections 66 is not especially limited, and may be one or may be plural.

Figure 5:
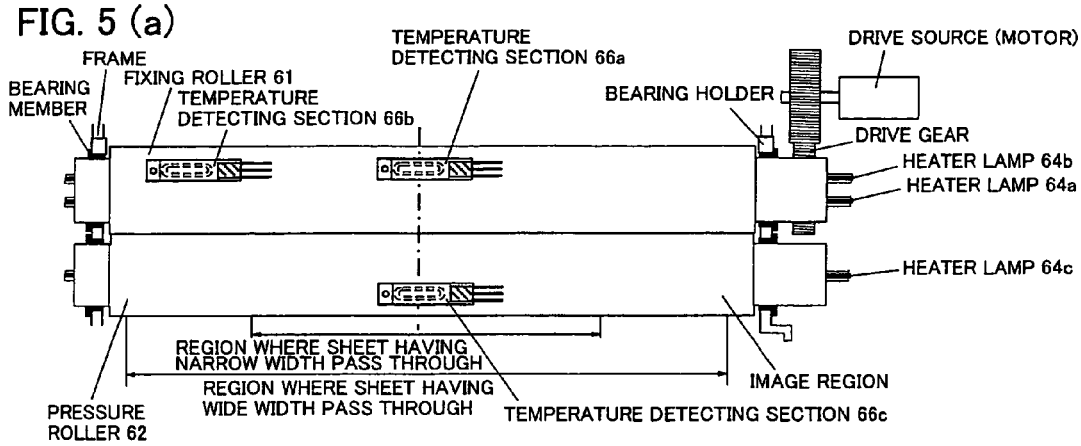
FIGS. 5(*a*) to 5(*c*) are diagrams for explaining where temperature detecting sections are placed.
Figure 5:
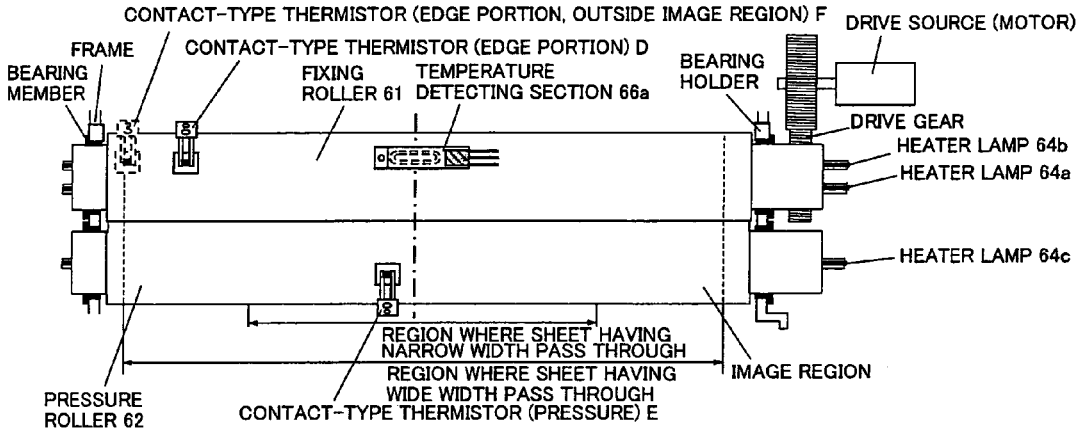
Figure 5:
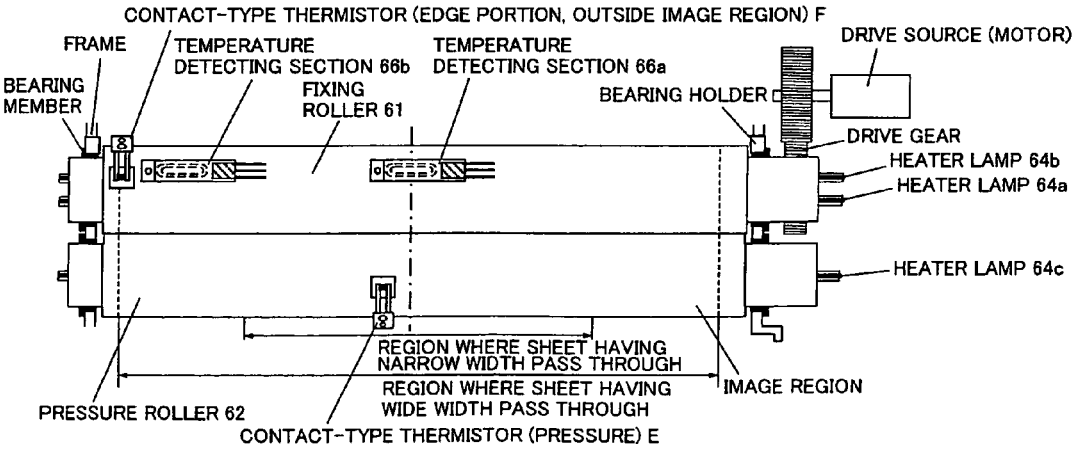

As shown in FIG. 5(*a*), three temperature detecting sections are provided in the present embodiment. In the axial direction of the fixing roller 61, one (temperature detecting section 66*a*) is provided in the vicinity of a paper feeding direction center portion, another (temperature detecting section 66*b*) is provided on a side of the edge portion of the fixing roller at a predetermined distance from the temperature detecting section 66*a*, and the last (temperature detecting section 66*c*) is provided at a position of the pressure roller 62 which position corresponds to the position where the temperature detecting section 66*a* is provided.

Alternatively, as shown in FIG. 5(*b*), in the axial direction of the fixing roller 61, one (the temperature detecting section 66*a*) is provided in the vicinity of the paper feeding direction center portion, one conventional contact-type thermistor is provided on a side of the edge portion of the fixing roller at a predetermined distance from the temperature detecting section 66*a*, and another conventional contact-type thermistor may be provided at a position of the pressure roller 62 which position is on a side of the edge portion of the fixing roller 61, or this another conventional contact-type thermistor may be provided outside an image region of the fixing roller 61 through which the sheet P passes or an image region of the pressure roller 62 through which the sheet P passes.

Further alternatively, in order to quickly detect local temperature rising of both edge portions of the fixing roller due to continuous paper feeding, a conventional contact-type thermistor F (shown in FIG. 5(*c*)) may be provided for safety reasons so as to contact a position where the sheet P does not pass through.

In the following description, the temperature detecting section 66*a* provided at the center of the fixing roller 61 in the axial direction is explained as the temperature detecting section 66.

Figure 6:
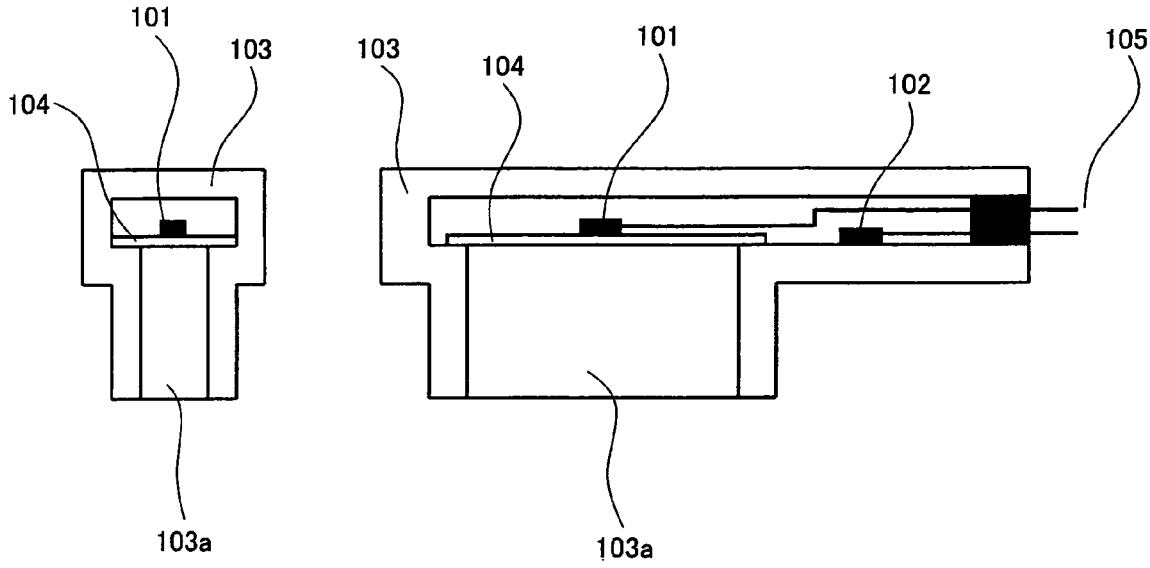
FIG. 6 is a cross-sectional view for explaining the configuration of the temperature detecting section included in the temperature control device.

FIG. 6 is a diagram showing the configuration of the temperature detecting section 66 of the present embodiment. As shown in FIG. 6, the temperature detecting section 66 includes two NTC thermistors (a main temperature detecting section and a compensation temperature detecting section) 101 and 102 each of which changes its resistance value depending on the temperature, a case (a holding body) 103, a heat-resistant film (an infrared radiation absorbing film) 104 and a lead wire 105.

The case 103 has an opening 103*a* on a side of the fixing roller 61. The heat-resistant film 104 is provided inside this opening 103*a*, and the NTC thermistor (the main temperature detecting section, a main thermistor) 101 is provided on the heat-resistant film 104. The NTC thermistor 101 functions as a noncontact-type temperature detecting section. Meanwhile, another NTC thermistor 102 (the compensation temperature detecting section, a compensation thermistor) is provided inside the case 103. This NTC thermistor 102 functions as a compensation temperature detecting section which detects the temperature of the temperature detecting section 66 itself (practically, the case 103). These two NTC thermistors 101 and 102 are connected to the lead wire 105, and another end of the lead wire 105 extends toward outside of the case 103. Note that as the temperature detecting section 66, it is possible to use a device having a configuration similar to that of, for example, NC Sensor F-Type produced by Ishizuka Electronics Corporation. In addition to this, it is also possible to use a device which carries out the temperature detection by detecting the infrared radiation in the same manner as above.

In the present embodiment, the infrared radiation emitted from the surface of the fixing roller 61 passes through the opening 103*a* of the temperature detecting section 66, and is absorbed by the heat-resistant film 104. As a result, the temperature of the heat-resistant film 104 increases depending on the amount of the infrared radiation absorbed. Then, depending on this temperature increase, the resistance value of the NTC thermistor 101 provided on the heat-resistant film 104 changes. Therefore, by grasping the resistance value of the NTC thermistor 101 as a voltage value, it is possible to detect the surface temperature of the fixing roller 61.

Meanwhile, when the ambient temperature of the temperature detecting section 66 (the temperature outside the case 103) changes, the temperature of the temperature detecting section 66 itself changes after a predetermined time. Accordingly, the resistance value of the NTC thermistor 102 attached to the case 103 changes. By grasping the resistance value of the NTC thermistor 102 as a voltage value, it is possible to detect the temperature of the temperature detecting section 66 itself (the temperature of the case 103).

The output voltage value from the NTC thermistor 101 basically corresponds to the surface temperature of the fixing roller 61. However, it is affected by the ambient temperature of the NTC thermistor 101, that is, the temperature of the case 103, etc. Here, compensation is carried out by using the output voltage value of the compensation NTC thermistor 102. Thus, the surface temperature of the fixing roller 61 can be obtained precisely.

Note that each of the NTC thermistors 101 and 102 has a feature that the resistance value becomes small as the temperature increases. Instead of the NTC thermistors 101 and 102, it is possible to use PTC thermistors each having a feature that the resistance value becomes large as the temperature increases.

Figure 7:
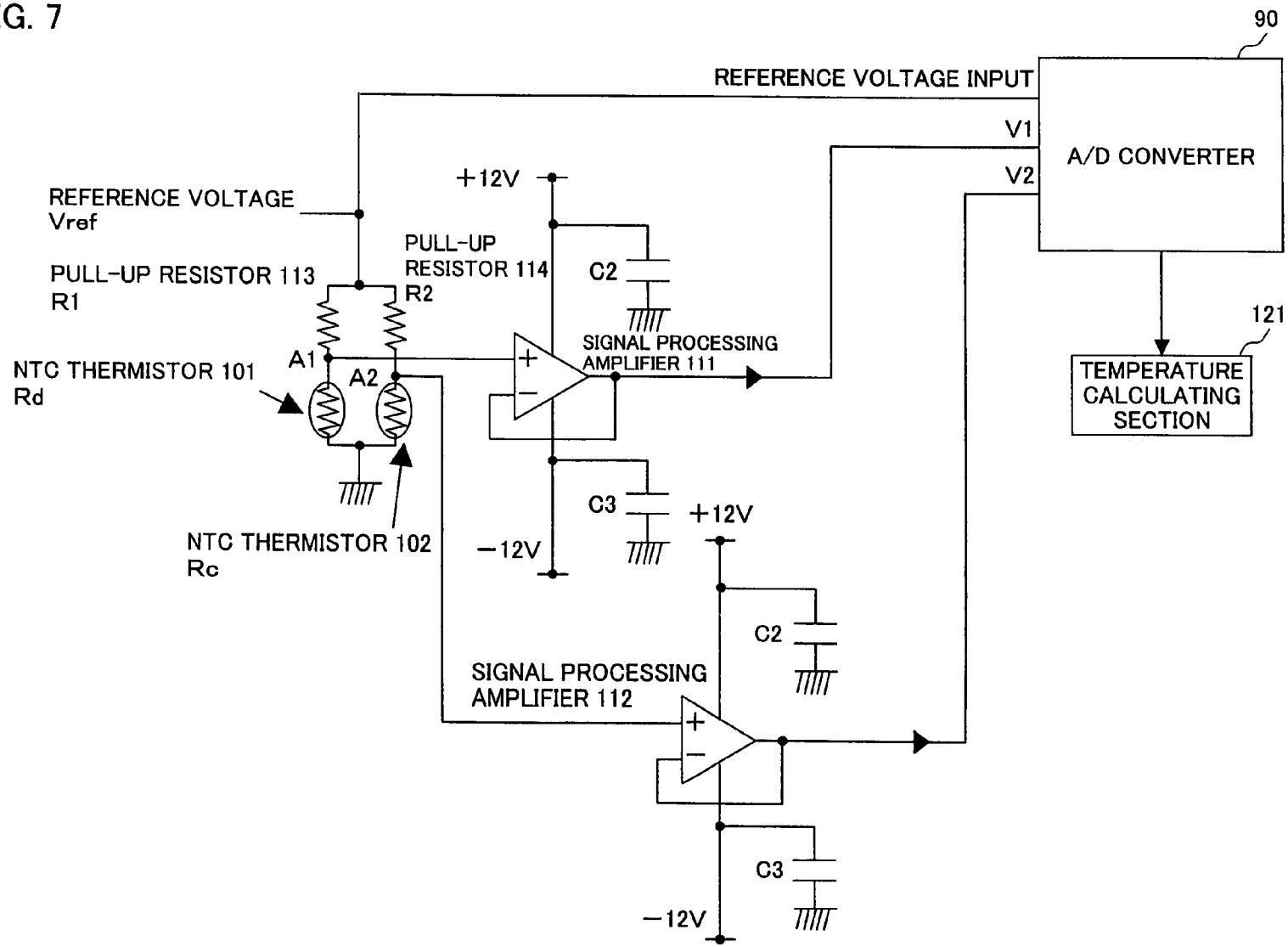
FIG. 7 is a circuit diagram showing that respective parts of the temperature detecting section are connected to an A/D converter.

FIG. 7 is a circuit diagram showing how the NTC thermistors 101 and 102 are connected. As shown in FIG. 7, a circuit including the NTC thermistors 101 and 102 is an equivalent circuit. The NTC thermistor 101 and the NTC thermistor 102 are connected to a reference voltage Vref via pull-up resistors R1 and R2, respectively. Voltages of voltage dividing points A1 and A2 shown in FIG. 7 (V1 that is a voltage output of the voltage dividing point A1 of the NTC thermistor 101 and V2 that is a voltage output of the voltage dividing point A2 of the NTC thermistor 102) are amplified by signal processing amplifiers 111 and 112. Note that examples of the signal processing amplifier are (1) respective package types of LMV821, LMV822 and LMV824 produced by Texas Instruments Incorporated, (2) respective package types of RC4558 produced by Texas Instruments Incorporated, (3) BA4558/4558F/4558N produced by Rohm Co., Ltd., and (4) respective types of LF412 produced by National Semiconductor Corporation. Note that the above amplifiers are just examples, and other types of amplifiers can be used as long as performance of the temperature control can be maintained.

Then, the output voltages V1 and V2 amplified by the signal processing amplifiers are input to the A/D converter 113. Moreover, the reference voltage Vref is also input to the A/D converter 113.

The signal processing amplifiers 111 and 112 output analog voltage signals. When these analog voltage signals are input to the A/D converter 113, the A/D converter 113 quantizes these voltages by comparing each of these voltages with the reference voltage Vref, so as to generate the voltage values. As a result, the voltage value V1 derived from the NTC thermistor 101 and the voltage value V2 derived from the NTC thermistor 102 are obtained. These two voltage values V1 and V2 are input to the temperature calculating section 121.

When the voltage values V1 and V2 are input to the temperature calculating section 121, the temperature calculating section 121 refers to the temperature correspondence table 124, stored in the memory section 122, so as to search for the surface temperature of the fixing roller 61 which temperature corresponds to the voltage values V1 and V2. FIG. 1 is a diagram showing one example of the temperature correspondence table 124. Moreover, FIG. 8 is a diagram for explaining a method for obtaining the surface temperature of the fixing roller 61 from the voltages value V1 and V2 by using the temperature correspondence table 124.

As shown in FIG. 1, the temperature correspondence table 124 is a two-dimensional table in which correspondences between the output voltage values V1 of the NTC thermistor 101 and the surface temperatures of the fixing roller 61 are shown for respective output voltage values V2 of the NTC thermistor 102. That is, since the relationship between the voltage value V1 and the surface temperature of the fixing roller 61 changes depending on the ambient temperature of the NTC thermistor 101 (the temperature of the case 103, etc.), the compensation is carried out based on the output voltage value of the NTC thermistor 102 which value is obtained by detecting the temperature of the case 103. With this, it is possible to suppress a phenomenon that the error occurs in the detected value of the NTC thermistor 101 as the temperature of the case 103 rises.

For example, it is clear from FIG. 8 that when the output voltage value V1 of the NTC thermistor 101 is 1.6221 V and the output voltage value V2 of the compensation NTC thermistor 102 is 1.7477 V, the temperature of the case 103 is 100° C. from Point L that is a value equal to or slightly smaller than the voltage value of 1.7477 V of the compensation NTC thermistor 102. Then, by (i) tracing this row to the right to obtain Point M (crossing position) that is a value equal to or slightly smaller than the voltage value of 1.6221 V of the NTC thermistor 101, and (ii) tracing upwardly from Point M to obtain the temperature of Point N (crossing position) which crosses the surface temperature of the fixing roller 61, it is found that the temperature "170° C." shown in Point N is the compensated surface temperature of the fixing roller 61.

Thus, the temperature calculating section 121 detects the surface temperature of the fixing roller 61 from the output voltage value V1 of the NTC thermistor 101 and the output voltage value V2 of the compensation NTC thermistor 102.

Here, the technology has a feature that a difference (hereinafter referred to as "interval") between adjacent output voltage values of the NTC thermistor (the main temperature detecting section) 101 and an interval between adjacent output voltage values of the NTC thermistor (the compensation temperature detecting section) 102 in the temperature correspondence table 124 are set so that an interval between adjacent values of temperatures (compensation temperatures) corresponding to respective output voltage values of the NTC thermistor 102 is smaller than an interval between adjacent values of temperatures (surface temperatures of the fixing roller) corresponding to respective output voltage values of the NTC thermistor 101. More specifically, it is preferable that the respective intervals of the voltage output values be set so that the interval between adjacent values of the compensation temperatures is 0.1 times or more but less than 0.5 times the interval between adjacent values of the surface temperatures, and it is more preferable that they be set so that the interval between adjacent values of the compensation temperatures is 0.2 times the interval between adjacent values of the surface temperatures. The intervals in a conventional temperature table has been set so that it is possible to detect the temperature change which is nearly equal to a control temperature accuracy (for example, 1° C.). However, the technology is set as above in light of the characteristics of the NTC thermistors.

With this, it is possible to precisely detect the compensation temperature (the temperature of the case 103) on the basis of the output voltage value V2 of the NTC thermistor 102, and also possible to precisely detect the surface temperature corresponding to the change in the voltage value V2 of the NTC thermistor 102 used for the compensation. Meanwhile, the detection resolution of the NTC thermistor 101 does not have to be precise excessively, but can be the minimum detection resolution. Thus, by setting the interval between adjacent values of the temperatures of the NTC thermistor 102 to be small, it is possible to prevent such a phenomenon that the surface temperature based on the output value V1 of the NTC thermistor 101 changes largely when the output value V2 of the NTC thermistor 102 changes slightly so as to change from one value set in a table to its adjacent value. Therefore, it is possible to precisely detect the surface temperature of the fixing roller 61.

As one example, the temperature correspondence table 124 of FIG. 1 of the present embodiment shows the compensation temperatures (the temperatures of the case 103) at intervals of 0.2° C., and the output voltage values of the NTC thermistor 102 which values correspond to the compensation temperatures. Meanwhile, the temperature correspondence table 124 shows the surface temperatures of the fixing roller 61 at intervals of 1° C., and the output voltage values of the NTC thermistor 102 which values correspond to the surface temperatures.

The surface temperature of the fixing roller 61 can be detected by using the temperature correspondence table 124. However, in order to carry out the temperature detection more precisely, it is preferable that the temperature calculating section 121 further correct the surface temperature, obtained by using the temperature correspondence table 124, in accordance with the compensation temperature (the temperature of the case 103) and/or the environmental temperature.

Figure 9:
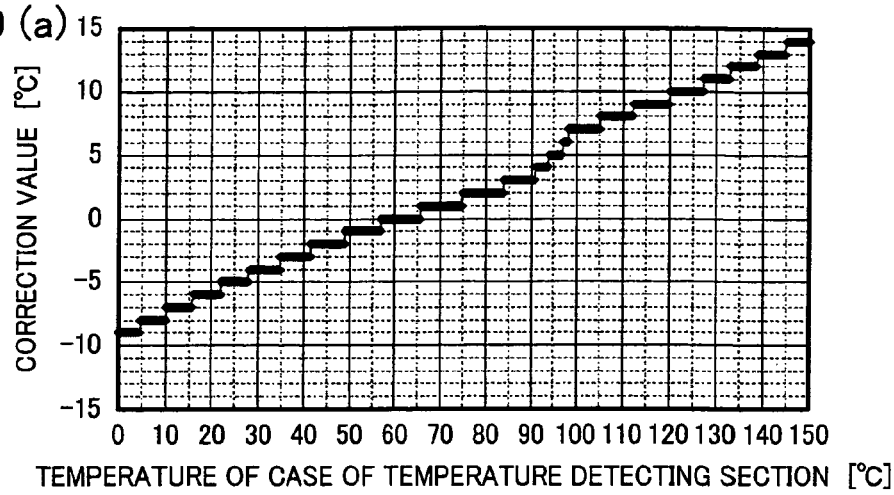
FIG. 9(*a*) is a diagram showing data of correction values corresponding to the temperatures of a case of the temperature detecting section used at normal temperature and normal humidity.
Figure 9:
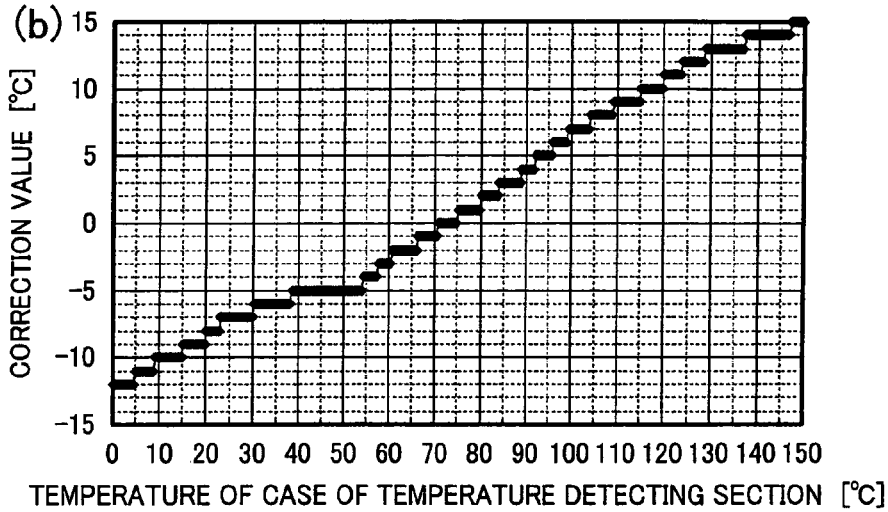
Figure 9:
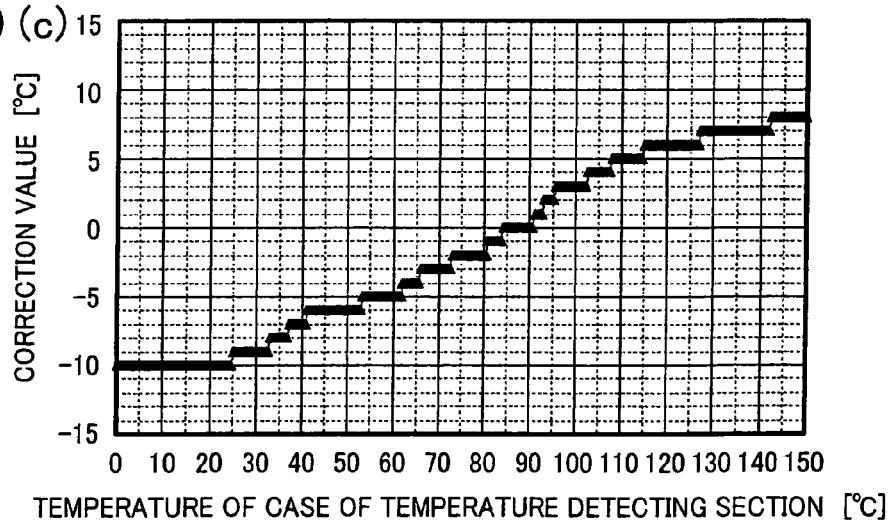

In the present embodiment, the memory section 122 stores first correction value data 125 that is data of the correction values for the respective compensation temperatures (the temperatures of the case 103). FIG. 9(*a*) is a diagram visualizing the first correction value data 125, and is a graph showing the relationship between the temperature of the case 103 and the correction value. In the present embodiment, a table of the correction values corresponding to the temperatures (at intervals of 0.2° C.) of the case 103 is stored as the first correction value data 125.

For example, when the output voltage value of the NTC thermistor 102 is 1.7477 V and the temperature of the case 103 is 100° C., the temperature calculating section 121 refers to the first correction value data 125 of FIG. 9(*a*) so as to obtain the correction value "+7° C.". Then, the surface temperature "170° C." of the fixing roller 61 obtained as above by using the temperature correspondence table 124 is corrected by this correction value. As a result, the surface temperature of the fixing roller 61 obtained by the temperature calculating section 121 is 177° C. Information of the surface temperature of the fixing roller 61 obtained eventually by the temperature calculating section 121 is input to the heat control section 123.

Note that the memory section 122 may store plural pieces of the first correction value data which pieces are different from each other depending on environmental conditions, and the temperature calculating section 121 may select, depending on the environmental condition, one piece of first correction value data, to be used for the compensation, from the plural pieces of the first correction value data. Examples of the environmental condition are the room temperature, humidity, etc. of a place where the image forming apparatus is placed.

More specifically, the memory section 122 stores (i) the table of FIG. 9(*a*) as the first correction value data used at normal temperature and normal humidity (N/N environment), (ii) a table of FIG. 9(*b*) as the first correction value data used at low temperature and low humidity (L/L environment), and (iii) a table of FIG. 9(*c*) as the first correction value data used at high temperature and high humidity (H/H environment). Then, depending on the environmental conditions obtained from a thermometer, a hygrometer, etc., the temperature calculating section 121 switches among three tables of the first correction value data for correction.

With this, the temperature calculating section 121 can carry out the correction more precisely in accordance with the environmental conditions, and can obtain the surface temperature of the fixing roller 61 more precisely.

Next, the heat control section 123 judges whether the corrected surface temperature "177° C." obtained by the temperature calculating section 121 is higher or lower than a predetermined target temperature TS (for example, 170° C.). Then, when the surface temperature of the fixing roller 61 is higher than the target temperature TS, the heat control section 123 instructs via the driver 91 not to supply electric power to the heater lamp 64, so that the heater lamp 64 stops heating. Meanwhile, when the surface temperature of the fixing roller 61 is lower than the target temperature TS, the heat control section 123 instructs via the driver 91 to supply electric power to the heater lamp 64, so that the heater lamp 64 heats. Regarding the driving of the heater lamp 64, it may be possible to improve, by introducing hysteresis, controllability when judging whether to supply electric power.

Figure 10:
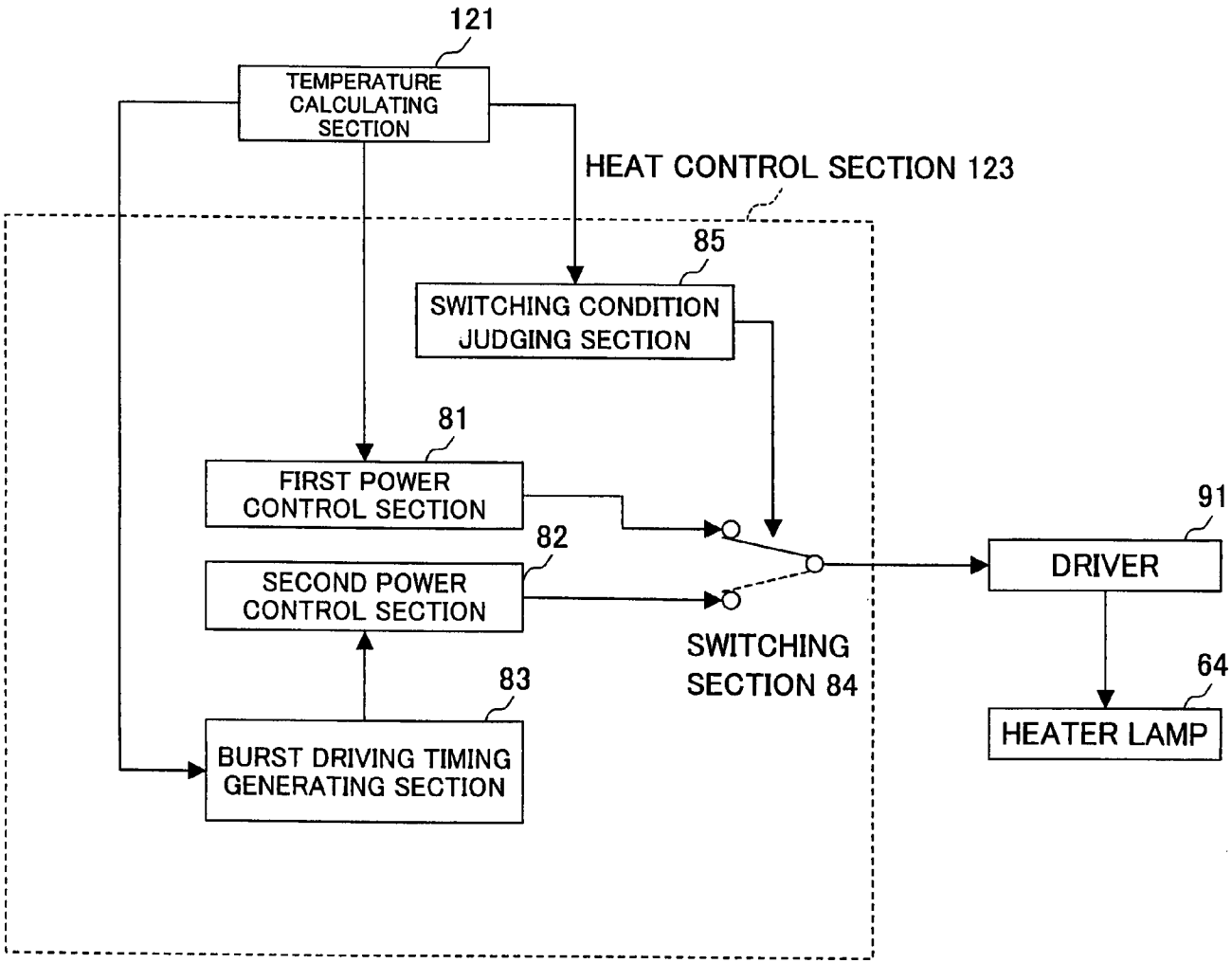
FIG. 10 is a block diagram for explaining a detailed functional configuration of a heat control section.

FIG. 10 is a block diagram showing a detailed configuration of the heat control section 123. As shown in FIG. 10, the heat control section 123 includes a first power control section 81, a second power control section 82, a burst driving timing generating section 83, a switching condition judging section 85 and a switching section 84. Moreover, the heat control section 123 is connected to the control section (not shown) which controls all the operations of the image forming apparatus 100.

The first power control section 81 is connected to respective components such as the control section, a drive section, etc. constituting the image forming apparatus 100, and controls set electric power values of electric power supplied to respective components including the temperature detecting section 66. The set electric power values are output command values of electric power supplied to respective components. Outputs of electric power to respective components are carried out based on the set electric power values.

The first power control section 81 is connected to the heater lamp 64 via the switching section 84 and the driver 91, receives the value of the surface temperature of the fixing roller 61 from the temperature calculating section 121, controls the set electric power value of electric power supplied to the heater lamp 64 on the basis of the value of the surface temperature and the target temperature, and executes a first electric power control mode for supplying electric power of the set electric power value to the heater lamp 64. Usually, the surface temperature of the fixing roller 61 is kept at a constant temperature by using the first power control section 81.

Note that the rated power of the heater lamp 64 is 1,000 W in the present embodiment. However, a permissible electric power value that is a value of electric power which can practically be supplied to the heater lamp 64 by the first power control section 81 is limited to 700 W. This is because (i) the electric power supplied from the commercial power source to the image forming apparatus 100 is usually 1,500 W, (ii) other components constituting the image forming apparatus 100 also need electric power supply, and (iii) some components do not function normally if 1,000 W is supplied to the heater lamp 64.

The second power control section 82 is connected to the heater lamp 64 via the switching section 84 and the driver 91, and is also connected to the burst driving timing generating section 83. Moreover, the second power control section 82 executes a second electric power control mode for controlling the set electric power value of electric power, supplied to the heater lamp 64, on the basis of operating conditions of the respective components of the image forming apparatus 100.

Further, the second power control section 82 supplies electric power of the set electric power value to the heater lamp 64 for a predetermined time on the basis of a signal output from the burst driving timing generating section 83, so as to burst-drive the heater lamp 64 (so as to force the heater lamp 64 to drive). The burst driving timing generating section 83 outputs a signal to the second power control section 82 in sync with a second control cycle that is a control cycle of the second power control section 82.

In addition, the second power control section 82 sets, on the basis of the operating conditions of the respective components of the image forming apparatus 100, the set electric power value that is equal to or more than the permissible electric power value for the heater lamp 64, so as to burst-drive the heater lamp 64. That is, electric power obtained by subtracting electric power used by the respective components from electric power (1,500 W) supplied from the commercial power source to the image forming apparatus 100 is supplied to the heater lamp 64. Thus, it is possible to appropriately burst-drive the heater lamp 64 while preventing respective components from lacking necessary electric power and maintaining the functions of the respective components.

In the burst driving, electric power of the set electric power value is supplied to the heater lamp 64 for a predetermined time based on the burst driving timing generating section 83 in one cycle of the second control cycle. Thus, by periodically supplying electric power to the heater lamp 64 for a predetermined time to burst-drive the heater lamp 64, electric power is generated in a pulsed manner each time power supply is started. Therefore, electric power averagely higher than the set electric power value is supplied to the heater lamp 64, and it is possible to cover insufficient electric power.

Figure 11:
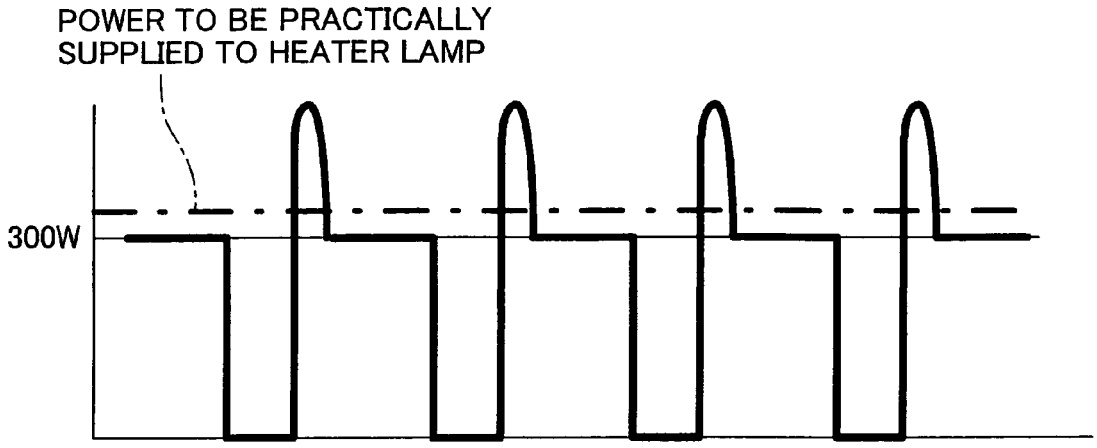
FIG. 11 is a diagram for explaining burst driving of a heater lamp.

For example, as shown in FIG. 11, in order to gain higher electric power than the permissible electric power "300 W" in the case of driving the heater lamp 64 within the permissible electric power, the heater lamp 64 is burst-driven. In the case of the burst driving shown in FIG. 11, electric power higher than 300 W is generated temporarily. By repeatedly carrying out the burst driving by a predetermined second control cycle unit, electric power averagely higher than 300 W is supplied to the heater lamp 64.

The switching section 84 switches electric power settings by a switching element, such as a relay, a thyristor or a triac, or by software. Specifically, depending on the operating conditions of the respective components constituting the image forming apparatus 100, the switching section 84 switches between the first power control section 81 and the second power control section 82 so as to switch between the first electric power control mode and the second electric power control mode.

For example, the switching section 84 switches from the first electric power control mode to the second electric power control mode when (i) the surface temperature of the fixing roller 61 becomes lower than a constant temperature due to continuous printing, (ii) the permissible power value which can be supplied to the heater lamp 64 by the first electric power control mode cannot quickly increase the temperature of the surface of the fixing roller 61, (iii) driving power consumed by the respective components is small, and (iv) electric power higher than the permissible power value can be supplied to the heater lamp 64.

To synchronize the first electric power control mode with the second electric power control mode, the second control cycle that is the control cycle of the second power control section (the second electric power control mode) is set to be an integral multiple of a first control cycle that is the control cycle of the first power control section (the first electric power control mode). For example, in the present Examples, the control cycle of the first electric power control mode is the cycle of 150 ms, and the control cycle of the second electric power control mode is the cycle of 3.0 s. Then, during the second electric power control mode, electric power is supplied to the heater lamp 64 in a pulsed manner for a predetermined time (750 ms in the present embodiment) in one cycle of the second control cycle, so that the heater lamp 64 is forced to drive.

As above, the heat control section 123 controls the heating power of the heater lamp 64 on the basis of the surface temperature of the fixing roller 61 which temperature is obtained by the temperature calculating section 121.

Here, in the temperature correspondence table 124 described above, it is preferable that the interval between adjacent output voltage values of the NTC thermistor 101 be set so that the interval between adjacent values of the surface temperatures of the fixing roller 61 which temperatures corresponding to the respective output voltage values is 0.5 times to 1 times the control temperature accuracy by the heater lamp 64 with respect to the fixing roller 61. In the present embodiment, the control temperature accuracy by the heater lamp 64 with respect to the fixing roller 61 is 1° C., and the interval between adjacent surface temperatures of the fixing roller 61 is 1° C. Therefore, the interval between adjacent surface temperatures is 1 times the control temperature accuracy.

With this configuration, it is possible to stably carry out the temperature control without an increase in the temperature ripple or drift.

Moreover, in the temperature correspondence table 124 described above, it is preferable that the interval between adjacent output voltage values of the NTC thermistor 101 be set so that the interval between adjacent values of the surface temperatures of the fixing roller 61 which temperatures correspond to the respective output voltage values is 0.5 times to 1 times a detection temperature accuracy of the NTC thermistor 101. In the present embodiment, the detection temperature accuracy of each of the NTC thermistors 101 and 102 is 1° C., and the interval between adjacent values of the surface temperatures of the fixing roller 61 is 1° C. Therefore, the interval between adjacent values of the surface temperatures is 1 times the detection temperature accuracy.

With this configuration, it is possible to stably carry out the temperature control without an increase in the temperature ripple or drift.

As above, in the present embodiment, the interval between the adjacent output voltage values of the NTC thermistor 101 and the interval between the adjacent output voltage values of the NTC thermistor 102 in the temperature correspondence table 124 are set so that the interval between adjacent values of the temperatures of the case 103 which temperatures correspond to the respective output values of the NTC thermistor 102 in the temperature correspondence table 124 is smaller than the interval between adjacent values of the temperatures of the fixing roller 61 which temperatures correspond to the respective output values of the NTC thermistor 101 in the temperature correspondence table 124. Moreover, the interval between adjacent values of the temperatures of the case 103 is preferably 0.5 times the interval between adjacent values of the temperatures of the fixing roller 61, more preferably 0.1 times or more but less than 0.5 times, and further preferably 0.1 times to 0.25 times.

This is true even when the quantization resolution of the A/D converter 90, the reference voltage Vref and the resistance value of the pull-up resistor are different.

Finally, based on Examples below, the following proves that the temperature control device 80 included in the fixing device 36 of the present embodiment can carry out the temperature detection accurately and can carry out the temperature control accurately.

Figure 12:
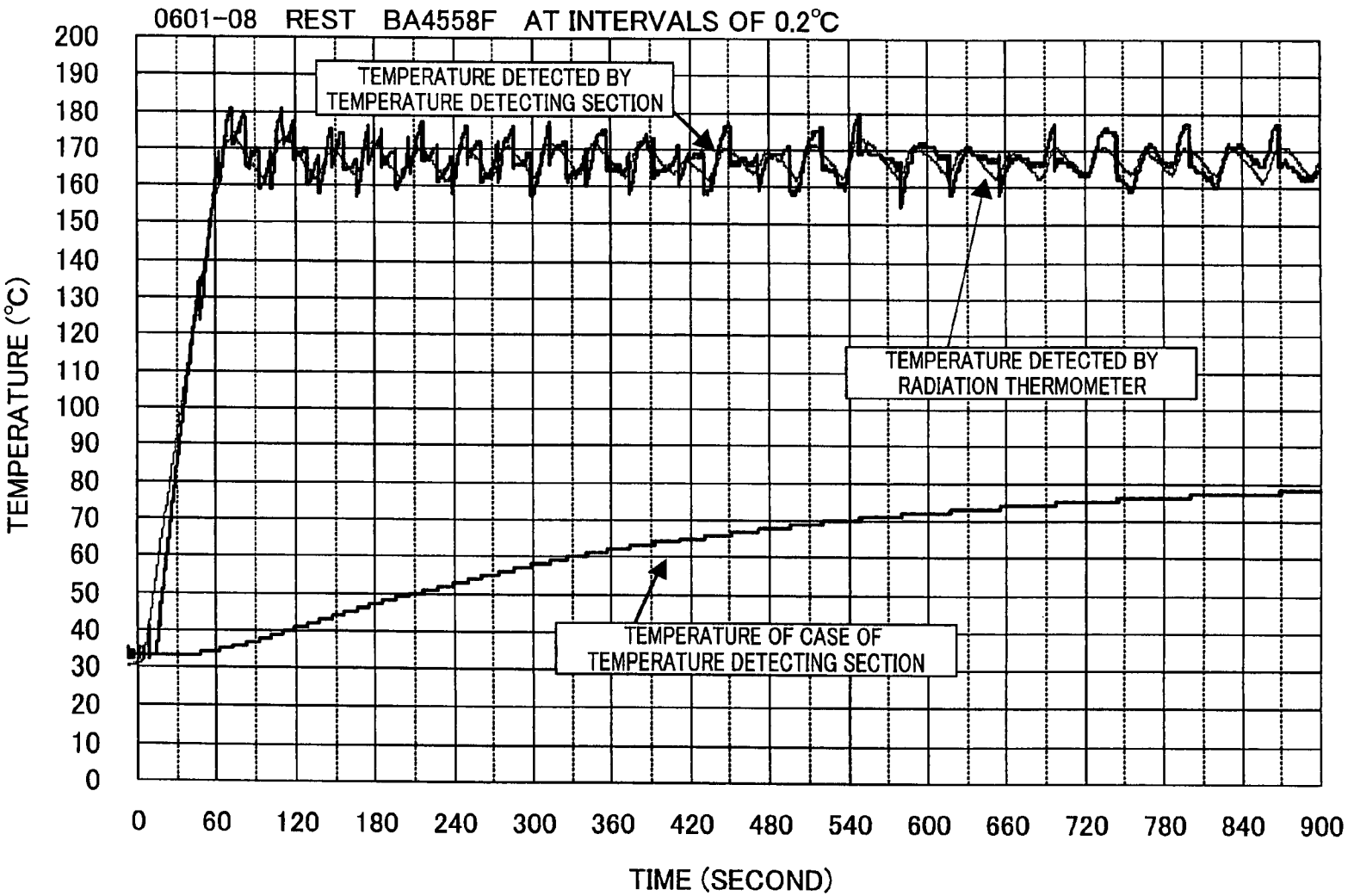
FIG. 12 is a diagram showing results of Example 1.

In Example 1, the temperature control device of Embodiment 1 carried out the temperature control of the fixing roller. In Example 1, (i) the surface temperatures of the fixing roller which temperatures are detected by the temperature detecting section and (ii) the temperatures of the temperature detecting section itself (the temperatures of the case) were plotted. Moreover, in order to measure the actual surface temperature of the fixing roller, a radiation thermometer that is unrelated to the present embodiment was prepared. The actual surface temperatures of the fixing roller which temperatures were measured by this radiation thermometer were also plotted. Results are shown in FIG. 12. As shown in FIG. 12, in the temperature control device of Example 1, the detected values by the temperature detecting section are close to the measured values by the radiation thermometer. Thus, the temperature detecting section of Example 1 accurately detected the change in the temperature of the fixing roller. Further, a phenomenon that the temperature ripple increases as time advances did not occur. Moreover, the temperature of the fixing roller could be kept at an appropriate constant temperature (168±3° C.), as with when using a conventional contact-type thermistor.

Figure 13:
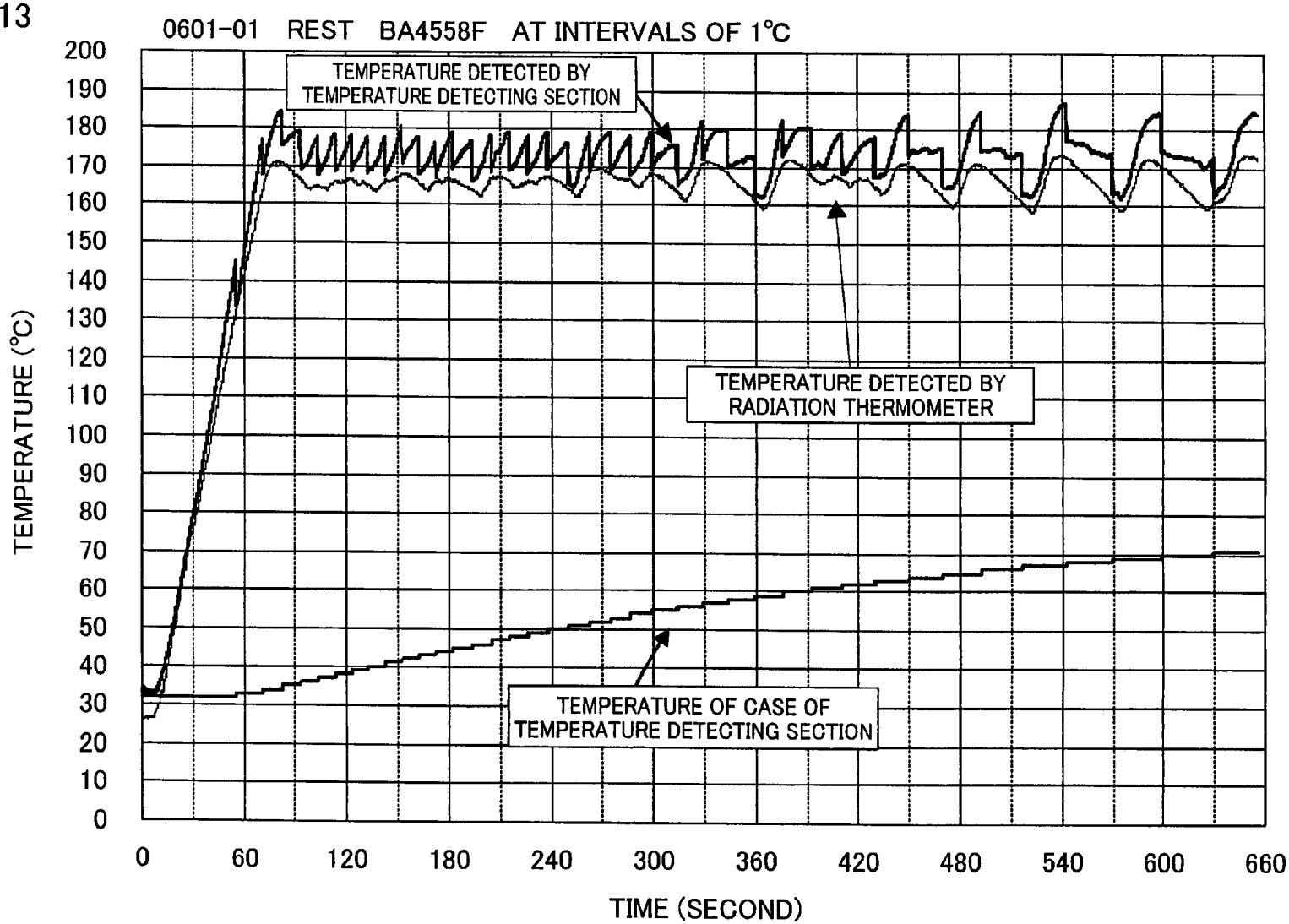
FIG. 13 is a diagram showing results of Comparative Example 1.

Meanwhile, in Comparative Example 1 corresponding to Example 1, prepared was the temperature control device in which the interval between adjacent temperatures of the temperature detecting section itself (the case) in the temperature correspondence table was set to 1° C., and the temperature control of the fixing roller was carried out in the same manner as Example 1. Note that the temperature control device of Comparative Example 1 was the same as that of Example 1 except for the temperature correspondence table. Results are shown in FIG. 13. As shown in FIG. 13, in the temperature control device of Comparative Example 1, the detected values by the temperature detecting section drifted toward a high temperature side as compared with the measured values by the radiation thermometer. Thus, the temperature detecting section of Comparative Example 1 could not precisely detect the change in the temperature of the fixing roller. Further, the ripple in the detected temperatures of the fixing roller increased as time advances (166±7° C.), and the temperature control could not follow the change in the temperature of the fixing roller.

This has proved the effectiveness of the temperature control device of Embodiment 1.

Embodiment 2

The following will explain the fixing device using the temperature control device of another embodiment. Explanations for members having the same functions as those explained in Embodiment 1 are omitted.

Figure 14:
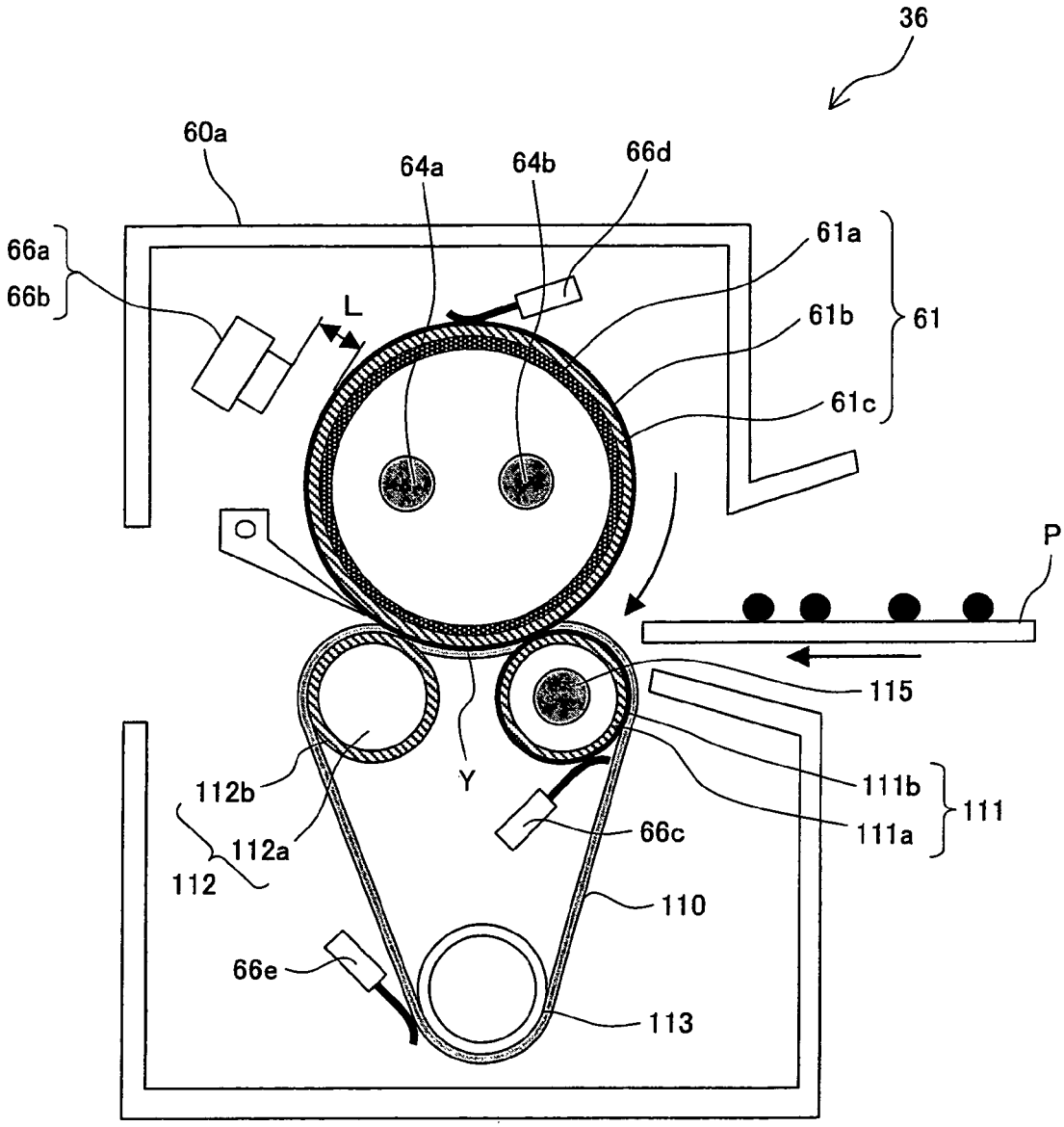
FIG. 14 is a cross-sectional view for explaining a partial configuration of the fixing device including the temperature control device.

FIG. 14 is a diagram showing the configuration of the fixing device 36 of the present embodiment. The fixing device 36 of the present embodiment basically has the same configuration as that of Embodiment 1, but two heater lamps 64*a* and 64*b* are incorporated in the fixing roller 61. The heater lamp 64*a* intensively heats the center portion of the fixing roller 61 in the axial direction whereas the heater lamp 64*b* intensively heats the edge portions of the fixing roller 61 in the axial direction.

Further, a member similar to the temperature detecting section 66 of Embodiment 1 is provided at the center portion and one edge portion of the fixing roller 61. In the following description, the temperature detecting section provided at the center portion of the fixing roller 61 in the axial direction is referred to as a temperature detecting section 66*a*, and the temperature detecting section provided at one edge portion of the fixing roller 61 in the axial direction is referred to as a temperature detecting section 66*b*.

The temperature detecting section 66*a* is used for the temperature control carried out by supplying electric power or by not supplying electric power to the heater lamp 64*a* which heats the center portion of the fixing roller 61 whereas the temperature detecting section 66*b* is used for the temperature control carried out by supplying electric power or by not supplying electric power to the heater lamp 64*b* which heats both edge portions of the fixing roller 61. Then, a contact-type thermistor contacts a no sheet passing portion (a portion through which a sheet does not pass) of the fixing roller 61 in order to detect the abnormal temperature rising due to the trouble of a temperature control section or the abnormal temperature rising at the no sheet passing portion when forming an image onto a small sheet. If, while sheets are passing, the temperature detected by the contact-type thermistor exceeds a predetermined threshold value (for example, 235° C.), a cooling mode is executed for cooling respective members to protect the fixing roller 61 and its peripheral members.

A pressure belt 110 in the shape of a belt contacts the fixing roller 61 by a pressure/heat roller 111 and a removing roller 112, and the fixation nip portion Y is formed between the pressure belt 110 and the fixing roller 61. The pressure belt 110 stretches by the pressure/heat roller 111, the removing roller 112 and a tension roller 113, and rotates by a drive power of the rotation of the fixing roller 61. A heater lamp 115 for carrying out heating is provided inside a core bar 111*a* of the pressure/heat roller 111. In order to remove sheets, the pressure belt 110 rotates at a rotation speed about 2% to 10% slower than the rotation speed of the fixing roller 61. Moreover, in order to effectively give the drive power and to promote the removing operation, the removing roller 112 is configured such that a rubber layer 112*b* (silicon rubber) having heat resistance and a thickness of 1 mm is formed on the outer peripheral surface of the core bar 112*a*.

Figure 15:
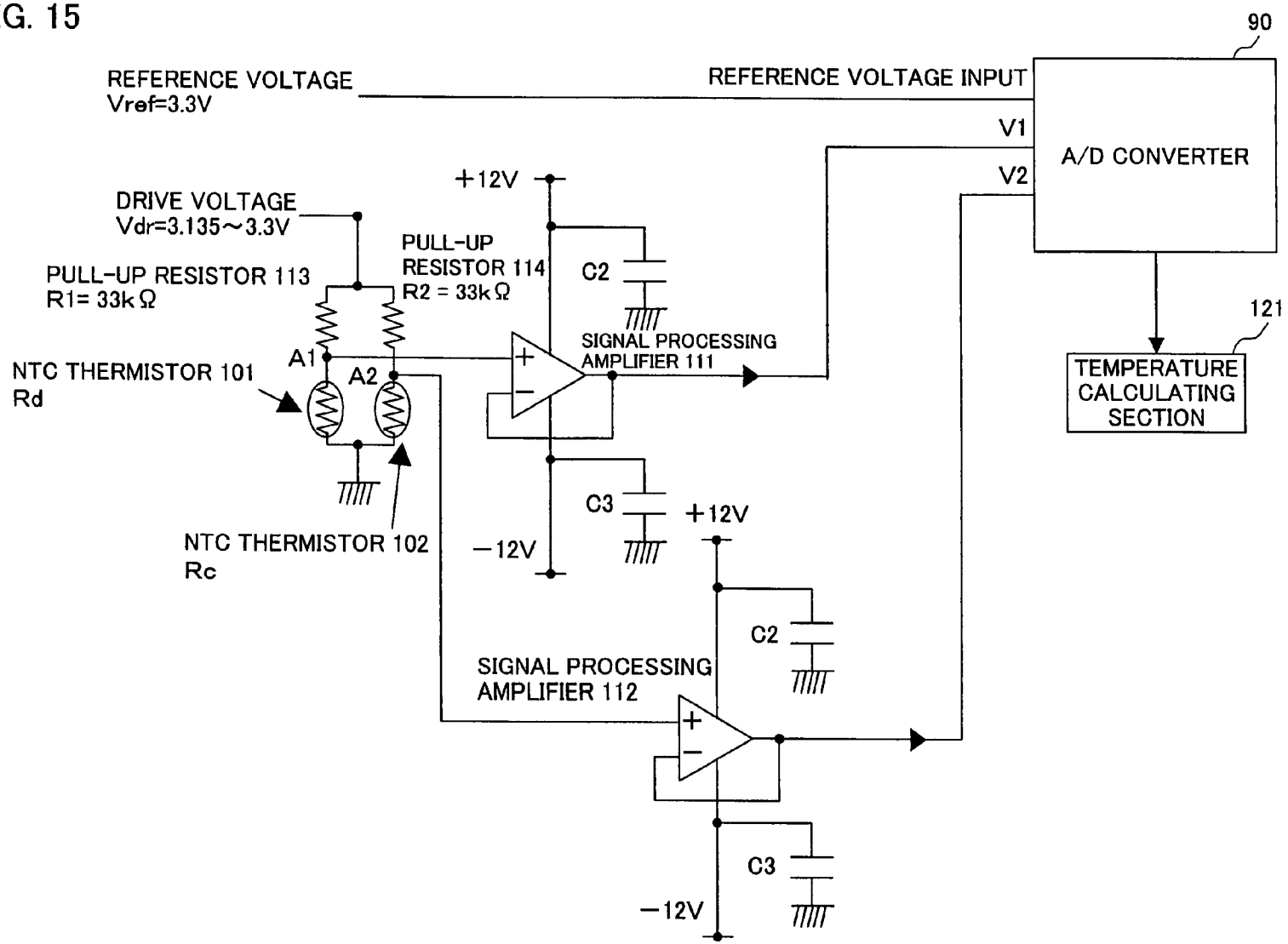
FIG. 15 is a circuit diagram showing that respective parts of the temperature detecting section are connected to the A/D converter.

FIG. 15 is a circuit diagram showing how the NTC thermistors 101 and 102 of the present embodiment are connected. As with Embodiment 1 described above, the circuit of the present embodiment includes (i) the NTC thermistor 101 which detects the infrared radiation passing through the opening 103*a* of the temperature detecting section 66 and outputs a voltage (V1) corresponding to the surface temperature of the fixing roller 61 and (ii) the NTC thermistor 102 which outputs a voltage (V2) corresponding to the temperature of the temperature detecting section 66 itself (the case 103). Then, the NTC thermistors 101 and 102 are connected to the reference voltage Vref via different pull-up resistors, the resistance values of the NTC thermistor 101 and the NTC thermistor 102 which values correspond to the temperatures are converted to voltages, and the voltages are input to the A/D converter 90.

Here, in the present embodiment, a drive voltage Vdr applied to the temperature detecting sections 66*a* and 66*b* is set to more than 95% but not more than 100% of the reference voltage Vref input to the A/D converter 90. Note that the reference voltage Vref input to the A/D converter 90 is a voltage that is a comparison criterion when a voltage signal output from the NTC thermistors 101 and 102 and subjected to the signal processing is converted to a digital voltage value.

If the output voltage of a voltage source which supplies the drive voltage of the NTC thermistors 101 and 102 varies, the output voltage values of the NTC thermistors 101 and 102 also vary, and the surface temperature of the fixing roller 61 detected by using the temperature correspondence table 124 become quite different from a proper value. Therefore, the temperature control of the fixing roller 61 is carried out based on an incorrect detected temperature. Therefore, the temperature control of the fixing roller 61 is carried out while there is a constant temperature difference between the temperature of the fixing roller 61 and a desired temperature of the fixing roller 61, and the temperature drift and ripple are increased. Thus, the temperature control is not carried out appropriately.

Here, as shown in FIG. 15, when the reference voltage Vref input to the A/D converter 90 is, for example, 3.3 V, the drive voltage applied to the pull-up resistor 113 and the NTC thermistor 101 is set to more than 3.135 V but not more than 3.3 V. Moreover, when the reference voltage Vref is 5 V, the drive voltage is set to more than 4.75 V but not more than 5 V. Note that a circuit such as Zener diode or a voltage regulator can be used for step-down.

With this, the gap between the voltage value stored in the temperature correspondence table 124 and the voltage value actually obtained from the temperature detecting section becomes smaller than a detectable voltage value, that is, an acceptable level, and the temperature conversion is carried out appropriately. As a result, it is possible to carry out the temperature control stably without an increase in the temperature drift or ripple.

When the drive voltage Vdr is more than 100% of the reference voltage Vref, a voltage resolution when detecting a voltage impacts more significantly than when the drive voltage Vref is from 100% to 95% of the reference voltage Vref. Therefore, the above configuration is preferable. This impact may become more significant depending on the characteristics of the NTC thermistor that is a temperature detecting element.

Moreover, it is preferable to use, as the pull-up resistors 113 and 114, a resistor whose tolerance between the actual resistance value and a nominal value (for example, 33 kΩ) shown in a specification is within ±1% (32.67 kΩ to 33.33 kΩ). This is because since the output voltages from the NTC thermistors 101 and 102 are determined depending on the ratio of the resistance values of the pull-up resistors 113 and 114 to the resistance values of the NTC thermistors 101 and 102, the surface temperature of the fixing roller 61 cannot be detected precisely if the value of the pull-up resistor varies. If the resistance value of the pull-up resistor which determines a voltage dividing ratio varies, the detected surface temperature of the fixing roller 61 becomes different from the actual surface temperature. Thus, the temperature drift and ripple are increased, and the temperature control becomes unstable.

In order to use the pull-up resistor in which the tolerance of the resistance value is within ±1%, for example, (i) a resistance element having a desired resistance value range may be selected from a large number of resistance elements, or (ii) the resistance value may be adjusted by burning off the surface of the resistor finely by laser trimming. For example, it is possible to use, as the pull-up resistor, a product selected from 1,000 Thin Film Chip Resistors "RR1220" (33 kΩ) produced by Susumu Co., Ltd.

Moreover, when the A/D converter 90 quantizes the output voltages from the NTC thermistors 101 and 102, it is preferable that the resolution be from 10 bits to 14 bits. In the present embodiment, the quantization is carried out with the resolution of 10 bits, as one example.

Usually, a voltage supplied from a power source section is 5 V or less. Moreover, the drive voltage of the NTC thermistors 101 and 102 is often 3.3 V. Here, when the resolution is 8 bits or 9 bits, the resolution is not enough, the deviation of the detected temperature obtained by using the temperature correspondence table increases, and the stable temperature control cannot be carried out.

Meanwhile, when the resolution is 15 bits or 16 bits, the resolution is enough. However, such resolution costs a lot, and the cost performance is very low. If the resolution is from 10 bits to 14 bits, the temperature detection is carried out sufficiently precisely for the temperature control, the troubles in the quantization can be reduced, and the cost performance can be improved.

Moreover, as shown in FIG. 15, the output voltages from the NTC thermistors 101 and 102 are input to the A/D converter 90 via the signal processing amplifiers 111 and 112. Thus, impedance matching is carried out, and the distortion of signal waveform is prevented. Therefore, the signal processing amplifiers 111 and 112 needs to faithfully transfer the output values of the NTC thermistors 101 and 102 from input terminals of the signal processing amplifiers 111 and 112 to output terminals thereof. This is because if a disturbance mingles in the signal processing amplifiers 111 and 112, the deviation of the output values from the NTC thermistors 101 and 102 increases, the temperature drift and ripple increases, and the temperature control becomes unstable.

For the reasons described above, each of the signal processing amplifiers 111 and 112 has an input-offset voltage of preferably 2 mV or less (Type value), and more preferably 1 mV or less. Moreover, it is preferable that each of the signal processing amplifiers 111 and 112 have smaller input-offset voltage when the sensitivity of each of the NTC thermistors 101 and 102 is higher.

With this, the signal transfer of the noncontact-type temperature detecting section 66 is not disturbed, and the temperature detection is carried out accurately. As a result, the temperature drift and ripple do not increase, and the stable temperature control can be carried out.

When the signal processing amplifier has the input-offset voltage larger than the above condition, but a dedicated adjustment terminal is provided at the input terminal of this signal processing amplifier, the input-offset voltage may be set to 1 mV or less by adjusting the voltage value input to this adjustment terminal. Moreover, by devising the circuit, the input-offset voltage may be adjusted. These signal processing amplifiers may be used.

Figure 16:
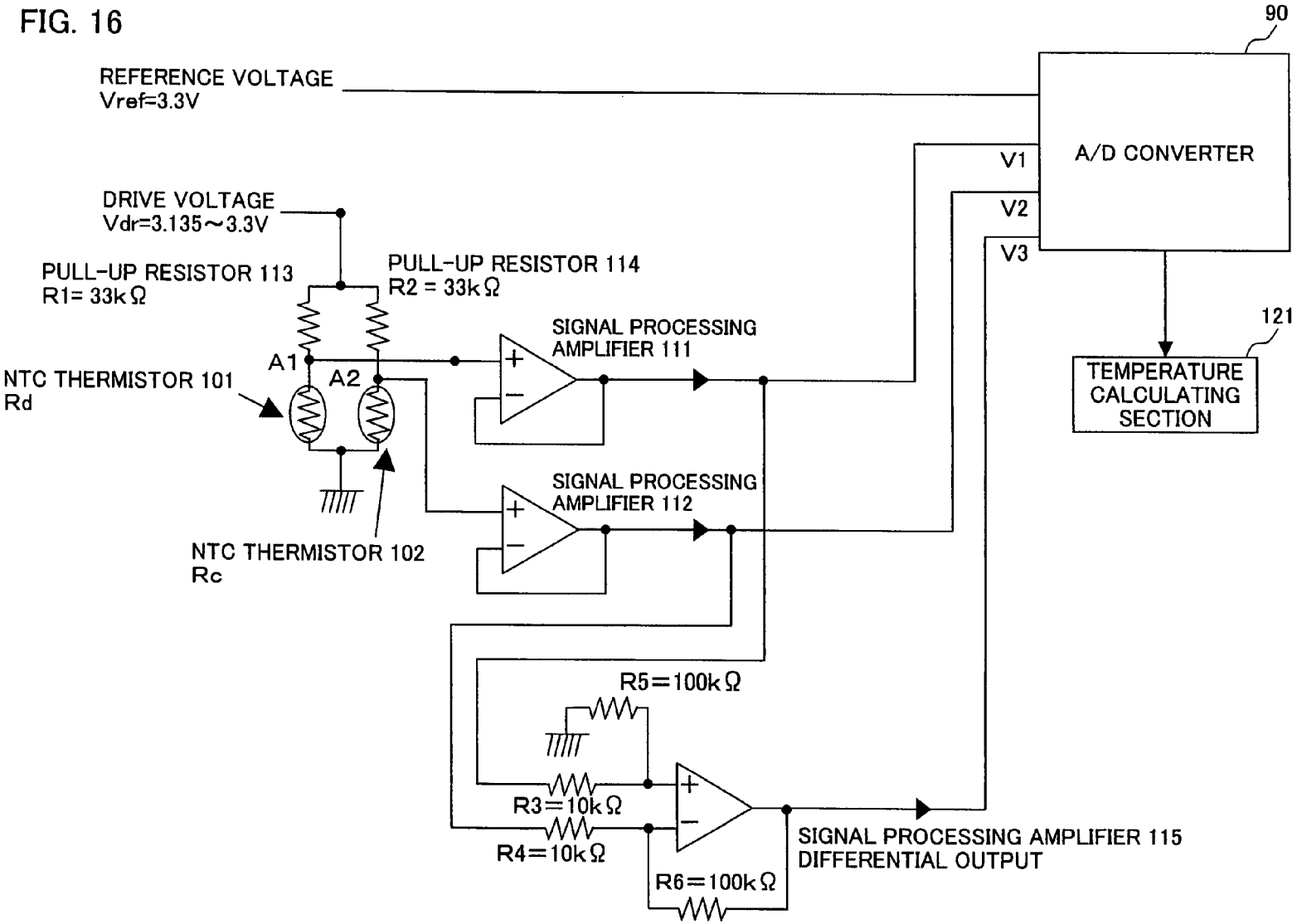
FIG. 16 is a circuit diagram showing that respective parts of the temperature detecting section are connected to the A/D converter.

Moreover, in addition to the signal processing circuit shown in FIG. 15, as shown in FIG. 16, the output terminals of the signal processing amplifiers 111 and 112 may be connected to respective input terminals of a differential output signal processing amplifier 115, and an output terminal of the signal processing amplifier 115 may be connected to the A/D converter 90. With this, the output values of the NTC thermistors 101 and 102 are input to the signal processing amplifier 115, and the surface temperature of the fixing roller 61 can be detected by using (i) a difference voltage V3 (=Vc−Vd, which is generally called a "differential voltage" and is called a "differential output of the temperature detecting section" here), and (ii) the output value V2 of the NTC thermistor 102.

With this signal processing amplifier 115, it is possible to increase an output gain with respect to an input, and also possible to grasp small changes in a voltage. The gain of the signal processing amplifier 115 can be set arbitrarily, but in many cases, it is set to 5 times to 10 times. If the gain is too low, it is impossible to increase the voltage resolution. Meanwhile, if the gain is too high, it exceeds an output range of the differential amplifier, and it is impossible to grasp the changes in voltage accurately. In the present embodiment, the gain of the signal processing amplifier 115 is set to 5 times.

Moreover, it is preferable that a control cycle of the heat control section 123 which control ON/OFF of the heater lamps 64*a* and 64*b* be a cycle that is 0.25 times or less a response speed of each of the temperature detecting sections 66*a* and 66*b*. In the present embodiment, a response speed T2 of each of the temperature detecting sections 66*a* and 66*b* including the NTC thermistors 101 and 102, the case 103, the heat-resistant film 104, etc. is 2 seconds. Meanwhile, the control cycle of the heat control section 123 is 500 ms. Note that this "500 ms" is the control cycle necessary for controlling both the heater lamps 64*a* and 64*b*.

The response speed T2 of each of the temperature detecting section 66*a* and 66*b* is a value measured in the same manner as a conventional contact-type thermistor. The temperature detecting section 66*a* and 66*b* outputs voltages corresponding to the surface temperature of the fixing roller 61 or the temperature of the temperature detecting section 66 itself (the case 103) at a cycle shorter than the response speed T2. Therefore, by carrying out the heat control of the heater lamps 64*a* and 64*b* at a cycle shorter than the response speed T2, specifically at a cycle that is 0.25 times the response speed T2, it is possible to realize the temperature control which quickly follows the changes in the surface temperature of the fixing roller 61.

Note that in the case of controlling a plurality of heater lamps, it is necessary to carry out the temperature control of each heater lamp more quickly. This is because troubles occur if the entire control cycle is made longer. Therefore, on the basis of this, it is preferable to adjust the control cycle of each heater lamp. For example, in the case of controlling three heater lamps, it is preferable to use (i) 150 ms for one heater lamp, that is, 450 ms for three heater lamps, (ii) 100 ms for one heater lamp, that is, 300 ms for three heater lamps, etc.

Note that the reference voltage Vref, the drive voltage Vdr, the resistance value of the pull-up resistor, etc. are not limited to the above values, and various values can be used depending on the characteristics of the NTC thermistor that is a detecting element, the quantization resolution of the A/D converter, the gain and characteristics of the signal processing amplifier, etc. Moreover, the pull-up resistor 113 connected to the NTC thermistor 101 and the pull-up resistor 114 connected to the NTC thermistor 102 do not have to have the same resistance value, but may have different resistance values.

Moreover, in addition to the configurations of the fixing roller 61 and the pressure belt 110 described in Examples, various configurations can be used. For example, the fixing roller 61 may be in the shape of a belt, and the pressure belt 110 may be in the shape of a roller. Moreover, instead of the heater lamp, it is possible to use, as heating means, (i) a direct heating method in which the inner surface of a roller or the surface of a roller generates heat or (ii) an induction heating method by electromagnetic induction. Especially in the induction heating method, the generated heat on the surface of a roller may become uneven depending on the configuration of a coil provided inside or outside the roller. In such a case, the temperature detection by the point contact measures only a portion where the temperature is high or only a portion where the temperature is low, and this affects the temperature control. However, since the temperature detecting section 66 detects the average temperature of a predetermined region, it can reduce such affection and is advantageous.

Finally, based on Examples below, the following proves that the temperature control device included in the fixing device 36 of the present embodiment can carry out the temperature detection accurately and can carry out the temperature control accurately.

In Example 2, whether the temperature control can be precisely carried out was tested under conditions that (i) the reference voltage Vref input to the A/D converter 90 is 5.0 V and (ii) the drive voltage Vdr of each of the NTC thermistors 101 and 102 is 4.75V, 4.9V, 4.95V, 5.0V, 5.05V, 5.1V or 5.25V.

Moreover, in Example 3, whether the temperature control can be precisely carried out was tested under conditions that (i) the reference voltage Vref input to the A/D converter 90 is 3.3 V and (ii) the drive voltage Vdr of each of the NTC thermistors 101 and 102 is 3.135V, 3.234V, 3.267V, 3.3V, 3.333V, 3.366V or 3.465V.

Results of Examples 2 and 3 are shown in FIG. 17. In the table of FIG. 17, "○" means that the increase in the ripple and the temperature drift do not occur and the controllability is satisfactory, "Δ" means that the increase in the ripple and the temperature drift hardly occurs but the controllability is slightly unstable, and "x" means that the increase in the ripple and the temperature drift occur and the controllability tends to deteriorate as time advances.

As shown in FIG. 17, Examples 2 and 3 showed that the temperature control could be carried out accurately when the drive voltage Vdr of the NTC thermistors 101 and 102 is from 95% to 100% of the reference voltage Vref input to the A/D converter 90.

Next, in Example 4, whether the temperature control can be precisely carried out was tested by using the pull-up resistors each of whose tolerance between the actual resistance value and the nominal value is from −2% to +2%. Specifically, used are the pull-up resistors each of whose nominal value is 33 kΩ and whose actual resistance value is 32.34 kΩ, 32.67 kΩ, 33 kΩ, 33.33 kΩ or 33.66 kΩ.

Results are shown in FIG. 18. In the table of FIG. 18, "○" means that the increase in the ripple and the temperature drift do not occur and the controllability is satisfactory, "Δ" means that the increase in the ripple and the temperature drift hardly occurs but the controllability is slightly unstable, and "x" means that the increase in the ripple and the temperature drift occur and the controllability tends to deteriorate as time advances.

As shown in FIG. 18, Example 4 showed that the temperature control could be carried out accurately when the tolerance of the resistance value of the pull-up resistor is within ±1% of the nominal value.

Next, in Example 5, whether the temperature control can be precisely carried out was tested under conditions that the quantization resolution of the A/D converter 90 is 8 bits, 10 bits, 12 bits, 14 bits or 16 bits. These tests are carried out under conditions that the reference voltage of 3.3V is input to the A/D converter 90 and the reference voltage of 5V is input to the A/D converter 90.

Results are shown in FIG. 19. In the table of FIG. 19, "○" means that the increase in the ripple and the temperature drift do not occur and the controllability is satisfactory, "Δ" means that the increase in the ripple and the temperature drift hardly occurs but the controllability is slightly unstable, and "x" means that the increase in the ripple and the temperature drift occur and the controllability tends to deteriorate as time advances.

As shown in FIG. 19, Example 5 showed that the temperature control could be carried out accurately when the quantization resolution is from 10 bits to 16 bits.

Next, in Example 6, whether the temperature control can be precisely carried out was tested by using the signal processing amplifiers 111 and 112 having different input-offset voltages. Specifically, the input-offset voltage was 0.1 mV, 0.5 mV, 1 mV, 2 mV or 5 mV.

Results are shown in FIG. 20. In the table of FIG. 20, "○" means that the increase in the ripple and the temperature drift do not occur and the controllability is satisfactory, "Δ" means that the increase in the ripple and the temperature drift hardly occurs but the controllability is slightly unstable, and "x" means that the increase in the ripple and the temperature drift occur and the controllability tends to deteriorate as time advances.

As shown in FIG. 20, Example 6 showed that the temperature control could be carried out accurately when the input-offset voltage of each of the signal processing amplifiers 111 and 112 is 1 mV or less.

Embodiment 3

The following will explain the fixing device using the temperature control device of yet another embodiment. Explanations for members having the same functions as those explained in Embodiments 1 and 2 are omitted.

Figure 21:
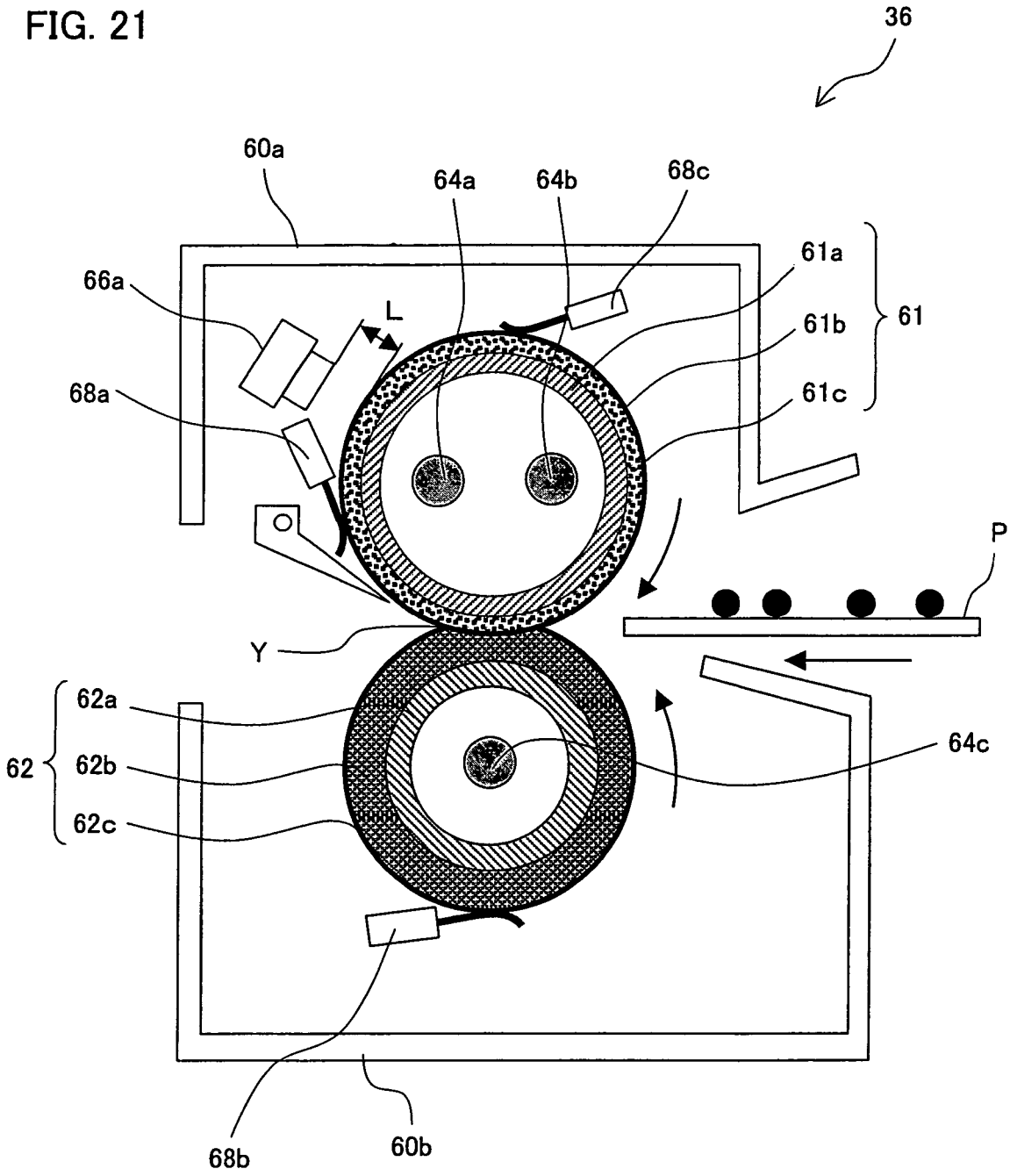
FIG. 21 is a cross-sectional view for explaining a partial configuration of the fixing device including the temperature control device.

FIG. 21 is a diagram showing the configuration of the fixing device 36 of the present embodiment. In the fixing device 36 of the present embodiment, the fixing roller 61 includes therein two heater lamps 64*a* and 64*b*, and the pressure roller 62 includes therein one heater lamp 64*c*. In the fixing roller 61, the heater lamp 64*a* carried out heating convexly and the heater lamp 64*b* carries out heating concavely, so that the heater lamp 64*a* mainly heats the center portion of the fixing roller 61 whereas the heater lamp 64*b* mainly heats both edge portions of the fixing roller 61. Thus, the entire surface of the fixing roller 61 is heated. Meanwhile, the heater lamp 64*c* heats the pressure roller 62 entirely.

In the present embodiment, the rated power of the heater lamp 64*a* is 480 W/100V, the rated power of the heater lamp 64*b* is 510 W/100V, and the rated power of the heater lamp 64*c* is 300 W/100V.

The basic configuration for detecting the temperature is the same as those in Embodiments 1 and 2. However, (i) the noncontact-type temperature detecting section 66*a* is used to carry out the temperature detection of the center portion of the fixing roller 61 which portion is heated by the heater lamp 64*a*, (ii) as is conventionally done, the contact-type thermistor 68*a* is used to carry out the temperature detection of both edge portions of the fixing roller 61 which portions are heated by the heater lamp 64*b*, and (iii) as is conventionally done, the contact-type thermistor 68*b* is used to carry out the temperature detection of the pressure roller 62 heated by the heater lamp 64*c*.

Since the contact-type thermistors 68*a* and 68*b* contacts respective rollers, they damage respective surfaces of the rollers to some extent. However, by providing the contact-type thermistors 68*a* and 68*b* at outside (i) an image region of a sheet or (ii) a region through which the sheet passes, it is possible to reduce the damages on the surfaces of the rollers.

The temperature detecting section 66*a* is used for the temperature control carried out by supplying electric power or by not supplying electric power to the heater lamp 64*a* which heats the center portion of the fixing roller 61, the contact-type thermistor 68*a* is used for the temperature control carried out by supplying electric power or by not supplying electric power to the heater lamp 64*b* which heats both edge portions of the fixing roller 61, and the contact-type thermistor 68*b* is used for the temperature control carried out by supplying power or by not supplying power to the heater lamp 64*c* which heats the pressure roller 62 entirely.

Moreover, the conventional contact-type thermistor 68*c* may be provided so as to contact a portion of the surface of the fixing roller 61 which portion does not contact a maximum-size sheet when the sheet passes through the fixing roller 61. This contact-type thermistor 68*c* may detect (i) the abnormal temperature rising at this portion when troubles of the heat control section 123 occur and (ii) the abnormal temperature rising at a portion of the fixing roller 61 which portion does not contact a small size sheet when the small size sheet passes through the fixing roller 61. The fixing device 36 of the present embodiment includes this contact-type thermistor 68*c*. When the temperature detected by the contact-type thermistor 68*c* exceeds a predetermined threshold value (which is for example, 235° C. while sheets are passing and 245° C. while sheets are not passing), the heat control section 123 executes the cooling mode which instructs to cool respective parts to protect the fixing roller 61 and its peripheral members from excess heat.

The fixing roller 61 is in the shape of a cylinder having an external diameter of 40 mm and a length of 326 mm, and the core bar 61*a* is made of STKM having an external diameter of 35 mm and a thickness of 1 mm. Moreover, the surface of the core bar 61*a* is covered with the heat-resistant elastic body layer 61*c* made of silicon rubber having a thickness of 2.5 mm, so that the surface of the fixing roller 61 has elasticity. Further, the release layer 61*b* that is a PFA tube is formed on the surface of the heat-resistant elastic body layer 61*c*. Both edge portions of the core bar 61*a* are subjected to a reducing treatment so as to have an external diameter of 30 mm, a ball bearing (not shown) and a drive gear (not shown) are attached, and the fixing roller 61 is held by a frame.

Meanwhile, the pressure roller 62 which contacts and is rotated by the fixing roller 61 is in the shape of a cylinder having an external diameter of 40 mm and a length of 326 mm, the core bar 62*a* is made of STKM having an external diameter of 30 mm and a thickness of 1 mm. Moreover, the surface of the core bar 62*a* is covered with the heat-resistant elastic body layer 62*b* made of silicon rubber having a thickness of 5 mm, so that the surface of the pressure roller 62 has elasticity. Further, the release layer 62*c* that is a PFA tube is formed on the surface of the heat-resistant elastic body layer 62*b*. Both edge portions of the core bar 62*a* are subjected to the reducing treatment so as to have an external diameter of 19 mm, a ball bearing (not shown) is attached, and the pressure roller 62 is held by the frame via a pressure lever.

The sheet P that is the print medium passes through the fixation nip portion Y that is a portion where the fixing roller 61 and the pressure roller 62 contact each other. The sheet P is heated and pressed by the fixing roller 61 and the pressure roller 62, so that the unfixed toner on the sheet is melted and fixed on the sheet.

When obtaining the surface temperature of the center portion of the fixing roller 61 on the basis of the temperature detecting section 66*a*, the temperature calculating section 121 uses the temperature correspondence table 124 and the first correction value data which are the same as those in Embodiment 1. That is, in the temperature correspondence table 124 of the present embodiment, similarly, the interval between adjacent values of the temperatures of the NTC thermistor 101 which temperatures correspond to respective output voltage values is 1° C., and the interval between adjacent values of the temperatures of the NTC thermistor 102 which temperatures correspond to respective output voltage values is 0.2° C. The temperature calculating section 121 refers to the temperature correspondence table 124, obtains the surface temperature of the center portion of the fixing roller 61 on the basis of the output voltage values from the NTC thermistors 101 and 102, and corrects the obtained surface temperature by using the first correction value data. Then, as with Embodiment 1, information of the surface temperature of the fixing roller 61 obtained eventually is input to the heat control section 123.

In the present embodiment, in addition to the information of the surface temperature of the center portion of the fixing roller 61 obtained by the temperature calculating section 121, the heat control section 123 receives information of the surface temperatures of respective portions of the fixing roller 61 and pressure roller 62 which temperatures are obtained by the noncontact-type thermistors 68*a*, 68*b* and 68*c*. Then, on the basis of the temperature detected by the temperature detecting section 66*a*, the heat control section 123 switches, by, for example, the switching element, between electric power supplying and no electric power supplying to the heater lamp 64*a* so that the surface temperature of the center portion of the fixing roller 61 becomes the target temperature TS1 (for example, 170° C.).

Meanwhile, on the basis of the surface temperature of the edge portion of the fixing roller 61 detected by the contact-type thermistor 68*a*, the heat control section 123 switches between electric power supplying and no electric power supplying to the heater lamp 64*b* so that the surface temperature of the edge portion of the fixing roller 61 becomes the target temperature TS3 (for example, 140° C.). Further, on the basis of the surface temperature of the pressure roller 62 detected by the contact-type thermistor 68*b*, the heat control section 123 switches between electric power supplying and no electric power supplying to the heater lamp 64*c* so that the surface temperature of the pressure roller 62 becomes the target temperature TS2 (for example, 170° C.). As a matter of course, respective portions may be controlled by different heat control sections.

Here, using the configuration of the fixing device of Embodiment 1 (that is, the configuration of obtaining the surface temperature of the fixing roller 61 by using only the temperature correspondence table 124 and the first correction value data), 500 A4-size sheets (a width of 297 mm and a length of 210 mm) are successively subjected to a fixing treatment at a printing speed of 27 sheets per minute under conditions of TS1=170° C., TS2=170° C. and TS3=140° C. Here, at the beginning of this printing processing, the surface temperature of the center portion of the fixing roller 61 becomes temporarily but significantly lower than the target temperature TS1. Then, this surface temperature recovers, becomes stable, and become almost the target temperature TS1 (not shown). This has been confirmed since a surface temperature TM1 of the center portion of the fixing roller 61 obtained by the temperature detecting section 66*a* became substantially the same as an actual surface temperature TM4 obtained by measuring the same point by a different temperature detecting means that is unrelated to the temperature control device 80 of the present embodiment. Moreover, it became clear that a surface temperature TM3 of the edge portion of the fixing roller 61 was controlled to be almost the target temperature TS3, and a surface temperature TM2 of the pressure roller 62 was also controlled to be almost the target temperature TS2.

Moreover, A5R-size sheets (a width of 210 mm and a length of 148.5 mm) are subjected to a fixing treatment at a printing speed of 19 sheets per minute under conditions of the same target temperatures as above. In this case, as the printing of the A5R-size sheets proceeds, deviation occurs between the surface temperature TM1 and the actual temperature TM4 which should be the same as each other (not shown). The narrower the width of the sheet is or the higher the printing speed is, the more the deviation increases. When carrying out printing onto the sheet having a narrow width, the surface temperature TM1 becomes higher than the actual temperature TM4 in many cases. Moreover, it became clear that the larger the number of printed sheets was, the more the deviation further increased.

This phenomenon occurs due to reasons below. When the heater lamp 64*a* heats the center portion of the fixing roller 61, (i) a region through which the A5R-size sheet passes and (ii) a heated region of the center portion of the fixing roller 61 which region is heated by the heater lamp 64*a* are different in size from each other. Here, when the heated region is larger in size than the region through which the A5R-size sheet passes, the heat of a no sheet passing region (a region through which a sheet does not pass) of the heated region is not drawn by the sheet, so that the no sheet passing region continues to keep the heat and becomes locally high in temperature. Therefore, a large amount of infrared radiation is incident on the NTC thermistor 101 through the opening 103*a* of the temperature detecting section 66*a* from the no sheet passing portion whose temperature is locally high.

The temperature control device 80 is originally desired to control the surface temperature of the sheet passing region of the fixing roller 61 so that the surface temperature becomes the target temperature. However, because of the infrared radiation from the no sheet passing region, the temperature detecting section 66*a* and the temperature calculating section 121 recognize the temperature of the sheet passing region as a value higher than the actual temperature. As a result, although the surface temperature of the sheet passing region of the fixing roller 61 has not reached the target temperature TS1, the heat control section 123 judges that it has reached the target temperature TS1, and operates to stop the heating of the heater lamp 64*a*. With this, the surface temperature of the sheet passing region of the fixing roller 61 is controlled to be a temperature lower than the target temperature.

This phenomenon causes troubles such as a fixation trouble. Especially, the toner which is sensitive to the temperature change contaminates the fixing roller 61, the pressure roller 62, etc., and this contamination shortens the life of each roller.

Figure 22:
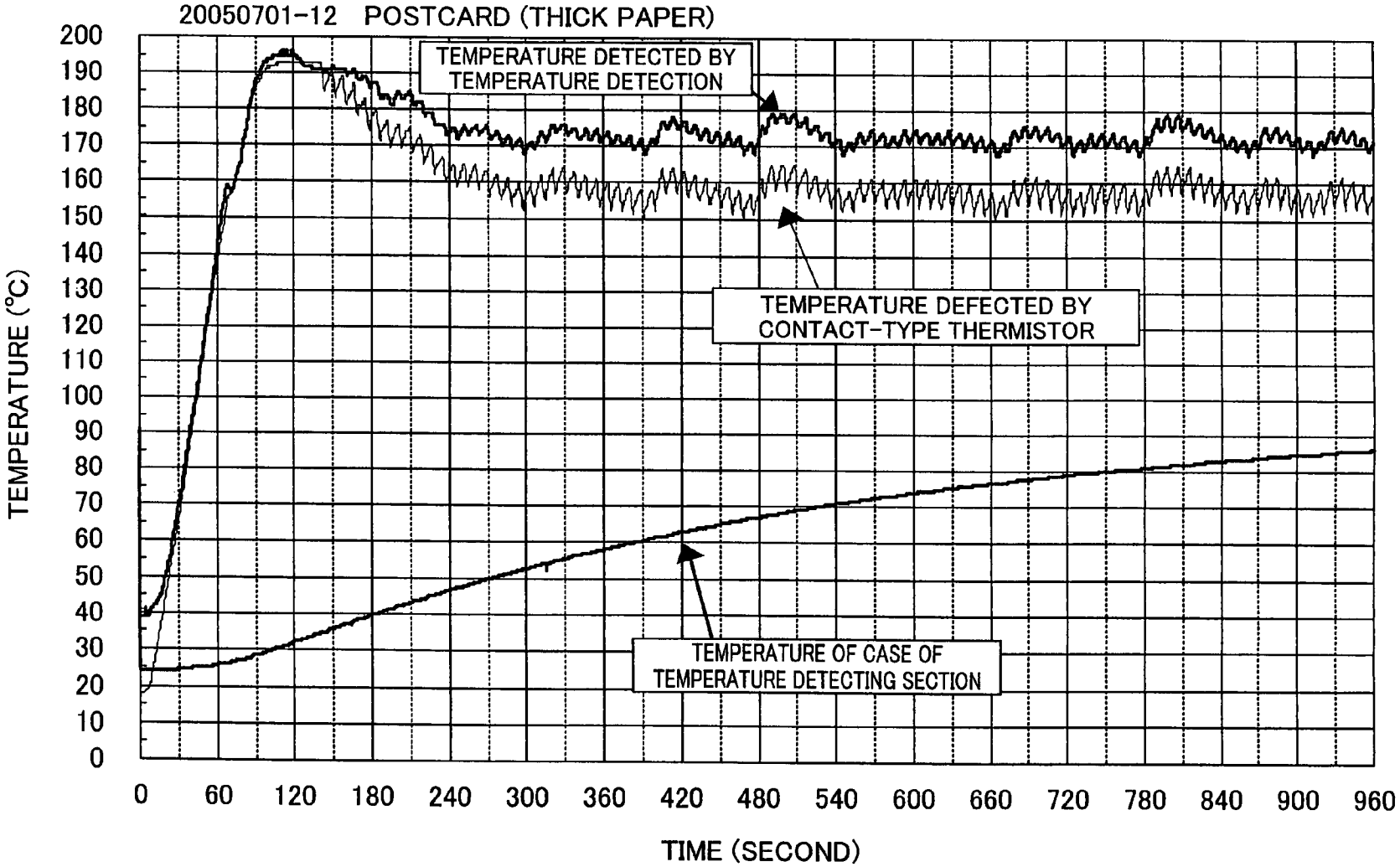
FIG. 22 is a diagram showing results of Comparative Example corresponding to Example 7.

This is true when carrying out printing onto postcards. For example, FIG. 22 shows (i) the surface temperature of the fixing roller 61 obtained by the noncontact-type temperature detecting section 66*a* and the temperature calculating section 121 and (ii) the actual surface temperature of the fixing roller 61 measured by the contact-type thermistor, when the postcards (a width of 100 mm and a length of 148 mm) are printed at a printing speed of 7 postcards per minute (7 CPM) (Comparative Example 2). Note that the temperature detecting section 66*a* and the noncontact-type thermistor are provided at positions which are the same in the circumferential direction of the fixing roller but are slightly different in the axial direction.

As shown in FIG. 22, the surface temperature of the fixing roller 66*a* detected by the temperature detecting section 66*a* is higher than the actual surface temperature of the fixing roller 66*a* measured by the contact-type thermistor. For example, at the time that 100 sheets have passed, the actual surface temperature is 158° C. which is low, and the error is about 18° C.

Reasons for this are as follows. Since (i) the width of the postcard is 100 mm and (ii) the width of a heat generating portion that is a convex portion of the heater lamp 64*a* which mainly heats the center region of the fixing roller 61, that is, the width of the heated region is about 150 mm, both edge regions (about 25 mm) of the heated region are the no sheet passing regions. The heat of these edge portions (about 25 mm) is not drawn by the sheet, so that these edge portions continue to keep heat, and become locally high in temperature. Therefore, a large amount of infrared radiation is incident on the NTC thermistor 101 through the opening 103*a* of the temperature detecting section 66*a* from the no sheet passing portions whose temperatures are locally high.

Although it depends on the degree of the temperature rising of the portion which is locally high in temperature, a positional relationship between this portion and the temperature detecting section 66*a*, etc., the detected temperature of the surface of the fixing roller is higher than the actual temperature due to the infrared radiation that is a disturbance.

Here, in the present embodiment, the temperature calculating section 121 applies a correction value, corresponding to various conditions, to the surface temperature of the fixing roller 61 obtained by using the temperature correspondence table 124 and the first correction value data 125. Examples of the correction value corresponding to various conditions are a correction value for each environmental condition (room temperature or humidity), a correction value for each number of printed sheets (the number of printed sheets, the number of printed surfaces), a correction value for each size of a printed sheet, a correction value for each length of a printed sheet in a width direction, a correction value for each type of a sheet (postcard, regular paper, heavy paper, etc.), a correction value for each rotation speed of the fixing roller, a correction value for each target temperature of the heated object, a correction value for each print condition (two-side printing, one-side printing), etc. Data of these correction values are stored in the memory section 122, and the temperature calculating section 121 selects data of the correction value corresponding to various conditions, and applies the data to the surface temperature of the fixing roller 61.

Note that the correction value may be applied directly to the temperature obtained by referring to the temperature correspondence table 124.

For example, in the case of using sheets having a size which easily causes local temperature rising described above, (i) the degree of the temperature rising is estimated on the basis of various print conditions and environmental conditions, and (ii) on the basis of results of this estimation, the correction value is applied to the surface temperature obtained by referring to the temperature correspondence table 124 and the first correction value data. Moreover, depending on the size of the sheet, the correction value with respect to the temperature of the temperature detecting section 66*a* itself (the case 103) is further applied.

For example, when carrying out printing onto postcards at normal temperature and normal humidity, a table of FIG. 23(*a*) showing correction values corresponding to the numbers of sheets is used. Then, depending on the number of printed sheets, the correction value shown in FIG. 23(*a*) is applied. Further, the correction value with respect to the temperature of the temperature detecting section 66*a* itself is applied in accordance with FIG. 24.

For example, when the temperature of the temperature detecting section 66*a* itself is 99.8° C. at the time that 20 postcards have passed and become 100.1° C. at the time that postcards have passed, the correction value corresponding to the number of printed sheets changes from "−8° C." to "−10° C.". Meanwhile, as shown in FIG. 24, the correction value by the temperature of the temperature detecting section 66*a* itself remains at "±0° C.". Therefore, the correction value from $21^{st}$ sheet to $50^{th}$ sheet is "−8° C." in total, and the correction value for $51^{st}$ sheet becomes "−10° C." in total.

Then, the temperature calculating section 121 further applies this total correction value to the surface temperature of the fixing roller 61 obtained by referring to the temperature correspondence table 124 and the first correction value data.

As above, by carrying out the correction by associating the temperature of the temperature detecting section 66*a* itself with the number of printed sheets, it is possible to precisely carry out the temperature control of the fixing roller 61.

Based on Example 7 below, the following proves that the temperature control device 80 of the present embodiment can carry out the temperature detection accurately and can carry out the temperature control accurately.

In Example 7, tested was whether the temperature control can be precisely carried out when carrying out printing onto postcards successively by using the tables of FIGS. 23(*a*) and 24. Note that Example 7 corresponds to Comparative Example 2 described above, and conditions thereof are the same as those of Comparative Example 2 unless otherwise stated. Results are shown in FIG. 25.

Figure 25:
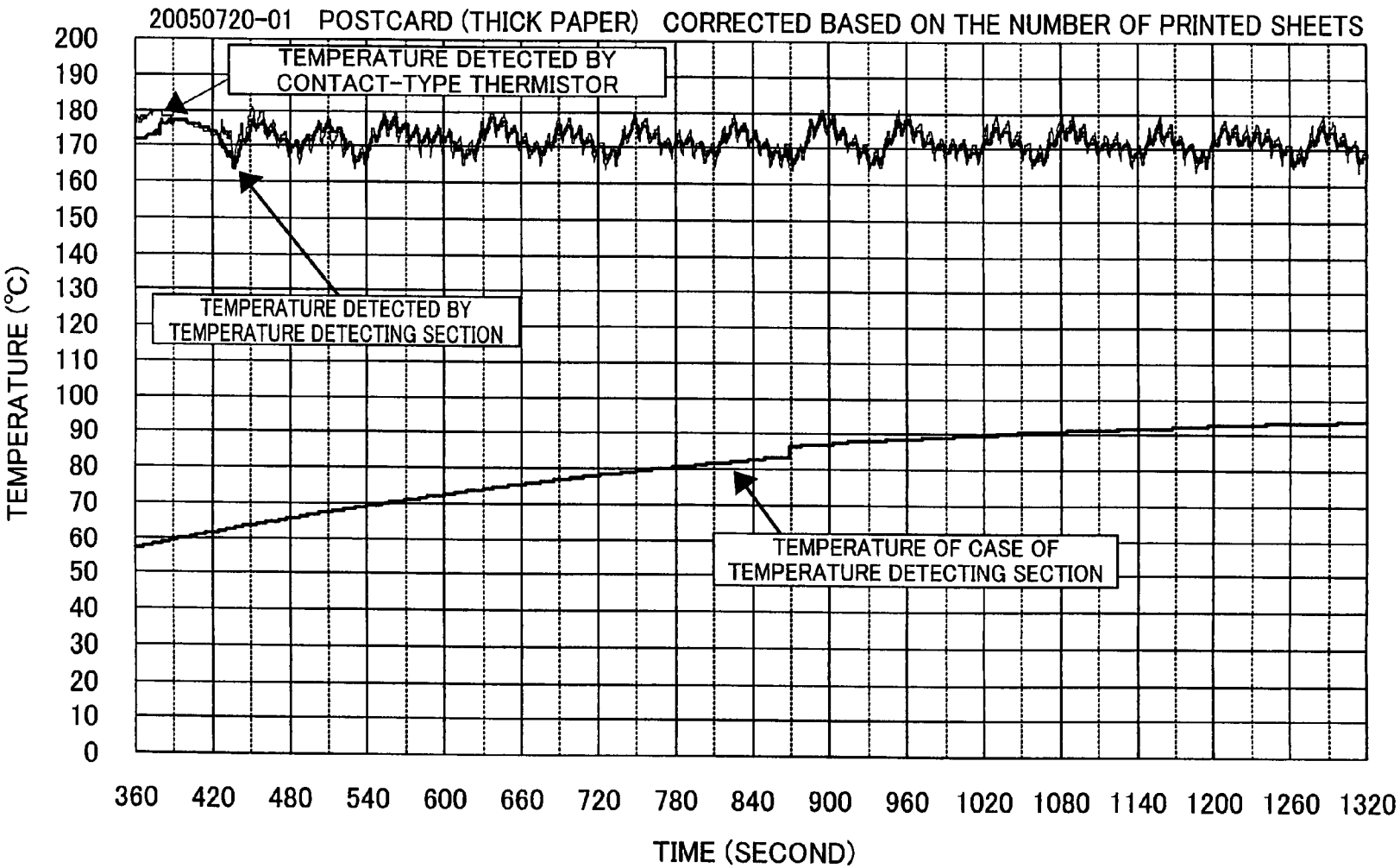
FIG. 25 is a diagram showing results of Example 7.

As shown in FIG. 25, in the temperature control device of Example 7, the surface temperatures of the fixing roller detected by the temperature detecting section are substantially the same as the actual surface temperatures measured by the contact-type thermistor. This proves that even when the postcards are successively printed by the configuration of the present embodiment, it is possible to carry out the temperature control accurately without the temperature drift or ripple.

The following will further describe the temperature control device 80 of the present embodiment.

Data of the correction values corresponding to the numbers of sheets of each size may be switched depending on the environmental condition. For example, the table shown in FIG. 23(*a*) is used at normal temperature and normal humidity, the table shown in FIG. 23(*b*) is used at low temperature and low humidity (L/L environment), and (iii) the table shown in FIG. 23(*c*) is used at high temperature and high humidity (H/H environment). Thus, it is possible to apply an appropriate correction value corresponding to the environmental condition.

Moreover, when carrying out printing onto a sheet (a width of 139.7 mm and a length of 215.9 mm, hereinafter referred to as "invoice R") having a half size, as another sheet size, of a letter by a longitudinal feed, respective correction values shown in the tables of FIGS. 26(*a*) and 26(*b*) are used.

In this case, as shown in FIG. 26(*a*), as the number of printed sheets increases (10 sheets, 20 sheets, 50 sheets, 100 sheets and 150 sheets), the correction value corresponding to the number of printed sheets changes ("±0° C.", "−1° C.", "−3° C.", "−4° C." and "−4° C."). When the number of printed sheets is more than 150, the correction value is "−4° C.". Meanwhile, as shown in FIG. 26(*b*), the correction value corresponding to the temperature of the temperature detecting section 66*a* itself (the temperature of the case 103) changes in accordance with the changes in the temperature of the temperature detecting section 66*a* itself from lower than 90° C. to 130° C. or more at intervals of 5° C., such as "+0° C.", "−1° C.", "−2° C.", "−5° C.", "−5° C.", . . . , "−5° C.", and "−6° C.". Then, a final correction value obtained by summing up both correction values (that is, a sum of the correction value corresponding to the number of printed sheets and the correction value corresponding to the temperature of the temperature detecting section 66*a* itself) is applied to the surface temperature obtained by referring to the temperature correspondence table and the first correction value data.

Here, the temperature control device 80 itself does not have to acquire the size and type of the print medium, but it may be possible to use size information and type information of the print medium which information are stored in the control means of the image forming apparatus 100 that is a higher-level device. In this case, the temperature control device 80 may include an interface as an information acquiring section which acquires various information from the control means of the image forming apparatus 100.

Then, the temperature calculating section 121 carries out a conditional judgment on the basis of various information obtained by the information acquiring section, so as to select the appropriate correction value, and further applies this correction value to the surface temperature obtained by referring to the temperature correspondence table 124 and the first correction value data.

Note that the above embodiments showed the correction tables corresponding to A5R, the postcard size, etc. However, even if the sheet size is unique, the correction values in these correction tables are not unique. It is preferable to adjust the correction values depending on various conditions such as the configuration of the fixing device, the configuration of the rollers used, the spec of the heater lamp, the supply power at the time of control, the control method, etc.

Here, different correction values are used depending on the size of the sheet (a sheet usually used is a standardized size such as A4 or B5, and has a specific width and length), the thickness of a sheet, the type of a sheet such as an envelope, a postcard, etc. However, as a particular case, the printing may be carried out onto a sheet having a nonstandardized size. In this case, since the correction table corresponding to this sheet size is not prepared, it is difficult to apply an appropriate correction value.

However, as a result of various studies, it became clear that not the size of the sheet but the length of the sheet in the width direction (the axial direction of the fixing roller) significantly affects the detection result of the temperature detecting section 66*a*. Therefore, the correction tables may be prepared for respective lengths of the sheet in the width direction, not respective sheet sizes, and the correction value may be applied depending on the length of the sheet in the width direction. In this case, for example, for respective lengths of the sheet in the width direction at intervals of 1 mm, 2 mm, or 5 mm, the correction values corresponding to the numbers of printed sheets and the correction values corresponding to the temperatures of the temperature detecting section 66*a* itself may be prepared.

With this, even when carrying out printing onto a sheet having a nonstandardized sheet size, it is possible to carry out the temperature detection and the temperature control accurately, and also possible to carry out high-quality image formation without fixation troubles.

Further, it is preferable that (i) the temperature control device 80 further include a width detecting section which, on the basis of the position of a member which guides the sheets stored in a sheet tray of the image forming apparatus 100, detects the length of a sheet in the width direction which sheet is conveyed to the fixing roller 61, and (ii) the correction value to be applied is switched by the temperature calculating section 121 depending on the length of the sheet in the width direction which length is detected by the width detecting section. Moreover, instead of this, a user may manually input to the image forming apparatus 100 information regarding the length of the sheet in the width direction, and the correction value to be applied may be switched by the temperature calculating section 121 on the basis of the input information regarding the length of the sheet in the width direction.

The following will explain a modification example of the temperature control device.

Other than the above disturbances, there are disturbances caused by the temperature changes in the target temperatures TS1, TS2 and TS3 of respective portions of the fixing roller 61 and the pressure roller 62. Therefore, when the target value of the surface temperature of the fixing roller 61 or the pressure roller 62 changes, it is preferable to carry out correction in accordance with this change. Specifically, it is preferable that (i) the surface temperature be corrected by accordingly applying the correction value in accordance with at least one of the target temperatures TS1, TS2 and TS3 of the fixing roller 61 and the pressure roller 62, and (ii) the heating control of the heater lamps 64*a*, 64*b* and 64*c* be carried out on the basis of the corrected surface temperature. With this, it is possible to suppress a phenomenon that the temperature control is adversely affected by the disturbance caused due to the changes in the target temperatures of respective portions.

As shown in FIGS. 27(*a*) and 27(*b*), for example, when the target temperature TS1 of the center portion of the fixing roller 61 changes depending on the number of printed sheets while carrying out printing onto the A4-size sheets, the degree of affection due to the disturbance such as the distribution of the surface temperature of the fixing roller 61 changes as the target temperature changes, and the correction value applied originally cannot modify the error.

Here, the correction values corresponding to the changes in the target temperature are prepared in advance. Then, if there is a change in the target temperature TS1, the correction value shown in the table of FIG. 27(*c*) is applied. This correction value can be applied to the surface temperature obtained by referring to the temperature correspondence table 124 and the first correction value data 125.

Moreover, in addition to the correction value corresponding to the change in the target temperature TS1, the correction value corresponding to the change in the target temperature TS3 may also be applied. With this, it is also possible to avoid the affection of the disturbance caused due to the change in the distribution of the temperature of the edge portion of the fixing roller 61.

FIG. 28(*a*) is a table showing the correction values of the target temperature TS3 which values correspond to the numbers of printed sheets when carrying out printing onto the B4-size sheets. Moreover, FIG. 28(*b*) is a table showing the values of the target temperatures TS3 which values correspond to the numbers of printed sheets when carrying out printing onto the B4-size sheets. Further, FIG. 28(*c*) is a table showing the correction values corresponding to the target temperatures TS3.

Figure 29:
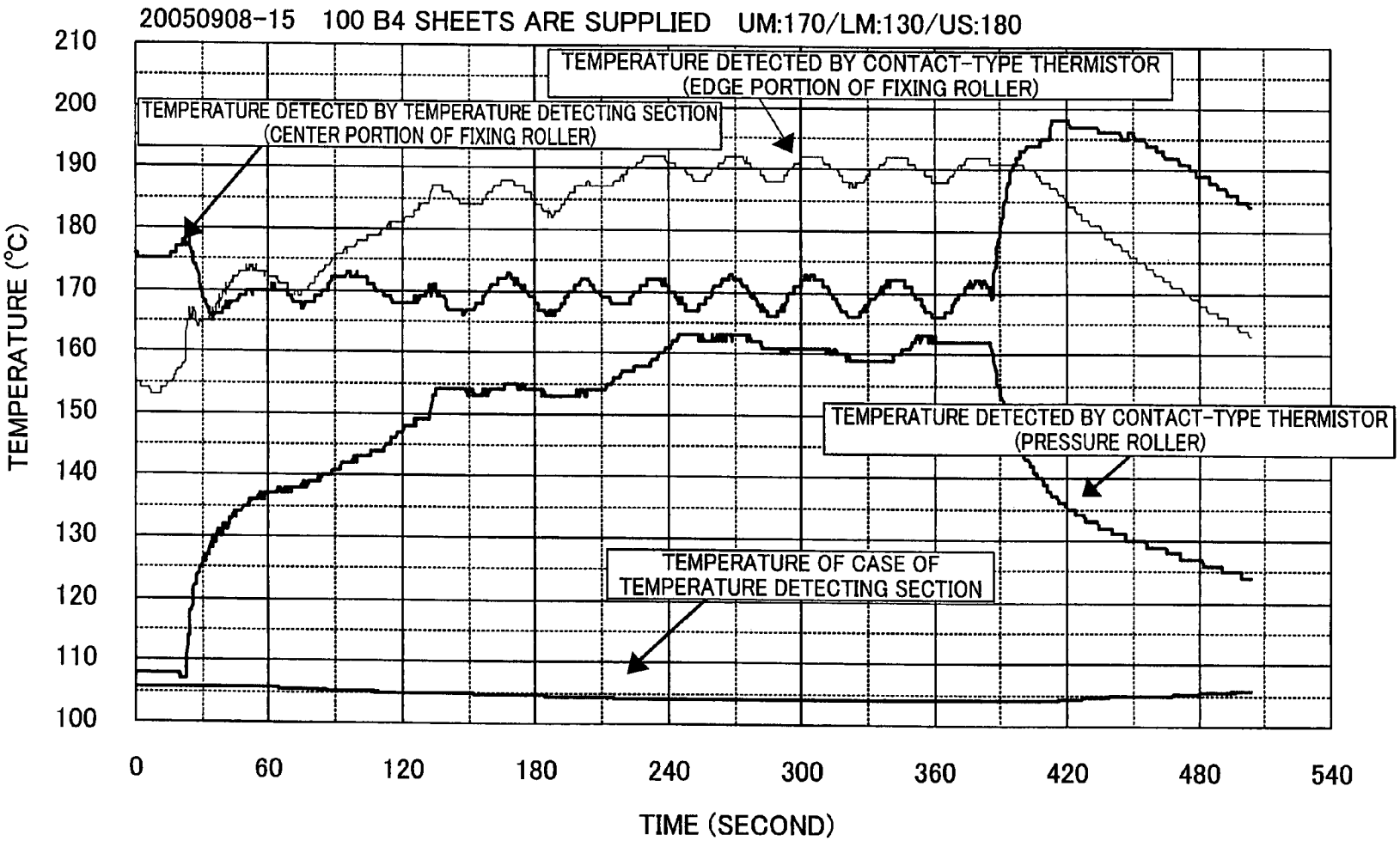
FIG. 29 is a diagram showing a result obtained by controlling the surface temperature of the fixing roller by using the correction values shown in FIG. 28(*c*).

The correction of the surface temperature obtained by referring to the temperature correspondence table 124 and the first correction value data was carried out by using the correction value shown in FIG. 28(*c*), and the heater lamps 64*a*, 64*b* and 64*c* are controlled on the basis of this corrected temperature. Results are shown in FIG. 29. This modification example showed that the appropriate temperature control was carried out as shown in FIG. 29.

Further, by changing the correction value depending on the change in the target temperature of the pressure roller, the difference between one-side printing and two-side printing, the difference between color modes, etc., it is possible to carry out an appropriate correction.

The following will explain another modification example of the temperature control device.

The disturbance may occur depending on the rotation/stop of the fixing roller 61 (the heated object) or the pressure roller 62, and the rotation speed (the process speed). In this case, it is possible to apply a predetermined correction value corresponding to the rotation or the stop. For example, it is possible to (i) apply the correction value "+3° C." when the rotation speed is 100 mm/sec or less, (ii) apply the correction value "+2° C." when the rotation speed is from 101 mm/sec to 200 mm/sec, (iii) apply the correction value "+2° C." when the rotation speed is from 201 mm/sec to 300 mm/sec, and (iv) not apply the correction value (or apply the correction value "0° C.") when the rotation speed is 301 mm/sec or more.

In this modification example, the correction value is "+2° C." when the fixing roller 61 and the pressure roller 62 are rotating at a certain speed. Moreover, the correction value when the speed is increasing from a stop state to a rotation state is also "+2° C.", and the correction value is "0° C." when the speed is decreasing (from the rotation state to the stop state).

Further, the correction value corresponding to the size of the print medium and the number of printed sheets, the correction value with respect to one or a plurality of the target temperatures, the correction value corresponding to the rotation or the stop, and the correction value corresponding to various print conditions such as one-side/two-sides and the type of the heated medium may be used alone or in combination.

As one example, the following will explain the correction value applied when carrying out printing onto the A5R sheets.

When carrying out printing onto A5R, the correction values corresponding to the numbers of printed surfaces are shown in FIG. 30(*a*). Moreover, the changes in the target temperatures TS1 to TS3 corresponding to the numbers of printed surfaces are shown in FIGS. 30(*b*) to 30(*d*). Then, the correction values corresponding to the target temperatures TS1 to TS3 are shown in FIGS. 30(*e*) to 30(*g*). The following will summarize these.

In a print standby state of waiting a print command, the target temperature TS1 of the center portion of the fixing roller 61 is set to 180° C., the target temperature TS3 of one edge portion (on a front side) of the fixing roller 61 is set to 160° C., and the target temperature TS2 of one edge portion (on a front side) of the pressure roller 62 is set to 105° C. In this print standby state, the temperature control is carried out so that the temperatures of respective portions of the fixing roller 61 and the pressure roller 62 become the target temperatures TS1, TS2 and TS3, respectively.

When carrying out white-and-black one-side printing onto the A5R sheets, each target temperature changes in accordance with the tables shown in FIGS. 30(*b*) to 30(*d*)

Standard temperature setting TS1: 170° C., TS2: 130° C., TS3: 180° C.

Up to 10 sheets TS1: 163° C., TS2: 120° C., TS3: 160° C.

Up to 20 sheets TS1: 170° C., TS2: 140° C., TS3: 160° C.

Up to 50 sheets TS1: 170° C., TS2: 150° C., TS3: 165° C.

51 sheets or more TS1: 170° C., TS2: 160° C., TS3: 165° C.

That is, at the beginning of the printing, the temperatures of the rollers are uneven, and temperature drop occurs due to the silicon rubber layer having low thermal conductivity. However, in order to suppress this temperature drop, the target temperature is set to be low at first, careless turning-off of the heater lamp is prevented, and temperature rising of respective rollers is induced. In order to prevent excess heating when the temperatures of the rollers increase, the target temperature is increased so that an appropriate heating is carried out.

Then, as shown in FIG. 30(*a*), the correction value (−2° C., −2° C., −3° C., −4° C. or −4° C.) corresponding to the number of printed A5R sheets changes as the number (10 sheets, 20 sheets, 50 sheets, 100 sheets or 150 sheets) of printed A5R sheets increases. When the number of printed A5R sheets is 151 or more, the correction value is "−4° C." without exception. Moreover, here, the temperature of the case 103 of the temperature detecting section 66 changes from 107° C. to 104.6° C. during printing. In this case, the correction value is always "0° C." as shown in FIG. 31.

Moreover, as described above, the target temperature changes as the number of printed sheets increases. Therefore, since the target temperature TS1 of the center portion of the fixing roller 61 up to 10 sheets is 163° C., the correction value is "+1° C." as shown in FIG. 30(*d*). Moreover, since the target temperature TS1 more than 10 sheets is 170° C., the correction value is "±0° C.". Meanwhile, since the target temperature TS3 of the edge portion of the fixing roller 61 up to 20 sheets is 160° C., the correction value is "±0° C." as shown in FIG. 30(*e*). Moreover, since the target temperature TS3 more than 21 sheets is 165° C., the correction value is "±0° C.". Similarly, as shown in FIG. 30(*f*), the target temperature TS2 ("±0° C.", "±0° C." or "±0° C.") of the pressure roller 62 changes as the number (10, 20 or 50) of printed sheets increases. Moreover, when the number of printed sheets is 51 or more, the target temperature TS2 is "−1° C."

Moreover, the correction value "+2° C." by the rotation of the roller is applied when changing from the print standby state to the print operation.

Therefore, the following correction value is applied to the surface temperature of the fixing roller 61 obtained from the temperature correspondence table 124 and the first correction value data 125.

1) Correction Values Corresponding to Numbers of Printed A5R Sheets

Up to 10 sheets: "−2° C."

Up to 20 sheets: "−2° C."

Up to 50 sheets: "−3° C."

Up to 100 sheets: "−4° C."

Up to 150 sheets: "−4° C."

151 sheets or more: "−4° C."

The correction value corresponding to the change in the temperature of the case of the temperature detecting section: "±0° C."

2) Correction Values Corresponding to Changes in Target Temperature TS1 of Center Portion of Fixing Roller 61

Up to 10 sheets: "+1° C."

11 sheets or more: "±0° C."

3) Correction Value Corresponding to Change in Target Temperature TS3 of Edge Portion of Fixing Roller 61

"±0° C." regardless of the number of printed sheets

4) Correction Values Corresponding to Changes in Target Temperature TS2 of Pressure Roller 62

Up to 50 sheets: "±0° C."

51 sheets or more: "−1° C."

5) Correction Value Corresponding to Rotation of Fixing Roller 61

"+2° C."

Therefore, the final correction value are as follows by summing up the above correction values.

Up to 10 sheets: (−2+0)+(+1)+0+0+(+2)=+1° C.

Up to 20 sheets: (−2+0)+0+0+0+(+2)=0° C.

Up to 50 sheets: (−3+0)+0+0+0+(+2)=−1° C.

Up to 100 sheets: (−4+0)+0+0+(−1)+(+2)=−3° C.

Up to 150 sheets: (−4+0)+0+0+(−1)+(+2)=−3° C.

151 sheets or more: (−4+0)+0+0+(−1)+(+2)=−3° C.

These are summarized in FIG. 32.

The final correction value is applied to the surface temperature of the fixing roller 61 obtained by the temperature calculating section 121 on the basis of the temperature correspondence table 124 and the first correction value data 125.

The following will explain yet another modification example of the temperature control device.

The memory section 122 may store correction value data for one-side printing and correction value data for two-side printing, and the temperature calculating section 121 may use different correction value data between when carrying out one-side printing and when carrying out two-side printing. For example, the following will explain a case where two-side printing is carried out with respect to the A4-size sheet. When carrying out one-side printing, the above correction values are applied. Note that in the present specification, when carrying out two-side printing with respect to one sheet, the number of printed sheets (surfaces) is 2.

In the case of using the A4-size sheet, it is not necessary to correct the temperature in accordance with the number of printed sheets. Therefore, there is no correction table corresponding to the number of printed sheets.

In the print standby state of waiting the print command, the target temperature TS1 of the temperature detecting section 66*a* used for the temperature control of the center portion of the fixing roller 61 is set to 180° C., the target temperature TS3 of the contact-type thermistor 68*a* used for the temperature control of one edge portion (on a front side) of the fixing roller 61 is set to 160° C., and the target temperature TS2 of the contact-type thermistor 68*b* used for the temperature control of one edge portion (on a front side) of the pressure roller 62 is set to 105° C. In the print standby state, the temperature control is carried out so that the respective portions have the target temperatures TS1, TS2 and TS3, respectively. Then, when two-side printing onto the A4-size sheets is started, the final target temperatures TS1, TS3 and TS2 are changed to 170° C., 160° C. and 100° C., respectively.

In this case, the target temperatures TS1 to TS3 change in accordance with the number of printed surfaces. FIGS. 33(*a*) to 33(*c*) are diagrams showing the changes in the target temperatures TS1 to TS3 which changes correspond to the numbers of printed surfaces. Moreover, FIGS. 33(*d*) to 33(*f*) are tables showing the correction values corresponding to the target temperatures TS1 to TS3, respectively. As shown in FIGS. 33(*a*) and 33(*d*), when carrying out printing onto the A4-size sheets, the target temperature TS1 of the center portion of the fixing roller 61 does not change, and is always set to a constant temperature "170° C.". Therefore, the correction value corresponding to the target temperature TS1 is always "0° C.".

Meanwhile, as shown in FIG. 33(*b*), the target temperature TS3 of the edge portion of the fixing roller 61 is 160° C. when the number of printed surfaces is up to 20 surfaces. In this case, the correction value is "±0° C." as shown in FIG. 33(*e*). Moreover, when the number of printed surfaces is 21 or more, the target temperature TS3 is 165° C. Therefore, the correction value in this case becomes "−1° C."

As shown in FIG. 33(*c*), the target temperature TS2 of the pressure roller 62 changes as the number (20, 40, 50 and 51) of printed surfaces increases. However, as shown in FIG. 33(*f*), the correction value is always "0° C.".

Further, when changing from the print standby state to the print operation, the correction value "+2° C." corresponding to the rotation of the fixing roller 61 is applied to the surface temperature obtained from a two-dimensional temperature conversion table and a one-dimensional compensation temperature correction table.

The following will summarize the correction values to be applied to the surface temperature obtained from the two-dimensional temperature conversion table and the one-dimensional compensation temperature correction table.

1) Correction Value Corresponding to Number of Printed Sheets (Surfaces) of A4 Subjected to Two-Side Printing None 2) Correction Value Corresponding to Change in Target Temperature TS1 of Center Portion of Fixing Roller 61

"0° C." regardless of the number of printed surfaces

3) Correction Values Corresponding to Changes in Target Temperature TS3 of Edge Portion of Fixing Roller 61

Up to 20 sheets: "0° C."

21 sheets or more: "−1° C."

4) Correction Value Corresponding to Change in Target Temperature TS2 of Pressure Roller 62

"0° C." regardless of the number of printed surfaces

5) Correction Value Corresponding to Rotation of Fixing Roller 61

"+2° C."

Note that the final correction values corresponding to the numbers of printed surfaces are as follows by summing up the above values.

From 0 surface to 20 surfaces: 0+0+0+0+(+2)=+2° C.

From 21 surfaces to 40 surfaces: 0+0+(−1)+0+(+2)=+1° C.

From 41 surfaces to 50 surfaces: 0+0+(−1)+0+(+2)=+1° C.

From 51 surfaces to 100 surfaces: 0+0+(−1)+0+(+2)=+1° C.

From 101 surfaces to 150 surfaces: 0+0+(−1)+0+(+2)=+1° C.

151 surfaces or more: 0+0+(−1)+0+(+2)=+1° C.

These are summarized in FIG. 34.

The final correction value is applied to the surface temperature of the fixing roller 61 obtained by the temperature calculating section 121 from the temperature correspondence table 124 and the first correction value data 125.

Similarly, when carrying out two-side printing onto A5R, the correction values corresponding to the numbers of printed surfaces are values shown in FIG. 35(*a*). Moreover, the changes in the target temperatures TS1 to TS3 corresponding to the numbers of printed surfaces are changes shown in FIGS. 35(*b*) to 35(*d*). Then, the correction values corresponding to the target temperatures TS1 to TS3 are values shown in FIGS. 35(*e*) to 35(*g*).

In this example, the correction value changes depending on the target temperature TS3 of the edge portion of the fixing roller 61 and the target temperature TS2 of the pressure roller 62. Then, as with the above case of A4 size, as the number (20, 40, 50, . . . ) of printed surfaces increases, the correction value changes.

The following will summarize the correction values when carrying out two-side printing onto A5R.

1) Correction Values Corresponding to Numbers of Printed Surfaces of A5R

Up to 20 surfaces: "−2° C."

Up to 40 surfaces: "−2° C."

Up to 50 surfaces: "−3° C."

Up to 100 surfaces: "−4° C."

Up to 150 surfaces: "−4° C."

151 surfaces or more: "−4° C."

Correction value corresponding to the change in the temperature of the case of the temperature detecting section: always "0° C."

2) Correction Values Corresponding to Changes in Target Temperature TS1 of Center Portion of Fixing Roller 61

Up to 20 surfaces: "+1° C."

21 surfaces or more: "±0° C."

3) Correction Value Corresponding to Change in Target Temperature TS3 of Edge Portion of Fixing Roller 61

"+1° C." regardless of the number of printed sheets

4) Correction Value Corresponding to Change in Target Temperature TS2 of Pressure Roller 62

"±0° C." regardless of the number of printed sheets

5) Correction Value Corresponding to Rotation of Fixing Roller 61

"+2° C."

These are summarized in a table of FIG. 36.

The foregoing has explained a correction method when carrying out two-side printing onto the A4-size or A5R-size sheets. However, the correction values used are not limited to the above values, and can be adjusted accordingly depending on various configurations of the fixing device, and can be various values. Moreover, the correction when carrying out two-side printing can be applied to not only the A4-size and A5R-size sheets but also various sheet mediums of various sizes.

Note that it is preferable that the temperature control device 80 be further configured as follows.

Usually, it is not a problem even if the temperature gradually reaches a high-temperature range (temperature range of about 230° C. or higher) of the detectable temperature range. However, if the heater lamp 64 carries out sudden heating by runaway, etc., a gap easily occurs between the surface temperature obtained by the temperature calculating section 121 and the actual surface temperature.

This problem becomes prominent especially when the heater lamp 64*a* is continuously turned on for a long time. When the change in a detection mechanism section of the temperature detecting section 66*a* is slower than the change in the actual surface temperature, the temperature detection cannot be carried out correctly, and the obtained surface temperature becomes an error.

Here, when the temperature is higher than a predetermined high-temperature threshold value (for example, 230° C. or higher) and the rate of the change in the temperature in a predetermined time interval is a predetermined threshold value or more (for example, 1° C./sec or more), a constant value (for example, −3° C. In this case, the detected temperature is higher than the actual surface temperature) or the correction value corresponding to the rate of the change in the temperature in a predetermined time interval (when the rate of the change in the temperature is small, the correction value is small, and when the rate of the change in the temperature is large, the correction value is large) is applied to the surface temperature obtained from the two-dimensional temperature conversion table. Thus, it is possible to suppress the error of the detected surface temperature and also possible not to make an erroneous judgment in, for example, a high-temperature trouble judgment. Note that this predetermined high-temperature threshold value may not be only one but be plural. Moreover, for respective predetermined high-temperature threshold value, there may be the same rate of the change in the temperature of or may be different rates of the change in the temperature.

Embodiment 4

In addition to the fixing devices described in the above embodiments, the temperature control device can be applied to various fixing devices, for example, shown in FIGS. 37 to 41. The following will explain other examples of the fixing device to which the temperature control device can be applied.

Figure 37:
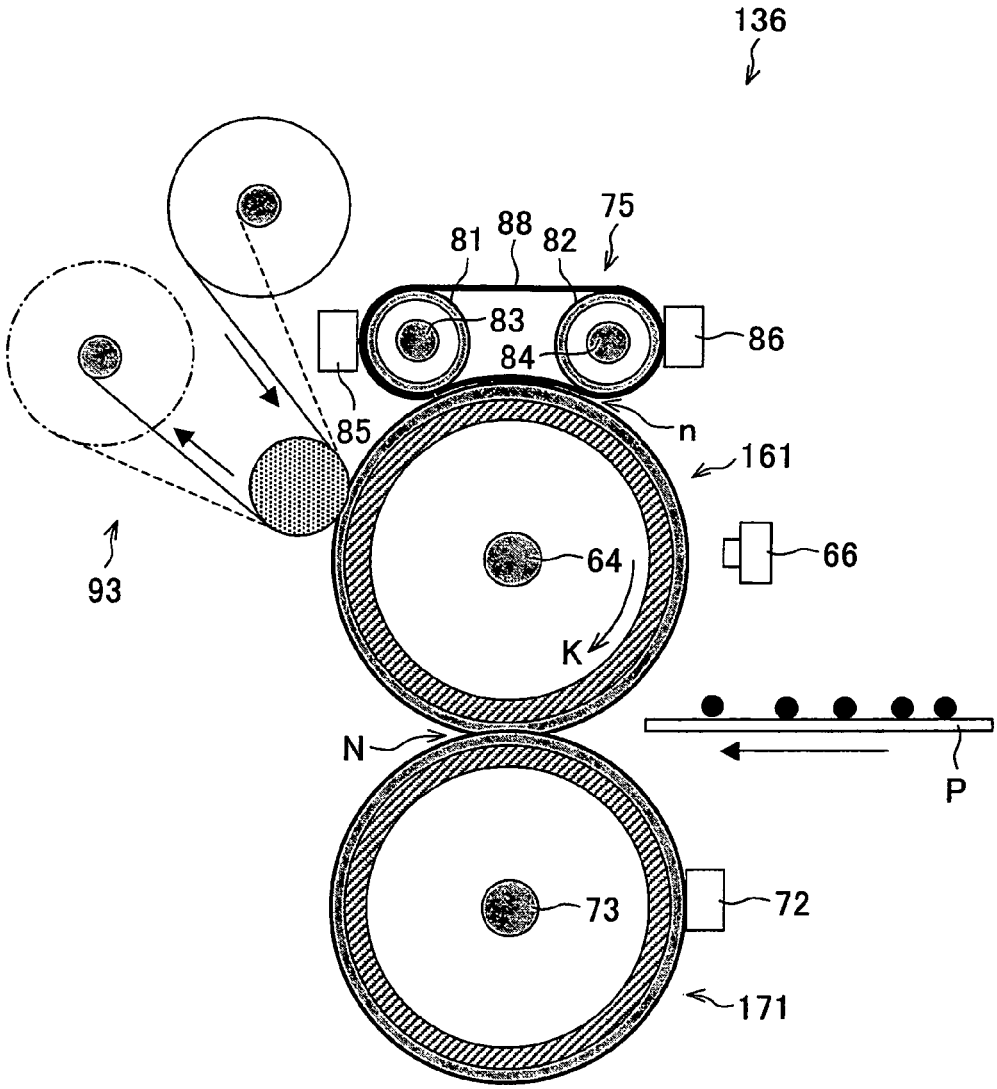
FIG. 37 is a cross-sectional view for explaining a partial configuration of the fixing device including the temperature control device.

FIG. 37 is a diagram showing other example of a fixing device to which the temperature control device is applied. In this fixing device, a fixing roller is heated by (i) a heater lamp provided in the fixing roller and (ii) a heating belt which contacts the surface of the fixing roller.

As shown in FIG. 37, a fixing device 136 includes a fixing roller 161, a pressure roller 171, an external heating section (external heating means) 75 and a web cleaning device 93.

The fixing roller 161 and the pressure roller 171 contact and press each other at a predetermined load (here, 600N), and a fixation nip portion N (portion where the fixing roller 161 and the pressure roller 171 contact each other) is formed between the fixing roller 161 and the pressure roller 171. In the present embodiment, a nip width (width along a rotation direction of the fixing roller 161 (along a "K" direction in FIG. 37)) of the fixation nip portion N is set to, for example, 9 mm.

The fixing roller 161 is heated to a predetermined temperature (for example, 180° C.), and heats a recording sheet P on which a toner image (unfixed) is formed and which passes through the fixation nip portion N. The fixing roller 161 is a three-layer roller member which is configured such that (i) an elastic layer is formed on the outer peripheral surface of a core bar and (ii) a release layer is further formed on the outer peripheral surface of the elastic layer.

As the core bar, for example, metal such as iron, stainless steel, aluminium or copper, or an alloy thereof is used. Moreover, as the elastic layer, silicon rubber is used. Further, as the release layer, fluorocarbon resin such as PFA (copolymer of tetrafluoroethylene and perfluoroalkyl vinyl ether) or PTFE (polytetrafluoroethylene) is used.

The heater lamp (halogen lamp) 64 that is a heat source for heating the fixing roller 161 is provided inside the fixing roller 161 (inside the core bar). Electric power supply to the heater lamp 64 is controlled by the heat control section 123 and the driver 91. When the electric power is supplied to the heater lamp 64, the heater lamp 64 emits the infrared radiation. The emitted infrared radiation is absorbed by the inner peripheral surface of the fixing roller 161. Thus, the fixing roller 161 is heated entirely.

The pressure roller 171 is caused to contact the fixing roller 161 by a pressing mechanism (not shown) provided at an edge portion of the pressure roller 171, and gives a predetermined pressure to the fixation nip portion N. As with the fixing roller 161, the pressure roller 171 is a three-layer roller member which is configured such that (i) an elastic layer made of, for example, silicon rubber is formed on the surface of a core bar made of, for example, metal such as iron, stainless steel, aluminium or copper, or an alloy thereof, and (ii) a release layer made of PFA or PTFE is further formed on the surface of the elastic layer.

Moreover, in the present embodiment, a heater lamp 73 is provided inside the core bar of the pressure roller 171. Then, electric power supply to the heater lamp 73 is controlled by the heat control section 123 and the driver 91. When the electric power is supplied to the heater lamp 73, the heater lamp 73 emits the infrared radiation. The emitted infrared radiation is absorbed by the inner peripheral surface of the pressure roller 171. Thus, the pressure roller 171 is heated entirely.

The external heating section 75 includes (i) an endless external heating belt (belt member) 88 and (ii) heat rollers (heating member) 81 and 82 that are a pair of belt holding rollers by which the external heating belt 88 is held. Then, a placing mechanism (not shown) is placed for causing the heat rollers 81 and 82 to be placed close to the surface of the fixing roller 161.

The external heating belt 88 is heated to a predetermined temperature (here, 210° C.), contacts the surface of the fixing roller 161, and heats the surface of the fixing roller 161. The external heating belt 88 is heated by the heat rollers 81 and 82 each of which contacts the back surface of the external heating belt 88.

The external heating belt 88 is provided at the periphery of the fixing roller 161 and provided upstream of the fixation nip portion N in the rotation direction of the fixing roller 161 (in the K direction in FIG. 37). Moreover, the external heating belt 88 is caused to contact the fixing roller 161 at a predetermined pressure force (here, 40N) by a pressing mechanism (not shown). Then, a heat nip portion n is formed between the external heating belt 88 and the fixing roller 161. In the present embodiment, the nip width of the heat nip portion n (width along the rotation direction of the fixing roller 161) is, for example, 20 mm.

The external heating belt 88 is a two-layer endless belt which is configured such that synthetic resin material (fluorocarbon resin such as PFA or PTFE) having excellent heat resistance and demoldability is formed as a release layer on the surface of a hollow cylindrical base made of heat-resistant resin (such as polyimide) or metal (such as stainless steel or nickel). Moreover, in order to reduce a force of deviating the external heating belt 88, the inner surface of the base may be coated with fluorocarbon resin or the like.

Each of the heat rollers 81 and 82 includes a hollow metal core material made of, for example, aluminium or metal material. In order to reduce the force of deviating the external heating belt 88, the surface of the metal core material may be coated with fluorocarbon resin or the like.

Heater lamps 83 and 84 which are heat sources are provided inside the heat rollers 81 and 82, respectively. When the heater lamp 83 or 84 are turned on by the heat control section 123 and the driver 91, it emits the infrared radiation. The emitted infrared radiation is absorbed by the inner peripheral surface of the heat roller 81 or 82. Thus, the heat rollers 81 and 82 are heated entirely. Then, the heat roller 81 and 82 heat the external heating belt 88.

Moreover, the noncontact-type temperature detecting section 66 for measuring the temperature of the center portion of the fixing roller 161 is provided at the peripheral surface of the fixing roller 161, and a thermistor 72 is provided at the peripheral surface of the pressure roller 171. Moreover, at the surface of the external heating belt 88, a thermistor 85 is provided so as to face the heat roller 81, and a thermistor 86 is provided so as to face the heat roller 82. In this example, the noncontact-type temperature detecting section 66 is provided for the center portion of the fixing roller 161. However, to detect the temperature of at least one of both edge portions of the fixing roller 161 in the axis direction, another noncontact-type temperature detecting section 66 may be used, that is, the temperature control can be carried out by using two noncontact-type temperature detecting sections 66. Further, to detect the surface temperature of the pressure roller 171, another noncontact-type temperature detecting section 66 may be used, that is, the temperature control can be carried out by using three noncontact-type temperature detecting sections. The number of temperature detecting sections is not limited.

Based on outputs from the temperature detecting section 66 and the thermistors 72, 85 and 86, the heat control section 123 detects the surface temperatures of the fixing roller 161, pressure roller 171 and two positions of the external heating belt 88. Then, the heat control section 123 controls the power supply to the heater lamps 64, 73, 83 and 84 via the driver 91 so that these surface temperatures become close to their target temperatures, respectively.

Note that in the present embodiment, the controls, such as the power supply to the heater lamps 64, 73, 83 and 84, are carried out by the heat control section 123 of the image forming apparatus 100. However, the fixing device 136 itself may include the heat control section 123.

Moreover, a driving power from a drive motor (drive source) is transmitted to a rotation axis (not shown in FIG. 37) provided at an edge portion of the fixing roller 161, and the rotation axis rotates in a "K" direction in FIG. 37. Since the pressure roller 171 contacts the fixing roller 161, it rotates, at the time of the fixing operation etc., by a frictional force caused by the rotation of the fixing roller 161. Therefore, the rotation direction of the pressure roller 171 is opposite the K direction.

The external heating belt 88 of the external heating section 75 also rotates by the frictional force caused by the fixing roller 161. Therefore, the rotation direction of the external heating belt 88 is opposite the K direction. Moreover, since the surfaces of the heat rollers 81 and 82 contact the back surface of the external heating belt 88, the heat rollers 81 and 82 rotates by the rotation of the external heating belt 88.

The recording sheet P is conveyed toward the fixation nip portion N so that its front surface on which the toner image is formed contacts the fixing roller 161 and its back surface contacts the pressure roller 171. Thus, the toner image formed on the recording sheet P is fixed on the recording sheet P by thermocompression. A fixation speed that is a speed at which the recording sheet P passes through the fixation nip portion N is equal to the process speed (sheet conveying speed), and is 355 mm/sec in the present embodiment. Moreover, a copying speed expressed by the number of successively supplied sheets per minute is 70 in the present embodiment.

In the present embodiment, the external heating belt 88 is configured such that fluorocarbon resin as a release layer made by blending PTFE and PFA and having a thickness of 20 μm is formed on the surface of a polyimide (Product name: UPILEX S produced by Ube Industries, Ltd.) base having a thickness of 90 μm.

Moreover, the fixing roller 161 is configured such that (i) a silicon rubber layer as an elastic layer having a thickness of 3 mm is formed on an aluminium core bar and (ii) a PFA tube as a release layer having a thickness of 30 μm is further formed on the silicon rubber layer. The fixing roller 161 has an external diameter (diameter) of 50 mm.

The pressure roller 171 is configured such that (i) a silicon rubber layer as an elastic layer having a thickness of 2 mm is formed on an aluminium core bar and (ii) a PFA tube having a thickness of 30 μm is further formed on the silicon rubber layer. The pressure roller 171 has an external diameter (diameter) of 50 mm that is the same as the external diameter of the fixing roller 161.

Each of the heat rollers 81 and 82 is configured such that fluorocarbon resin made by blending PTFE and PFA and having a thickness of 20 μm is formed on the surface of an aluminium core bar having a thickness of 0.75 mm. Each of the heat rollers 81 and 82 has an external diameter (diameter) of 15 mm. Then, these heat rollers 81 and 82 are placed so that the distance between their axes is 23.0 mm.

Figure 38:
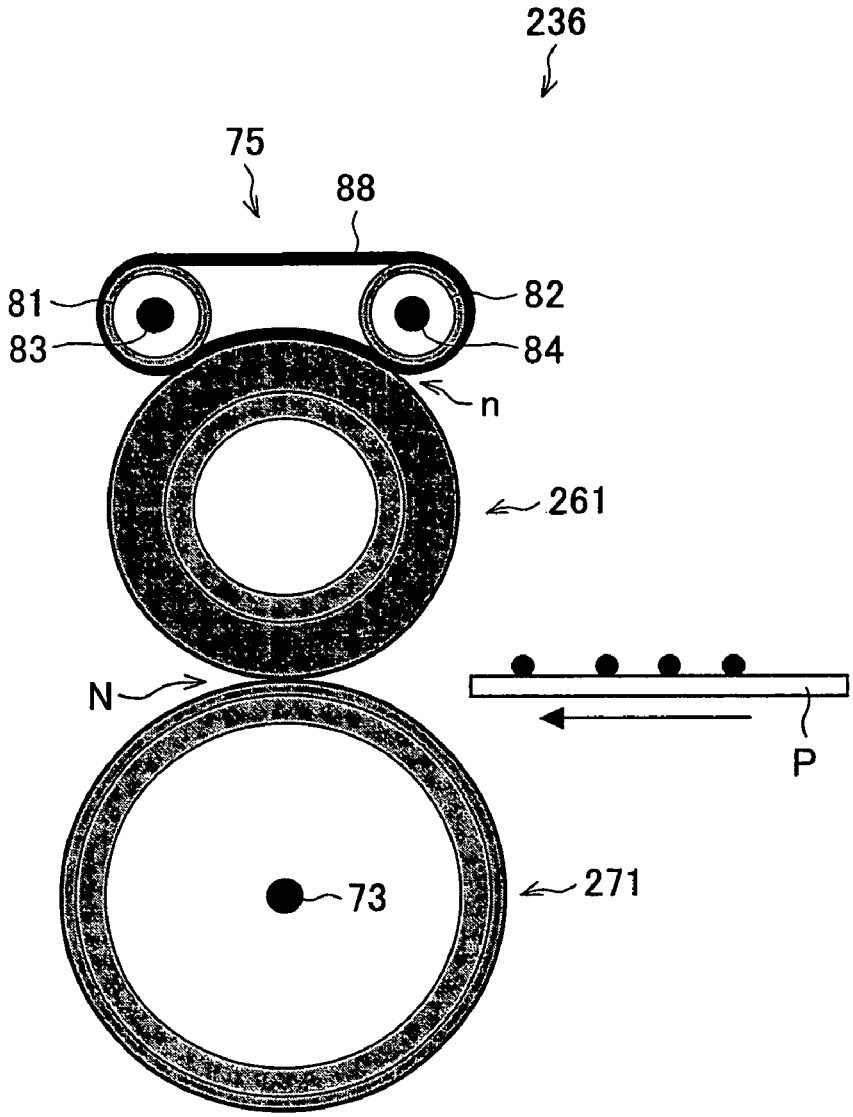
FIGS. 38 to 41 are cross-sectional views showing other examples of the fixing device.

Note that a method for heating the fixing roller is not limited to the above method. FIG. 38 is a diagram showing yet another example of the fixing device. In a fixing device 236, a heater lamp is not provided inside a fixing roller, and a heating belt contacting the surface of the fixing roller heats the fixing roller.

As shown in FIG. 38, the fixing device 236 includes a fixing roller 261, a pressure roller 271 and the external heating section 75. The fixing roller 261 has an external diameter of 34 mm and is a three-layer roller member which is configured such that (i) an elastic layer made of silicon rubber is formed on the outer peripheral surface of a core bar made of STKM and (ii) a release layer made of PFA is further formed on the outer peripheral surface of the elastic layer. Note that in the present embodiment, a heater lamp is not provided inside the fixing roller 261. Meanwhile, the pressure roller 271 has an external diameter of 40 mm, is a three-layer roller member as with the fixing roller 261, and includes therein the heater lamp 73. The external heating section 75 is configured as above. In the present embodiment, the fixing roller 261 is heated by the external heating belt 88 of the external heating section 75. In the fixing device 236, to detect and control the temperature of at least any of the fixing roller 261, the pressure roller 271 and the heat rollers 81 and 82, the temperature detecting section 66 can be provided so as to face each of these members.

Figure 39:
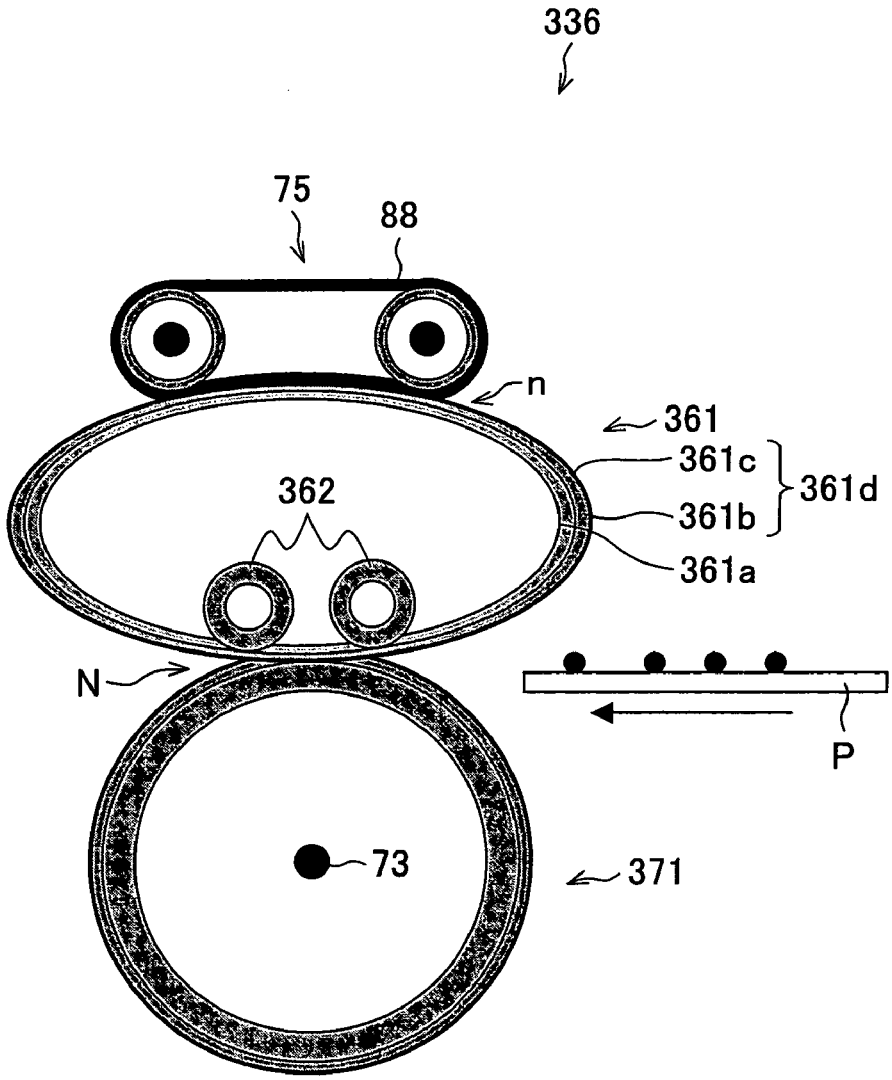

Moreover, each of the fixing roller and the pressure roller is not limited to a cylindrical shape, but may be a belt shape or any shape. FIG. 39 is a diagram showing still another example of the fixing device. In a fixing device 336, a fixing member 361 in the shape of an ellipse carries out fixing instead of a fixing roller in the shape of a cylinder.

The fixing member 361 is configured such that (i) an endless belt 361*d* including an elastic layer 361*b* made of silicon rubber and a release layer 361*c* made of PFA is provided on the peripheral surface of an elliptical core bar having an external diameter of 40 mm and 361*a* made of SUS and (ii) the endless belt 361*d* is slidable on the core bar 361*a*. The endless belt 361*d* of the fixing member 361 is heated by the external heating belt 88 of the external heating section 75. Moreover, the fixing member 361 is caused to contact the pressure roller 371 by nip portion press rollers 362 having an external diameter of 16 mm, made of iron and having a thickness of 1 mm. The pressure roller 371 is the same as the pressure roller 271 described above. Thus, a fixation nip portion N (portion where the fixing roller 361 and the pressure roller 371 contact each other) is formed between the endless belt 361*d* of the fixing member 361 and the pressure roller 371.

Figure 40:
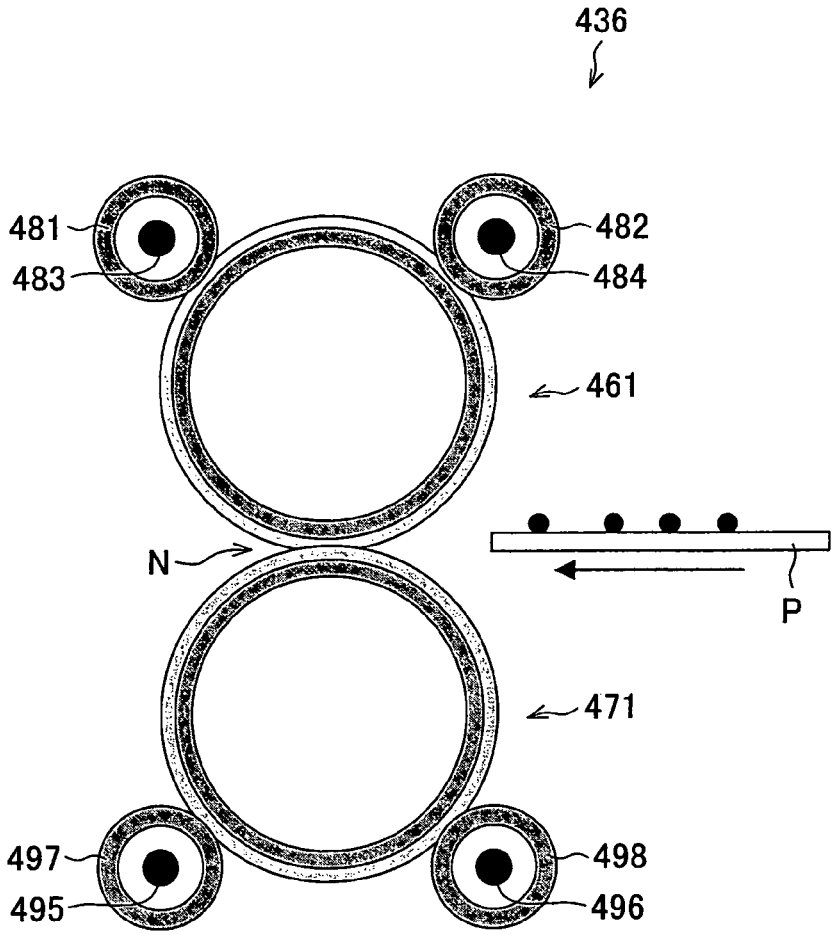

FIG. 40 is yet another example of the fixing device. In a fixing device 436, both a fixing roller and a pressure roller are heated externally. The fixing roller is heated by a pair of pressing rollers, and the pressure roller is heated by another pair of pressing rollers.

The fixing device 436 includes a thin fixing roller 461 having an external diameter of 40 mm and a thin pressure roller 471 having an external diameter of 40 mm. Each of the fixing roller 461 and the pressure roller 471 is a three-layer roller member which is configured such that a thin elastic layer and release layer are formed on a core bar. Then, to heat the fixing roller 461, pressing rollers 481 and 482 each having an external diameter of 16 mm and made of STKM externally contact the surface of the fixing roller 461. The pressing rollers 481 and 482 include therein heater lamps 483 and 484, respectively. Similarly, pressing rollers 497 and 498 each having an external diameter of 16 mm and made of STKM externally contact the surface of the pressure roller 471. The pressing rollers 497 and 498 include therein heater lamps 495 and 496, respectively. These pressing rollers 481, 482, 497 and 498 have a function of heating the fixing roller 461 or the pressure roller 471, and a function of causing the fixing roller 461 and the pressure roller 471 to contact each other. Thus, a fixation nip portion N (portion where the fixing roller 461 and the pressure roller 471 contact each other) is formed between the fixing roller 461 and the pressure roller 471.

Figure 41:
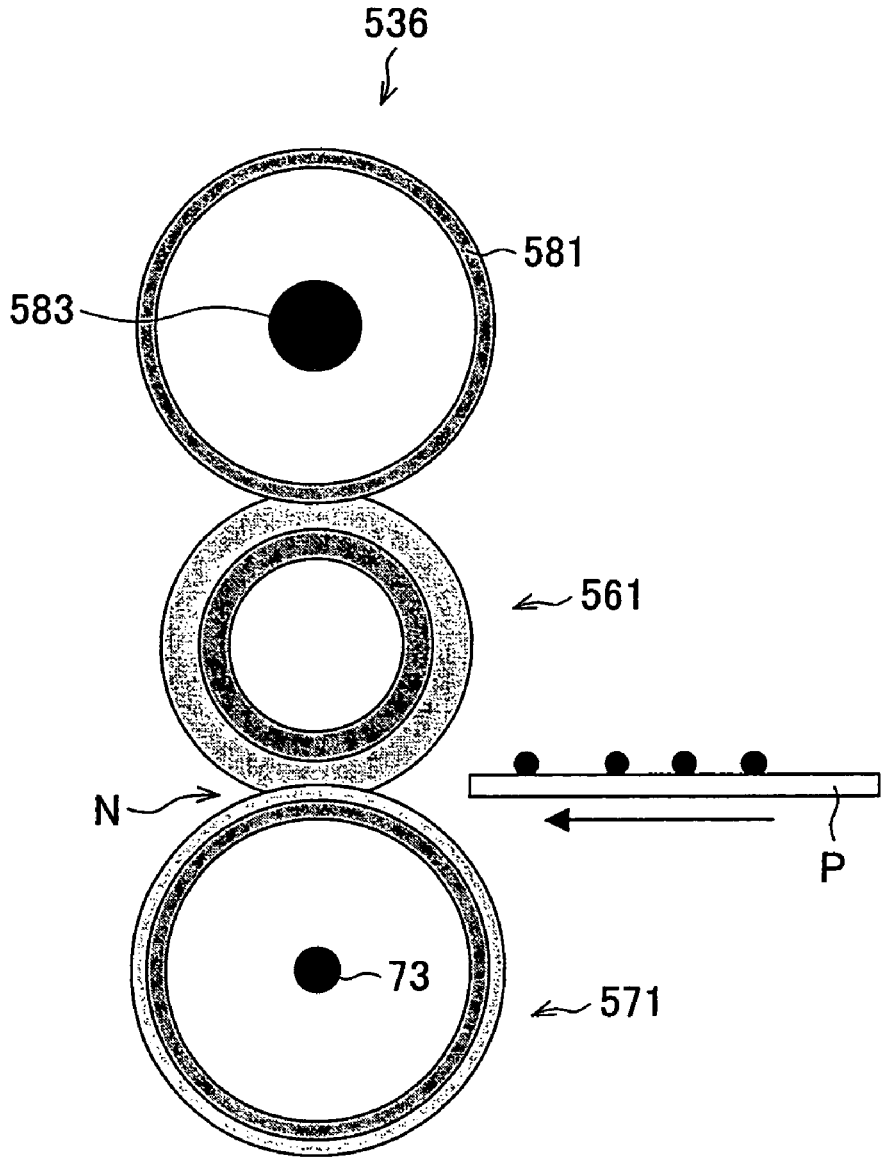

FIG. 41 is a diagram showing still another example of the fixing device. A fixing device 536 includes a thick fixing roller 561 having an external diameter of 20 mm (small diameter) and a pressure roller 571 having an external diameter of 30 mm. The fixing roller 561 is configured such that (i) an elastic layer made of rubber is formed on an aluminium core bar and (ii) the elastic layer has a thickness of 5 mm. Moreover, a release layer may be formed on the surface of the elastic layer. Meanwhile, the pressure roller 571 is configured such that (i) an elastic layer made of rubber is formed on a core bar made of SUS and (ii) the elastic layer has a thickness of 0.2 mm. An external heat roller 581 having an external diameter of 30 mm, made of SUS and having a thickness of 0.15 mm contacts the fixing roller 561. The external heat roller 581 includes therein a heater lamp 583, and the surface of the fixing roller 561 is heated externally by the external heat roller 581. Meanwhile, the pressure roller 571 is heated by a heater lamp 73 included therein.

As above, members included in the fixing device are not especially limited. In addition to the fixing roller and the pressure roller, the fixing device can include any member such as a pressing roller, a heat roller, a cleaning roller, a heat uniformizing roller, a cleaning web, a removing roller, a removing plate, etc. Moreover, the number of members, the configuration, material and size of each member and a combination thereof are not especially limited. The temperature control device can be applied to various fixing devices described above.

Moreover, in the above embodiments, as one example, the first correction value data is prepared for each of a normal temperature/normal humidity environment (N/N environment), a low temperature/low humidity environment (L/L environment) and a high temperature/high humidity environment (H/H environment). However, how to prepare the first correction value data for each environmental condition is not limited to the above. That is, the first correction value data may be prepared for each environmental condition that is a combination of environmental conditions such as low temperature (for example, 5° C. or 10° C.), normal temperature (for example, 20° C. or 25° C.), high temperature (for example, 30° C. or 35° C.), low humidity (for example, 10% RH or 20% RH), normal humidity (40% RH or 50% RH) and high humidity (70% RH or 80% RH). The environmental condition is not limited to a specific one. Note that the above temperatures and humidity are just examples. Moreover, the first correction value data may be prepared for each environmental condition that is a combination of various temperatures and humidity, and the temperature and humidity are not limited to specific ones.

Finally, the temperature calculating section 121 of the temperature control device 80 may be configured by a hardware logic, or may be realized by software using a CPU in the following manner.

That is, the temperature control device 80 includes: a CPU (central processing unit) which executes a command of a control program for realizing each function; a ROM (read only memory) which stores the program; a RAM (random access memory) which loads the program; a storage device (recording medium), such as a memory, which stores the program and various data; and the like. Then, an object of the technology can be achieved by supplying a computer-readable recording medium to the temperature control device 80 and then causing its computer (CPU, MPU, or the like) to read out and execute a program code (executable format program, intermediate code program, source program) of the control program of the temperature control device 80, the program being software that realizes the above-described functions.

Examples of the recording medium are (i) a tape, such as a magnetic tape or a cassette tape, (ii) a disc, such as a magnetic disc (a Floppy® disc, a hard disc, etc.) or an optical disc (a CD-ROM, an MO, an MD, a DVD, a CD-R, etc.), (iii) a card, such as an IC card (including a memory card) or an optical card, (iv) a semiconductor memory, such as a mask ROM, an EPROM, an EEPROM, a flash ROM, etc.

Moreover, the temperature control device 80 may be configured so as to be connectable with a communication network, so that the program code may be supplied through the communication network. The communication network is not especially limited, and may be, for example, the Internet, an intranet, and extranet, a LAN, an ISDN, a VAN, a CATV communication network, a virtual private network, a telephone network, a mobile communication network, a satellite communication network, or the like. Moreover, a transmission medium constituting the communication network is not especially limited, and may be, for example, (i) a fixed line, such as an IEEE1394, a USB, a power line carrier, a cable TV circuit, a telephone line, or an ADSL, or (ii) a wireless, such as an infrared (an IrDA, a remote control), a Bluetooth®, an 802.11 wireless, an HDR, a mobile phone network, a satellite circuit, or a ground wave digital network. Note that the technology can be realized even in the case where the program code is in the form of a computer data signal which is realized by an electronic transmission and is embedded in a carrier wave.

As above, a temperature control device controls a temperature of a heated object heated by a heating section and includes: a main temperature detecting section which detects heat generated by infrared radiation from the heated object; a compensation temperature detecting section which detects an ambient temperature of the main temperature detecting section; a memory section which stores a temperature correspondence table in which correspondences between output values of the main temperature detecting section and the temperatures of the heated object are shown for respective output values of the compensation temperature detecting section; a temperature calculating section which refers to the temperature correspondence table so as to obtain the temperature of the heated object from the output value of the main temperature detecting section and the output value of the compensation temperature detecting section; and a heat control section which controls a heating power of the heating section on the basis of the temperature obtained by the temperature calculating section, and the output values of the compensation temperature detecting section and the output values of the main temperature detecting section in the temperature correspondence table are set so that an interval between adjacent values of the ambient temperatures corresponding to the output values of the compensation temperature detecting section is smaller than an interval between adjacent values of the temperatures of the heated object which temperatures correspond to the output values of the main temperature detecting section.

According to the above configuration, the heat generated by the infrared radiation emitted from the heated object is detected by the main temperature detecting section. Here, in addition to the heat generated by the infrared radiation from the heated object, the heat detected by the main temperature detecting section is, for example, heat from the holding body that is a peripheral member of the main temperature detecting section. Therefore, the compensation temperature detecting section detects the ambient temperature which may affect the main temperature detecting section, and the temperature detected by the main temperature detecting section is compensated by this ambient temperature. With this, it is possible to detect the temperature of the heated object precisely without contacting the heated object.

Here, when the temperature calculating section obtains the temperature of the heated object from the output value of the main temperature detecting section and the output value of the compensation temperature detecting section, the temperature correspondence table stored in the memory section is used. This temperature correspondence table shows the correspondences between the output values of the main temperature detecting section and the temperatures of the heated object for respective output values of the compensation temperature detecting section. Therefore, by referring to a cell corresponding to the output value of the main temperature detecting section and the output value of the compensation temperature detecting section, the temperature calculating section can obtain the temperature of the heated object quickly. Moreover, by obtaining the temperatures corresponding to respective output values through experiments and creating the temperature correspondence table based on the obtained temperatures, it is possible to accurately obtain the temperature close to the actual temperature.

Further, according to the above configuration, the output values of the compensation temperature detecting section and the output values of the main temperature detecting section in the temperature correspondence table are set so that the difference (interval) between adjacent values of the compensation temperatures corresponding to the output values of the compensation temperature detecting section is smaller than the difference (interval) between adjacent values of the temperatures of the heated object which temperatures correspond to the output values of the main temperature detecting section. This setting has the following advantages.

As the temperature detected by the compensation temperature detecting section changes by 1° C. in the case of obtaining the temperature of the heated object by using the output value of the main temperature detecting section and the output value of the compensation temperature detecting section, the corresponding temperature of the heated object usually changes by a few degrees centigrade. Therefore, as is conventional, even if the main temperature detecting section detects the temperature of the heated object to an accuracy of 1° C. by using the temperature correspondence table in which the interval between adjacent values of the compensation temperatures and the interval between adjacent values of the temperatures of the heated object are the same value (for example, 1° C.), the eventually obtained temperature of the heated object contains the error that is a few times (that is, a few degrees centigrade) the accuracy of the compensation temperature detected by the compensation temperature detecting section. However, according to the above configuration, the accuracy of the compensation temperature detected by the compensation temperature detecting section becomes higher than the accuracy of the temperature of the heated object detected by the main temperature detecting section, and the errors of the temperatures detected by these temperature detecting sections are balanced. Therefore, it is possible to obtain the temperature of the heated object precisely without pointlessly reducing the interval between the adjacent values of the temperatures in the temperature correspondence table.

Then, since the heat control section controls the heating power of the heating section on the basis of the accurate temperature of the heated object which temperature is obtained by the temperature calculating section, it is possible to carry out the temperature control accurately without the temperature drift or the temperature ripple.

As above, the temperature control device which detects the temperature in a noncontact manner can carry out the temperature detection and the temperature control accurately.

Note that when the main temperature detecting section is held by the holding body, a temperature of the holding body may be detected as the ambient temperature.

Moreover, the output values of the compensation temperature detecting section and the output values of the main temperature detecting section in the temperature correspondence table are set so that the interval between the adjacent values of the ambient temperatures corresponding to the output values of the compensation temperature detecting section is preferably 0.1 times or more but less than 0.5 times the interval between the adjacent values of the temperatures of the heated object which temperatures correspond to the output values of the main temperature detecting section, and more preferably 0.2 times.

According to the above configuration, the errors of the temperatures detected by these temperature detecting sections are further balanced, and it is possible to obtain the temperature of the heated object further precisely and carry out the temperature control further accurately.

It is preferable that the output values of the main temperature detecting section in the temperature correspondence table be set so that the interval between the adjacent values of the temperatures of the heated object which temperatures correspond to the output values of the main temperature detecting section in the temperature correspondence table is 0.5 times to 1 times a control temperature accuracy by the heating section with respect to the heated object.

According to the above configuration, since the accuracy of the temperature of the heated object which temperature is detected by the main temperature detecting section is better than the control temperature accuracy by the heat control section, it is possible to carry out the temperature control of the heated object accurately without the temperature drift or the temperature ripple.

It is preferable that the output values of the main temperature detecting section in the temperature correspondence table be set so that the interval between the adjacent values of the temperatures of the heated object which temperatures correspond to the output values of the main temperature detecting section in the temperature correspondence table is 0.5 times to 1 times a detection temperature accuracy by the main temperature detecting section.

According to the above configuration, the accuracy of the temperature of the heated object which temperature is detected by the main temperature detecting section becomes better, and the temperature can be obtained accurately. Moreover, it is possible to carry out the temperature control of the heated object without the temperature drift or the temperature ripple.

Moreover, it is preferable that: the memory section store one piece or plural pieces of first correction value data each of which is data of correction values for respective temperatures corresponding to the output values of the compensation temperature detecting section; the temperature calculating section correct the temperature, obtained by referring to the temperature correspondence table, by using the correction value of the first correction value data on the basis of the temperature corresponding to the output value of the compensation temperature detecting section; and the heat control section control the heating power of the heating section on the basis of the temperature corrected by the temperature calculating section.

According to the above configuration, the temperature of the heated object which temperature is obtained by referring to the temperature correspondence table is corrected properly on the basis of the compensation temperature detected by the compensation temperature detecting section. Therefore, the temperature control device can obtain the temperature of the heated object further precisely and carry out the temperature control further accurately.

Moreover, it is preferable that: the memory section store plural pieces of the first correction value data, these pieces being different from each other depending on environmental conditions; and the temperature calculating section select the first correction value data, to be used for correction, from the plural pieces of the first correction value data on the basis of the environmental condition.

According to the above configuration, the first correction value data are prepared for respective environmental conditions, and the temperature calculating section selects the appropriate first correction value data on the basis of the environmental condition and corrects the temperature on the basis of the selected first correction value data. In the case of detecting the temperature of the heated object in a noncontact manner, various disturbances affect this detection. However, by properly using the first correction value data depending on the environmental condition, it is always possible to obtain the temperature of the heated object precisely regardless of the environmental condition.

Note that specific examples of the environmental condition are a room temperature and humidity, however the technology is not limited to these.

Moreover, it is preferable that: the heated object be a fixing section which heats print mediums, conveyed sequentially, so as to fix a toner image transferred onto the print mediums; the memory section store one piece or plural pieces of second correction value data each of which is data of correction values for respective amounts of the print mediums fixed sequentially; the temperature calculating section correct the temperature, obtained by referring to the temperature correspondence table, by using the correction value of the second correction value data on the basis of the amount of the print mediums fixed sequentially; and the heat control section control the heating power of the heating section on the basis of the temperature corrected by the temperature calculating section.

As a result of various examinations by the present inventors, it became clear that when the fixing section sequentially fixes the toner on the print medium, depending on a condition (for example, the size of the print medium), the temperature of the fixing section which temperature is obtained by referring to the temperature correspondence table contains an error corresponding to the amount of the print mediums fixed sequentially (for example, the number of printed sheets per unit time, the number of printed surfaces per unit time, a mass per unit area, a volume, a density, the total number of printed sheets, the total number of printed surfaces, etc.). Here, according to the above configuration, the temperature calculating section corrects the temperature of the fixing section, which temperature is obtained by referring to the temperature correspondence table, depending on the amount of the print mediums. Therefore, even in the case of fixing the print mediums sequentially, the temperature control section can detect the temperature that is close to the actual temperature of the fixing section and can carry out the temperature control accurately without the temperature drift or the temperature ripple.

Moreover, it is preferable that: the memory section store the second correction value data for respective sizes of the print medium to be fixed; and the temperature calculating section use the second correction value data corresponding to the size of the print medium to be fixed, so as to correct the temperature obtained by referring to the temperature correspondence table.

As a result of various examinations by the present inventors, it became clear that when the obtained temperature is corrected on the basis of the amount of the print mediums, a necessary correction amount depends on the size of the print medium. According to the above configuration, since the correction is carried out by using the second correction value data corresponding to the size of the print medium, it is possible to carry out the correction further accurately.

Moreover, the memory section may store the second correction value data for respective types of the print medium to be fixed, and the temperature calculating section may use the second correction value data corresponding to the type of the print medium to be fixed, so as to correct the temperature obtained by referring to the temperature correspondence table.

As a result of various examinations by the present inventors, it became clear that when the obtained temperature is corrected on the basis of the amount of the print mediums, a necessary correction amount technically depends on the type of the print medium. Here, according to the above configuration, since the correction is carried out by using the second correction value data corresponding to the type of the print medium, it is possible to carry out the correction further accurately.

Note that specific examples of the type of the print medium are the size, material, thickness, etc. of the print medium, however the technology is not limited to these.

Moreover, it is preferable that: an information acquiring section which acquires information regarding the size or type of the print medium be further included; and the temperature calculating section identify the size or type of the print medium, to be fixed, on the basis of the information acquired by the information acquiring section.

According to the above configuration, the temperature control device itself does not have to identify the size or type of the print medium, and can obtain, through the information acquiring section, the information regarding the size or type of the recording medium from various higher-level devices including the temperature control device. Therefore, it is possible to prevent the configuration of the temperature control device from becoming complex.

Moreover, (i) the fixing section may include a fixing roller, (ii) the memory section may store the second correction value data for respective widths of the print medium in an axial direction of the fixing roller, and (iii) the temperature calculating section may using the second correction value data corresponding to the width of the print medium in the axial direction of the fixing roller so as to correct the temperature obtained by referring to the temperature correspondence table.

As described above, when the obtained temperature is corrected on the basis of the amount of the print mediums, a necessary correction amount technically depends on the size of the print medium. Here, as a result of examinations under various conditions by the present inventors, it became clear that the necessary correction amount mainly depends on the width of the print medium (the length of the print medium in the axial direction of the fixing roller). According to the above configuration, since the correction is carried out by using the second correction value data corresponding to the width of the print medium, it is possible to carry out the correction further accurately.

Moreover, it is preferable that: a width detecting section which detects the width of the print medium in the axial direction of the fixing roller be further included; and the temperature calculating section select the second correction value data corresponding to the width of the print medium in the axial direction of the fixing roller on the basis of the width, detected by the width detecting section, of the print medium in the axial direction of the fixing roller.

When the print medium has a nonstandardized size, the width of this print medium cannot be acquired from, for example, the image forming apparatus that is a higher-level device including the temperature control device. However, according to the above configuration, even if the print medium has a nonstandardized size, the width detecting section can detect the width of the print medium. Therefore, the temperature control section can carry out the correction in accordance with the detected width of the print medium.

Moreover, (i) the memory section may store at least two types of the second correction value data, one of the two types being used when a toner image is fixed only on one surface of the print medium and another of the two types being used when the toner image is fixed on both surfaces of the print medium; and (ii) the temperature calculating section may select one of at least the two types of the second correction value data depending on whether the toner image is fixed only on one surface of the print medium or on both surfaces of the printing medium, and use the selected second correction value data so as to correct the temperature obtained by referring to the temperature correspondence table.

When fixing the toner on a back surface of the print medium after having fixed the toner on a front surface of the print medium, the print medium is already heated. Therefore, the necessary correction amount is technically different between when fixing onto one surface and when fixing onto both surfaces. According to the above configuration, since the second correction value data are used properly depending on whether the fixing is carried out onto one surface or both surfaces, it is possible to carry out the correction further accurately.

Moreover, it is preferable that: the heated object be a fixing roller which heats a conveyed print medium so as to fix a toner image transferred onto the print medium; the memory section store third correction value data that is data of correction values for respective rotation states of the fixing roller; the temperature calculating section correct the temperature, obtained by referring to the temperature correspondence table, by using the correction value of the third correction value data on the basis of the rotation state of the fixing roller; and the heat control section control the heating power of the heating section on the basis of the temperature corrected by the temperature calculating section.

In the case of detecting the temperature of the fixing roller in a noncontact manner, various disturbances affect this detection. As a result of various examinations by the present inventors, it became clear that one of these disturbances is the change in a temperature distribution caused by the rotation of the fixing roller. Therefore, the necessary correction amount also depends on the rotation state of the fixing roller. According to the above configuration, since the correction is carried out in accordance with the rotation state of the fixing roller, it is possible to carry out the correction further accurately.

Moreover, it is preferable that: the heat control section control the heating power of the heating section on the basis of the temperature, obtained by the temperature calculating section, so that the heated object has a target temperature; the memory section store fourth correction value data that is data of correction values for respective target temperatures of the heated object; the temperature calculating section correct the temperature, obtained by referring to the temperature correspondence table, by using the correction value of the fourth correction value data on the basis of the target temperature of the heated object; and the heat control section control the heating power of the heating section on the basis of the temperature corrected by the temperature calculating section.

In the case of detecting the temperature of the heated object in a noncontact manner, various disturbances affect this detection. As a result of various examinations by the present inventors, it became clear that one of the disturbances is the change in the surface temperature distribution which change is caused by the change in the target temperature. Therefore, the necessary correction amount also depends on the target temperature of the heated object. According to the above configuration, since the correction is carried out in accordance with the target temperature of the heated object, it is possible to carry out the correction further accurately.

Moreover, it is preferable that: the temperature calculating section obtain, from the corrected temperature, a rate of change of the temperature of the heated object per unit time; and when the corrected temperature is higher than a high-temperature threshold value and the rate of change is higher than a threshold value, the temperature calculating section further correct the corrected temperature by using the correction value corresponding to the rate of change or by using a predetermined correction value.

As a result of various examinations by the present inventors, it became clear that when (i) the heated object has a certain high temperature, (ii) the rate of change of the temperature per unit time is high (for example, at the time of continuous heating by runaway, etc.), and (iii) the temperature of the heated object is detected in a noncontact manner, a gap easily occurs between the temperature obtained by using the temperature correspondence table and the actual temperature. Especially when the heating section continuously heats the heated object for a long time, the response speeds of respective portions whose temperatures are detected become low. Thus, this problem becomes prominent. As a result, the temperature of the heated object cannot be detected accurately, and the temperature control becomes inaccurate.

Here, according to the above configuration, when the corrected temperature is higher than a threshold value (for example, 230° C.) and the rate of change the temperature of the heated object per unit time is higher than a predetermined threshold value (for example, 1° C./sec), the correction is further carried out by using the correction value corresponding to the rate of change or by using a predetermined correction value. Thus, it is possible to prevent the erroneous judgment in, for example, the high-temperature trouble judgment.

Moreover, (i) the heating section may be a first heating section for heating a first region of the heated object, (ii) the main temperature detecting section may detect the heat generated by the infrared radiation from the first region of the heated object, (iii) the heat control section may be a first heat control section, (iv) the temperature control device may further include: a second temperature detecting section which detects a temperature of a second region, heated by a second heating section, of the heated object; and a second heat control section which controls the heating power of the second heating section on the basis of the temperature, detected by the second temperature detecting section, so that the second region of the heated object has the target temperature, (iv) the memory section may store fifth correction value data that is data of the correction values for respective target temperatures of the second region of the heated object, and (v) the temperature calculating section may correct the temperature, obtained by referring to the temperature correspondence table, by using the correction value of the fifth correction value data on the basis of the target temperature of the second region.

In the case of heating the heated object, a single heating section may heat the heated object, or a plurality of heating sections may heat different regions of the heated object, respectively. The foregoing has described that one of the disturbances when detecting the temperature of the heated object in a noncontact manner is the change in the target temperature of the heated object. When a plurality of heating sections heat different regions, respectively, the temperature detection is affected by the target temperatures of the regions controlled by different heat control sections. According to the above configuration, since the correction is carried out in accordance with the target temperatures of different regions of the heated object which target temperatures are controlled by different heat control sections, it is possible to carry out the correction further accurately.

Moreover, it is preferable that the heat control section control the heating power of the heating section in a cycle 0.25 times or less a response speed of the temperature detecting section including the main temperature detecting section and the compensation temperature detecting section.

According to the above configuration, since the control cycle of the heat control section is 0.25 times or less the response speed of the temperature detecting section, a following capability of control of the heat control section improves, and it is possible to carry out the temperature control accurately without the temperature drift or the temperature ripple.

Moreover, it is preferable that: each of the main temperature detecting section and the compensation temperature detecting section output an analog voltage signal; the temperature control device further include an A/D converting section which converts the analog voltage signal, output from each of the main temperature detecting section and the compensation temperature detecting section, into a digital signal by using a predetermined reference voltage; and each of a voltage for driving the main temperature detecting section and a voltage for driving the compensation temperature detecting section be 95% to 100% of the reference voltage.

Each of (i) the output value corresponding to the temperature of the heated object which temperature is detected by the main temperature detecting section and (ii) the output value corresponding to the compensation temperature which is detected by the compensation temperature detecting section is output as a voltage. Here, the voltage value of the drive voltage for driving the respective detecting sections and the voltage value of the reference voltage supplied to the A/D converting section are important factors which influence the accuracy at the time of quantization. According to the above configuration, since the drive voltage is defined to be 95% to 100% of a predetermined reference voltage (for example, 5V or 3.3V), the influence by the gap in the temperature correspondence table becomes a detectable voltage value or less, that is, an acceptable level, and the stable temperature control can be carried out.

Moreover, it is preferable that: each of the main temperature detecting section and the compensation temperature detecting section be connected in series to a pull-up resistor; and a tolerance of a resistance value of the pull-up resistor be within ±1% of a nominal value.

Regarding the pull-up resistor, it is necessary that the difference between the voltage value that is the output value of the pull-up resistor and the voltage value in the two-dimensional temperature conversion table be an acceptable value or less. According to the above configuration, since the tolerance of the resistance value of the pull-up resistor is within ±1% of the nominal value, the influence by the gap in the temperature correspondence table becomes a detectable voltage value or less, that is, an acceptable level, and the stable temperature control can be carried out.

Moreover, it is preferable that: each of the main temperature detecting section and the compensation temperature detecting section output the output value as an analog signal; and the temperature control device further include an A/D converting section which converts the output value, output from the main temperature detecting section, into a digital signal of 10 bits to 14 bits.

Since 5V or less is usually used as the reference voltage and 3.3V is also used so often, the resolution of 8 bits or 9 bits is not sufficient, the deviation increases at the time of compensation by using the temperature correspondence table, and the stable temperature control cannot be realized. Meanwhile, the resolution of 15 bits or 16 bits is sufficient. However, in order to give this resolution, the cost increases, and the cost performance is very low. According to the above configuration, since the number of quantized bits of the A/D converting section is from 10 bits to 14 bits, the cost performance is high, and it is possible to realize the temperature control device which can carry out control sufficiently accurately.

Moreover, it is preferable that (i) each of the main temperature detecting section and the compensation temperature detecting section include: a thermistor whose resistance value changes depending on a temperature; a pull-up resistor connected in series to the thermistor; and a signal amplifier connected to between a connection portion of the thermistor and the pull-up resistor and the temperature calculating section, and (ii) an input-offset voltage of the signal amplifier be 1 mV or less.

According to the above configuration, since the voltage amplified by the signal amplifier has less deviation, it is possible to carry out the temperature control accurately.

A fixing device includes: any of the above temperature control devices; the heating section controlled by the temperature control device; and a fixing section, as the heated object, which heats print mediums, conveyed sequentially, so as to fix the toner image transferred onto the print mediums.

According to the above configuration, since the fixing device includes the temperature control device, it is possible to carry out the temperature control of the fixing section accurately, and also possible to realize the fixing device which can fix the toner properly.

An image forming apparatus includes the above temperature control device. Therefore, it is possible to realize the image forming apparatus which can realize high print quality.

Here, the temperature calculating section of the temperature control device may be realized by a hardware or by causing a computer to execute a program. Specifically, a program of the present technology is a temperature calculating program which causes a computer to function as the temperature calculating section, and a recording medium of the present technology records this program.

When this program is executed by a computer, the computer functions as the temperature calculating section of the temperature control device. Therefore, as with the temperature control device, it is possible to obtain the accurate temperature of the heated object.

Moreover, another recording medium of the present technology records the temperature correspondence table stored in the memory section of the temperature control device. Since a computer obtains the temperature of the heated object by using the temperature correspondence table, it is possible to obtain the temperature of the heated object accurately.

In order to solve the above problems, a temperature control device controls a temperature of a fixing section which fixes a toner image transferred onto a print medium and is heated by a heating section, and the temperature control device includes: a main thermistor which detects heat generated by infrared radiation from the fixing section; a compensation thermistor which detects an ambient temperature of the main thermistor; a memory section which stores (i) a temperature correspondence table in which correspondences between output values of the main thermistor and the temperatures of the fixing section are shown for respective output values of the compensation thermistor and (ii) data of correction values for respective types of a sheet and for respective numbers of the sheets sequentially fixed by the fixing section; a temperature calculating section which (i) refers to the temperature correspondence table so as to obtain the temperature of the fixing section from the output value of the main thermistor and the output value of the compensation thermistor and (ii) corrects the obtained temperature by using the correction value in the data of the correction values on the basis of the type of the sheet and the number of the sheets fixed sequentially; and a heat control section which controls a heating power of the heating section on the basis of the temperature of the fixing section which temperature is corrected by the temperature calculating section, and the output values of the main thermistor and the output values of the compensation thermistor in the temperature correspondence table are set so that an interval between adjacent values of the ambient temperatures corresponding to the output values of the compensation thermistor is smaller than an interval between adjacent values of the temperatures of the fixing section which temperatures correspond to the output values of the main thermistor.

According to the above configuration, it is possible to detect the accurate temperature of the fixing section on the basis of the output voltage values of the main thermistor and the compensation thermistor, and also possible to carry out the temperature control accurately without the temperature drift or the temperature ripple.

In order to solve the above problems, a temperature control method controls a temperature of a heated object, heated by a heating section, by using (i) a main temperature detecting section which detects heat generated by infrared radiation from the heated object and (ii) a compensation temperature detecting section which detects an ambient temperature of the main temperature detecting section, and the temperature control method includes the steps of: obtaining the temperature of the heated object from an output value of the main temperature detecting section and an output value of the compensation temperature detecting section by referring to a temperature correspondence table, stored in a memory section, in which (i) correspondences between the output values of the main temperature detecting section and the temperatures of the heated object are shown for the respective output values of the compensation temperature detecting section and (ii) the output values of the compensation temperature detecting section and the output values of the main temperature detecting section are set so that an interval between adjacent values of the ambient temperatures corresponding to the output values of the compensation temperature detecting section is smaller than an interval between adjacent values of the temperatures of the heated object which temperatures correspond to the output values of the main temperature detecting section; and controlling a heating power of the heating section on the basis of the temperature obtained in the obtaining step.

According to the above configuration, it is possible to carry out the temperature detection accurately, and also possible to carry out the temperature control accurately without the temperature drift or the temperature ripple.

Moreover, in order to solve the above problems, another temperature control method controls a temperature of a first region of a heated object, whose first region is heated by a first heating section and whose second region is heated by a second heating section, by using (i) a main temperature detecting section which detects heat generated by infrared radiation from the first region of the heated object and (ii) a compensation temperature detecting section which detects an ambient temperature of the main temperature detecting section, and the temperature control method includes the steps of: obtaining the temperature of the first region of the heated object from the output value of the main temperature detecting section and the output value of the compensation temperature detecting section by referring to a temperature correspondence table, stored in a memory section, in which (i) correspondences between the output values of the main temperature detecting section and the temperatures of the first region of the heated object are shown for respective output values of the compensation temperature detecting section and (ii) the output values of the compensation temperature detecting section and the output values of the main temperature detecting section are set so that an interval between adjacent values of the ambient temperatures corresponding to the output values of the compensation temperature detecting section is smaller than an interval between adjacent values of the temperatures of the first region of the heated object which temperatures correspond to the output values of the main temperature detecting section; correcting the temperature, obtained in the obtaining step, by using data, stored in the memory section, of correction values for respective target temperatures of the second region of the heated object on the basis of the target temperature of the second region of the heated object; and controlling a heating power of the first heating section on the basis of the temperature corrected in the correcting step.

According to the above configuration, it is possible to carry out the temperature detection accurately, and also possible to carry out the temperature control accurately without the temperature drift or the temperature ripple.

A temperature control device can be applied to devices having heating means, such as a hot plate, a microwave oven, a drying device of a wet electrophotographic device or an inkjet printer, a fixing device of a dry electrophotographic device, etc.

The technology is not limited to the description of the embodiments above, but may be altered by a skilled person within the scope of the claims. An embodiment based on a proper combination of technical means disclosed in different embodiments is encompassed in the technical scope of the technology.

That is, the embodiments and concrete examples of implementation discussed in the foregoing detailed explanation serve solely to illustrate the technical details of the present technology, which should not be narrowly interpreted within the limits of such embodiments and concrete examples, but rather may be applied in many variations, provided such variations do not exceed the scope of the patent claims set forth below.

What is claimed is:

1. A temperature control device which controls a temperature of a heated object heated by a heating section, the temperature control device comprising:

a main temperature detecting section which detects heat generated by infrared radiation from the heated object;

a compensation temperature detecting section which detects an ambient temperature of the main temperature detecting section;

a memory section which stores a temperature correspondence table in which correspondences between output values of the main temperature detecting section and the temperatures of the heated object are shown for respective output values of the compensation temperature detecting section;

a temperature calculating section which refers to the temperature correspondence table so as to obtain the temperature of the heated object from the output value of the main temperature detecting section and the output value of the compensation temperature detecting section; and a heat control section which controls a heating power of the heating section on the basis of the temperature obtained by the temperature calculating section, the output values of the compensation temperature detecting section and the output values of the main temperature detecting section in the temperature correspondence table being set so that an interval between adjacent values of the ambient temperatures corresponding to the output values of the compensation temperature detecting section is smaller than an interval between adjacent values of the temperatures of the heated object which temperatures correspond to the output values of the main temperature detecting section.

2. The temperature control device as set forth in claim 1, wherein the output values of the compensation temperature detecting section and the output values of the main temperature detecting section in the temperature correspondence table are set so that the interval between the adjacent values of the ambient temperatures corresponding to the output values of the compensation temperature detecting section is 0.1 times or more but less than 0.5 times the interval between the adjacent values of the temperatures of the heated object which temperatures correspond to the output values of the main temperature detecting section.

3. The temperature control device as set forth in claim 1, wherein the output values of the compensation temperature detecting section and the output values of the main temperature detecting section in the temperature correspondence table are set so that the interval between the adjacent values of the ambient temperatures corresponding to the output values of the compensation temperature detecting section is 0.2 times the interval between the adjacent values of the temperatures of the heated object which temperatures correspond to the output values of the main temperature detecting section.

4. The temperature control device as set forth in claim 3, wherein the output values of the main temperature detecting section in the temperature correspondence table are set so that the interval between the adjacent values of the temperatures of the heated object which temperatures correspond to the output values of the main temperature detecting section in the temperature correspondence table is 0.5 times to 1 times a control temperature accuracy by the heating section with respect to the heated object.

5. The temperature control device as set forth in claim 3, wherein the output values of the main temperature detecting section in the temperature correspondence table are set so that the interval between the adjacent values of the temperatures of the heated object which temperatures correspond to the output values of the main temperature detecting section in the temperature correspondence table is 0.5 times to 1 times a detection temperature accuracy by the main temperature detecting section.

6. The temperature control device as set forth in claim 1, wherein:

the memory section stores one piece or plural pieces of first correction value data each of which is data of correction values for respective temperatures corresponding to the output values of the compensation temperature detecting section;

the temperature calculating section corrects the temperature, obtained by referring to the temperature correspondence table, by using the correction value of the first correction value data on the basis of the temperature corresponding to the output value of the compensation temperature detecting section; and the heat control section controls the heating power of the heating section on the basis of the temperature corrected by the temperature calculating section.

7. The temperature control device as set forth in claim 6, wherein:

the memory section stores plural pieces of the first correction value data, these pieces being different from each other depending on environmental conditions; and the temperature calculating section selects the first correction value data, to be used for correction, from the plural pieces of the first correction value data on the basis of the environmental condition.

8. The temperature control device as set forth in claim 6, wherein:

the temperature calculating section obtains, from the corrected temperature, a rate of change of the temperature of the heated object per unit time; and when the corrected temperature is higher than a high-temperature threshold value and the rate of change is higher than a threshold value, the temperature calculating section further corrects the corrected temperature by using the correction value corresponding to the rate of change or by using a predetermined correction value.

9. The temperature control device as set forth in claim 1, wherein:

the heated object is a fixing section which heats print mediums, conveyed sequentially, so as to fix a toner image transferred onto the print mediums;

the memory section stores one piece or plural pieces of second correction value data each of which is data of correction values for respective amounts of the print mediums fixed sequentially;

the temperature calculating section corrects the temperature, obtained by referring to the temperature correspondence table, by using the correction value of the second correction value data on the basis of the amount of the print mediums fixed sequentially; and the heat control section controls the heating power of the heating section on the basis of the temperature corrected by the temperature calculating section.

10. The temperature control device as set forth in claim 9, wherein:

the memory section stores the second correction value data for respective sizes of the print medium to be fixed; and the temperature calculating section uses the second correction value data corresponding to the size of the print medium to be fixed, so as to correct the temperature obtained by referring to the temperature correspondence table.

11. The temperature control device as set forth in claim 10, further comprising an information acquiring section which acquires information regarding the size of the print medium, the temperature calculating section identifying the size of the print medium, to be fixed, on the basis of the information acquired by the information acquiring section.

12. The temperature control device as set forth in claim 9, wherein:

the memory section stores the second correction value data for respective types of the print medium to be fixed; and the temperature calculating section uses the second correction value data corresponding to the type of the print medium to be fixed, so as to correct the temperature obtained by referring to the temperature correspondence table.

13. The temperature control device as set forth in claim 12, further comprising an information acquiring section which acquires information regarding the type of the print medium, the temperature calculating section identifying the type of the print medium, to be fixed, on the basis of the information acquired by the information acquiring section.

14. The temperature control device as set forth in claim 9, wherein:

the fixing section includes a fixing roller;

the memory section stores the second correction value data for respective widths of the print medium in an axial direction of the fixing roller; and the temperature calculating section uses the second correction value data corresponding to the width of the print medium in the axial direction of the fixing roller so as to correct the temperature obtained by referring to the temperature correspondence table.

15. The temperature control device as set forth in claim 14, further comprising a width detecting section which detects the width of the print medium in the axial direction of the fixing roller, the temperature calculating section selecting the second correction value data corresponding to the width of the print medium in the axial direction of the fixing roller on the basis of the width, detected by the width detecting section, of the print medium in the axial direction of the fixing roller.

16. The temperature control device as set forth in claim 9, wherein:

the memory section stores at least two types of the second correction value data, one of the two types being used when a toner image is fixed only on one surface of the print medium and another of the two types being used when the toner image is fixed on both surfaces of the print medium; and the temperature calculating section selects one of at least the two types of the second correction value data depending on whether the toner image is fixed only on one surface of the print medium or on both surfaces of the printing medium, and uses the selected second correction value data so as to correct the temperature obtained by referring to the temperature correspondence table.

17. The temperature control device as set forth in claim 1, wherein:

the heated object is a fixing roller which heats a conveyed print medium so as to fix a toner image transferred onto the print medium;

the memory section stores third correction value data that is data of correction values for respective rotation states of the fixing roller;

the temperature calculating section corrects the temperature, obtained by referring to the temperature correspondence table, by using the correction value of the third correction value data on the basis of the rotation state of the fixing roller; and the heat control section controls the heating power of the heating section on the basis of the temperature corrected by the temperature calculating section.

18. The temperature control device as set forth in claim 1, wherein:

the heat control section controls the heating power of the heating section on the basis of the temperature, obtained by the temperature calculating section, so that the heated object has a target temperature;

the memory section stores fourth correction value data that is data of correction values for respective target temperatures of the heated object;

the temperature calculating section corrects the temperature, obtained by referring to the temperature correspondence table, by using the correction value of the fourth correction value data on the basis of the target temperature of the heated object; and the heat control section controls the heating power of the heating section on the basis of the temperature corrected by the temperature calculating section.

19. The temperature control device as set forth in claim 1, wherein:

the heating section is a first heating section for heating a first region of the heated object;

the main temperature detecting section detects the heat generated by the infrared radiation from the first region of the heated object; and the heat control section is a first heat control section, the temperature control device further comprising:

a second temperature detecting section which detects a temperature of a second region, heated by a second heating section, of the heated object; and a second heat control section which controls the heating power of the second heating section on the basis of the temperature, detected by the second temperature detecting section, so that the second region of the heated object has the target temperature, the memory section storing fifth correction value data that is data of the correction values for respective target temperatures of the second region of the heated object, and the temperature calculating section correcting the temperature, obtained by referring to the temperature correspondence table, by using the correction value of the fifth correction value data on the basis of the target temperature of the second region.

20. The temperature control device as set forth in claim 1, wherein the heat control section controls the heating power of the heating section in a cycle 0.25 times or less a response speed of the temperature detecting section including the main temperature detecting section and the compensation temperature detecting section.

21. The temperature control device as set forth in claim 1, wherein each of the main temperature detecting section and the compensation temperature detecting section outputs an analog voltage signal, the temperature control device further comprising an A/D converting section which converts the analog voltage signal, output from each of the main temperature detecting section and the compensation temperature detecting section, into a digital signal by using a predetermined reference voltage, each of a voltage for driving the main temperature detecting section and a voltage for driving the compensation temperature detecting section being 95% to 100% of the reference voltage.

22. The temperature control device as set forth in claim 1, wherein:

each of the main temperature detecting section and the compensation temperature detecting section is connected in series to a pull-up resistor; and a tolerance of a resistance value of the pull-up resistor is within ±1% of a nominal value.

23. The temperature control device as set forth in claim 1, wherein each of the main temperature detecting section and the compensation temperature detecting section outputs the output value as an analog signal, the temperature control device further comprising an A/D converting section which converts the output value, output from the main temperature detecting section, into a digital signal of 10 bits to 14 bits.

24. The temperature control device as set forth in claim 1, wherein:

each of the main temperature detecting section and the compensation temperature detecting section includes: a thermistor whose resistance value changes depending on a temperature; a pull-up resistor connected in series to the thermistor; and a signal amplifier connected to between a connection portion of the thermistor and the pull-up resistor and the temperature calculating section; and an input-offset voltage of the signal amplifier is 1 mV or less.

25. A fixing device comprising:

the temperature control device as set forth in claim 1;

the heating section controlled by the temperature control device; and a fixing section, as the heated object, which heats print mediums, conveyed sequentially, so as to fix the toner image transferred onto the print mediums.

26. An image forming apparatus comprising the fixing device as set forth in claim 25.

27. A temperature control device which controls a temperature of a fixing section which fixes a toner image transferred onto a print medium and is heated by a heating section, the temperature control device comprising:

a main thermistor which detects heat generated by infrared radiation from the fixing section;

a compensation thermistor which detects an ambient temperature of the main thermistor;

a memory section which stores (i) a temperature correspondence table in which correspondences between output values of the main thermistor and the temperatures of the fixing section are shown for respective output values of the compensation thermistor and (ii) data of correction values for respective types of the print medium and for respective numbers of the print mediums sequentially fixed by the fixing section;

a temperature calculating section which (i) refers to the temperature correspondence table so as to obtain the temperature of the fixing section from the output value of the main thermistor and the output value of the compensation thermistor and (ii) corrects the obtained temperature by using the correction value in the data of the correction values on the basis of the type of the print medium and the number of the print mediums fixed sequentially; and a heat control section which controls a heating power of the heating section on the basis of the temperature of the fixing section which temperature is corrected by the temperature calculating section, the output values of the main thermistor and the output values of the compensation thermistor in the temperature correspondence table being set so that an interval between adjacent values of the ambient temperatures corresponding to the output values of the compensation thermistor is smaller than an interval between adjacent values of the temperatures of the fixing section which temperatures correspond to the output values of the main thermistor.

28. A temperature control method for controlling a temperature of a heated object, heated by a heating section, by using (i) a main temperature detecting section which detects heat generated by infrared radiation from the heated object and (ii) a compensation temperature detecting section which detects an ambient temperature of the main temperature detecting section, the temperature control method comprising the steps of:

obtaining the temperature of the heated object from an output value of the main temperature detecting section and an output value of the compensation temperature detecting section by referring to a temperature correspondence table in which (i) correspondences between the output values of the main temperature detecting section and the temperatures of the heated object are shown for the respective output values of the compensation temperature detecting section and (ii) the output values of the compensation temperature detecting section and the output values of the main temperature detecting section are set so that an interval between adjacent values of the ambient temperatures corresponding to the output values of the compensation temperature detecting section is smaller than an interval between adjacent values of the temperatures of the heated object which temperatures correspond to the output values of the main temperature detecting section; and controlling a heating power of the heating section on the basis of the temperature obtained in the obtaining step.

29. A temperature control method for controlling a temperature of a first region of a heated object, whose first region is heated by a first heating section and whose second region is heated by a second heating section, by using (i) a main temperature detecting section which detects heat generated by infrared radiation from the first region of the heated object and (ii) a compensation temperature detecting section which detects an ambient temperature of the main temperature detecting section, the temperature control method comprising the steps of:

obtaining the temperature of the first region of the heated object from the output value of the main temperature detecting section and the output value of the compensation temperature detecting section by referring to a temperature correspondence table in which (i) correspondences between the output values of the main temperature detecting section and the temperatures of the first region of the heated object are shown for respective output values of the compensation temperature detecting section and (ii) the output values of the compensation temperature detecting section and the output values of the main temperature detecting section are set so that an interval between adjacent values of the ambient temperatures corresponding to the output values of the compensation temperature detecting section is smaller than an interval between adjacent values of the temperatures of the first region of the heated object which temperatures correspond to the output values of the main temperature detecting section;

correcting the temperature, obtained in the obtaining step, by using data of correction values for respective target temperatures of the second region of the heated object on the basis of the target temperature of the second region of the heated object; and controlling a heating power of the first heating section on the basis of the temperature corrected in the correcting step.

30. A computer-readable non-transitory recording medium storing computer software which will cause a computer processor to perform a series of steps to calculate a temperature of a heated object, the series of steps comprising:

obtaining an output value from a main temperature detecting section which detects infrared radiation generated by the heated object;

obtaining an output value from a compensation temperature detecting section which detects an ambient temperature of the main temperature detecting section; and determining the temperature of the heated object based on the output value of the main temperature detecting section and the output value of the compensation temperature detecting section by referring to a temperature correspondence table in which (i) correspondences between the output values of the main temperature detecting section and the temperatures of the heated object are shown for the respective output values of the compensation temperature detecting section and (ii) the output values of the compensation temperature detecting section and the output values of the main temperature detecting section are set so that an interval between adjacent values of the ambient temperatures corresponding to the output values of the compensation temperature detecting section is smaller than an interval between adjacent values of the temperatures of the heated object which temperatures correspond to the output values of the main temperature detecting section.

* * * * *